US011345575B2

(12) United States Patent
Nguyen

(10) Patent No.: US 11,345,575 B2
(45) **Date of Patent: *May 31, 2022**

(54) CLAMPING DEVICE FOR LIFTING AND TRANSFER OBJECTS

(71) Applicant: Hoa Nhon Nguyen, Bankstown (AU)

(72) Inventor: Hoa Nhon Nguyen, Bankstown (AU)

( * ) Notice: Subject to any disclaimer, the term of this patent is extended or adjusted under 35 U.S.C. 154(b) by 0 days.

This patent is subject to a terminal disclaimer.

(21) Appl. No.: 15/905,010

(22) Filed: Feb. 26, 2018

(65) Prior Publication Data

US 2021/0238015 A1 Aug. 5, 2021

Related U.S. Application Data

(63) Continuation-in-part of application No. 15/479,283, filed on Apr. 5, 2017, now Pat. No. 9,908,748, and a continuation-in-part of application No. 15/438,735, filed on Feb. 21, 2017, now Pat. No. 9,902,574.

(51) Int. Cl.
*B66C 1/44* (2006.01)

(52) U.S. Cl.
CPC ..... *B66C 1/44* (2013.01)

(58) Field of Classification Search
CPC ..... B66C 1/44; B66C 1/48; Y10S 294/901; B25J 15/08
USPC ..... 294/103.1, 102.1, 115, 116
See application file for complete search history.

(56) References Cited

U.S. PATENT DOCUMENTS

| | | | | | |
|---|---|---|---|---|---|
| 2,360,365 | A * | 10/1944 | Renfroe | B66C 1/48 | 294/104 |
| 3,153,555 | A * | 10/1964 | Kaplan | B66C 1/485 | 294/197 |
| 3,524,670 | A * | 8/1970 | Ilich | B65G 7/12 | 294/164 |
| 4,299,535 | A * | 11/1981 | Brockman | F04D 29/462 | 415/160 |
| 5,893,595 | A * | 4/1999 | Corbett | B66C 1/442 | 294/102.1 |
| 6,113,167 | A * | 9/2000 | Mattis | B65G 7/12 | 294/104 |
| 7,156,436 | B2 * | 1/2007 | Nguyen | B66C 1/442 | 294/102.1 |
| 9,902,574 | B1 * | 2/2018 | Nguyen | B65G 1/04 | |
| 9,908,748 | B1 * | 3/2018 | Nguyen | B66C 1/442 | |
| 10,889,472 | B2 * | 1/2021 | Nguyen | B66C 1/44 | |
| 2006/0163892 | A1 * | 7/2006 | Nguyen | B66C 1/48 | 294/103.1 |
| 2006/0202496 | A1 * | 9/2006 | Davis | B66C 1/442 | 294/102.1 |
| 2019/0144245 | A1 * | 5/2019 | Corbett | B66C 1/48 | 294/104 |

* cited by examiner

*Primary Examiner* — Paul T Chin
(74) *Attorney, Agent, or Firm* — Tue Nguyen

(57) ABSTRACT

A clamping device for lifting and transferring objects can employ slanting interfaces to convert a pulling action on the clamping device to a clamping action on the object. A pulling element in the form of a triangle can be disposed between a jaw and a jaw support of the clamping device. When the pulling element is pulled up, the base of the triangle shape pulling element can exert a force on the jaw against the jaw support, for securing a gripping action on the object.

15 Claims, 52 Drawing Sheets

Forming a clamping device, wherein the clamping device comprises a jaw and a jaw support, wherein the jaw and the jaw support is coupled with a slanting angle, wherein the slanting angle is configured so that when the jaw moves down, the jaw also moves toward an object
300

*FIG. 3A*

Forming a clamping device, wherein the clamping device comprises a clamp bar, a first jaw fixedly coupled to the clamp bar, and a jaw support assembly movably fixedly coupled to the clamp bar, wherein the jaw support assembly comprises a second jaw and a jaw support, wherein the second jaw and the jaw support is coupled with a slanting angle, wherein the slanting angle is configured so that when the second jaw moves down, the second jaw also moves toward an object supported between the first and second jaw for keeping the object in place
320

*FIG. 3B*

Placing an object between a first jaw and a second jaw of a clamping device, wherein the second jaw is coupled to a jaw support with a slanting angle, wherein the slanting angle is configured so that when the object moves down, the object makes the second jaw moving toward the object for keeping the object in place
340

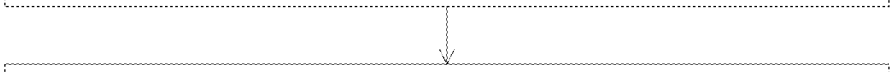

Lifting the clamping device to move the object
350

*FIG. 3C*

Forming a clamping device, wherein the clamping device comprises a first jaw fixedly coupled to a clamp bar, and a second jaw assembly movably and fixedly coupled to the clamp bar, wherein the second jaw assembly comprises a second jaw and a jaw support, together with a pulling element disposed between the second jaw and the jaw support, wherein there is at least a slanting interface coupling between the pulling element and the second jaw or between the pulling element and the jaw support, wherein the slanting interface is configured so that when the pulling element moves up, the second jaw moves toward an object for keeping the object in place
500

*FIG. 5A*

Placing an object between a first jaw and a second jaw of a clamping device, wherein the second jaw is part of a jaw assembly, wherein the jaw assembly further comprises a jaw support and a pulling element disposed between the second jaw and the jaw support, wherein there is at least a slanting interface coupling between the pulling element and the second jaw or between the pulling element and the jaw support
520

Optionally locking the jaw assembly so that the object is disposed between the first jaw and the second jaw
530

Lifting the pulling element which moves the second jaw toward the object, since the slanting interface is configured so that when the pulling element moves up, the second jaw moves toward the object
540

*FIG. 5B*

Forming a clamping device, wherein the clamping device comprises a first jaw fixedly coupled to a clamp bar, and a second jaw assembly movably and fixedly coupled to the clamp bar, wherein the second jaw assembly comprises at least two components coupled through a slanting surface interface, wherein the slanting surface is configured so that when one component moves down, it also moves toward an object disposed between the first jaw and the second jaw assembly, wherein the slanting surface comprises a rolling friction
700

*FIG. 7A*

Placing an object between a first jaw and a second jaw of a clamping device, wherein the second jaw is part of a jaw assembly, wherein the jaw assembly further comprises a jaw support and a hanging element disposed between the second jaw and the jaw support, wherein there is at least a slanting surface interface coupling the hanging element and the second jaw or coupling the hanging element and the jaw support, wherein the slanting surface comprises a rolling friction
720

Optionally locking the jaw assembly so that the object is disposed between a fixed first jaw and a fixed jaw support
730

Lifting the hanging element which moves the second jaw toward the object, since the slanting surface interface comprises a rolling friction, the second jaw moves toward the object when the hanging element moves up
740

*FIG. 7B*

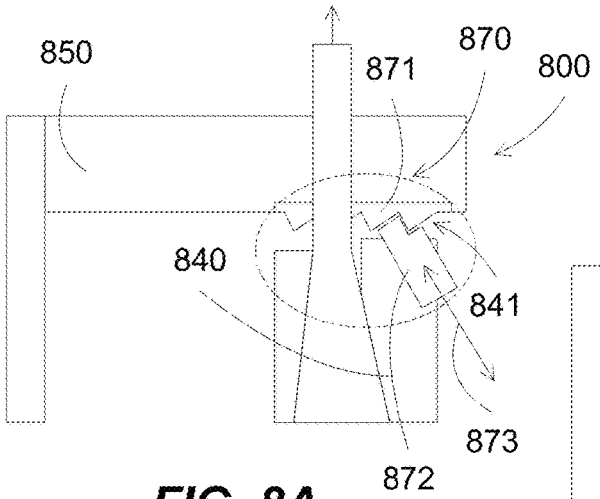
FIG. 8A
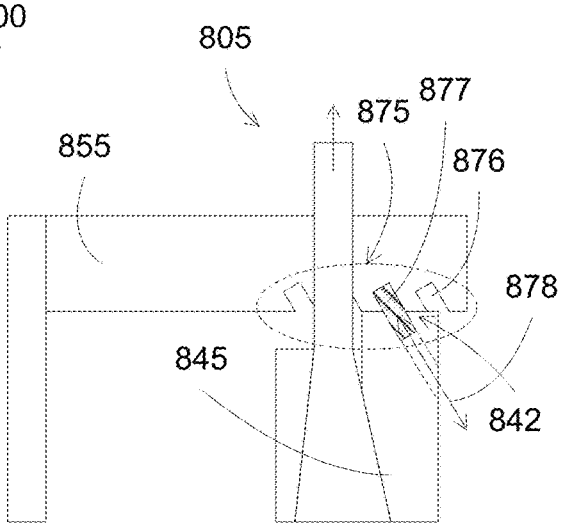
FIG. 8B
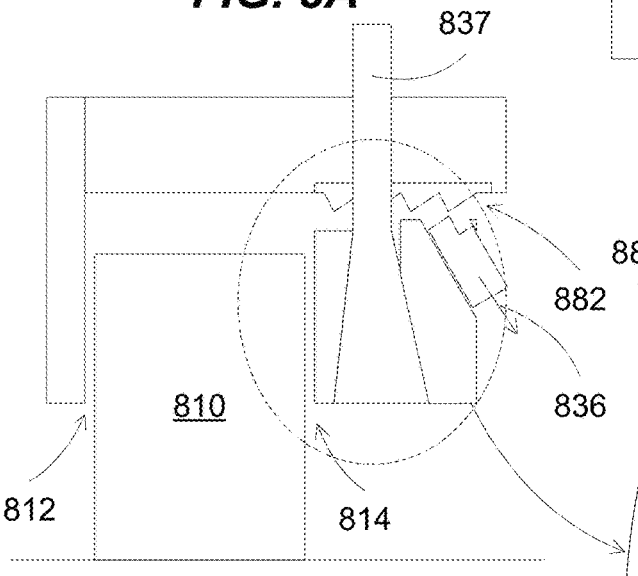
FIG. 8C
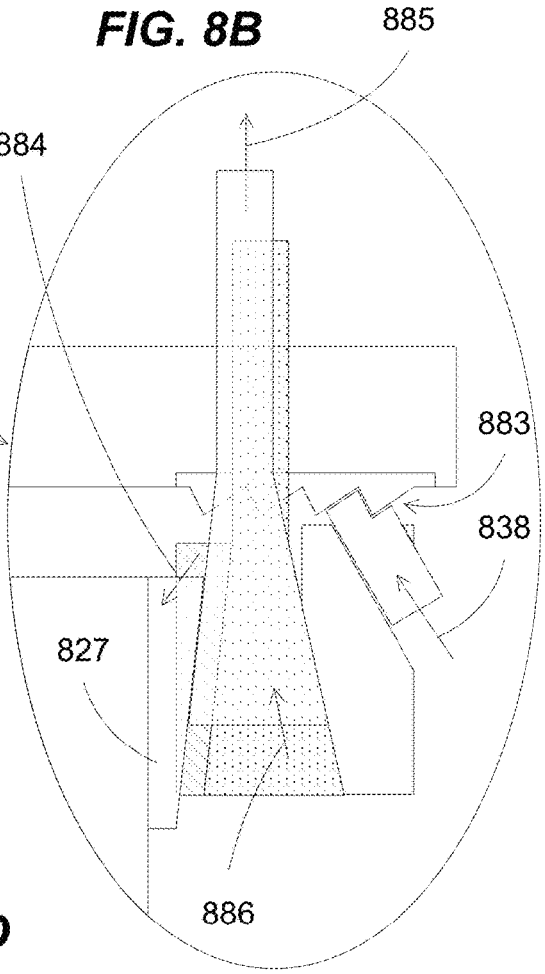
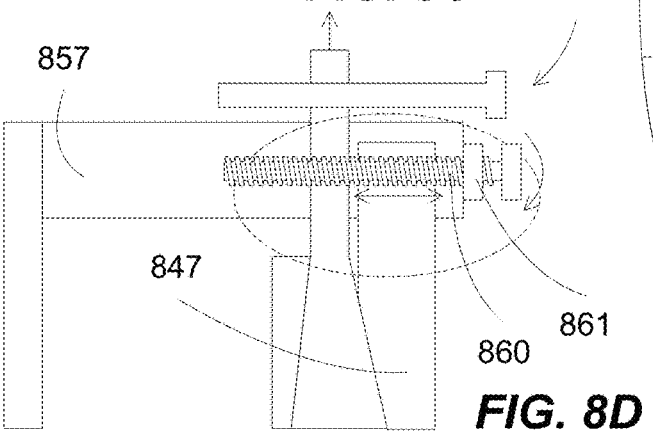
FIG. 8D Forming a clamping device, wherein the clamping device comprises a first jaw fixedly coupled to a clamp bar, and a second jaw assembly movably and fixedly coupled to the clamp bar, wherein the second jaw assembly comprises a locking mechanism for fixedly coupling the second jaw assembly to the clamp bar, wherein the locking mechanism is configured to secure the second jaw assembly to the clamp bar continuously or at discrete locations
900

*FIG. 9A*

Placing an object between a first jaw and a second jaw of a clamping device, wherein the second jaw is part of a jaw assembly, wherein the jaw assembly further comprises a locking mechanism for securing the jaw assembly with respect to the first jaw, wherein the locking mechanism is configured to secure the jaw assembly at discrete locations
920

↓

Unlocking the locking mechanism to place an object between the first jaw and the second jaw
930

↓

Locking the locking mechanism at a location to achieve a minimum gap between the first and second jaws with the object
940

↓

Lifting the clamping device to secure the object between the first and second jaws
950

↓

Lifting the clamping device to move the object
960

*FIG. 9B*

Forming a clamping device, wherein the clamping device comprises a first jaw coupled to a clamp bar, and a jaw assembly coupled to the clamp bar, wherein the jaw assembly comprises a second jaw disposed opposite the first jaw for clamping on an object,
wherein the jaw assembly comprises a jaw support,
wherein the jaw assembly comprises a hanging element disposed between the second jaw and the jaw support,
wherein at least an interface between the hanging element and the jaw support and an interface between the hanging element and the second jaw comprises a slanting surface,
wherein the slanting surface is configured so that when the clamping device is lifted up from the hanging element, the second jaw is configured to press on the object
2400

*FIG. 24A*

Forming a clamping device, wherein the clamping device comprises a clamp bar, a first jaw, and a jaw assembly,
wherein the jaw assembly comprises a jaw support, wherein at least one of the first jar or the jaw support is configured to movably couple to the clamp bar and to lockably coupled to the clamp bar at discrete positions through a locking mechanism,
wherein the jaw assembly comprises a second jaw disposed opposite the first jaw for clamping on an object, wherein the second jaw is coupled to the jaw support through a flexible component to allow the second jaw to move in multiple directions with respect to the jaw support,
wherein the jaw assembly comprises a hanging element disposed between the second jaw and the jaw support,
wherein at least an interface between the hanging element and the jaw support and an interface between the hanging element and the second jaw comprises a slanting surface, wherein the slanting surface interface comprises a rolling friction,
wherein the slanting surface is configured so that when the hanging element moves in a direction comprising a vertical direction, the second jaw moves away relative to the jaw support in a direction comprising a horizontal direction.
2420

*FIG. 24B*

Forming a clamping device, wherein the clamping device comprises a first jaw coupled to a clamp bar, and a jaw assembly coupled to the clamp bar, wherein the jaw assembly comprises a second jaw disposed opposite the first jaw for clamping on an object,
wherein the jaw assembly comprises a jaw support,
wherein the jaw assembly comprises a hanging element disposed between the second jaw and the jaw support,
wherein at least an interface between the hanging element and the jaw support and an interface between the hanging element and the second jaw comprises a slanting surface,
wherein the slanting surface is configured so that when the clamping device is lifted up from the hanging element, the second jaw is configured to press on the object
4900

*FIG. 49A*

Forming a clamping device, wherein the clamping device comprises a clamp bar, a first jaw, and a jaw assembly,
wherein the jaw assembly comprises a jaw support, wherein at least one of the first jar or the jaw support is configured to movably couple to the clamp bar and to lockably coupled to the clamp bar at discrete positions through a locking mechanism,
wherein the jaw assembly comprises a second jaw disposed opposite the first jaw for clamping on an object, wherein the second jaw is coupled to the jaw support through a flexible component to allow the second jaw to move in multiple directions with respect to the jaw support,
wherein the jaw assembly comprises a hanging element disposed between the second jaw and the jaw support,
wherein at least an interface between the hanging element and the jaw support and an interface between the hanging element and the second jaw comprises a slanting surface, wherein the slanting surface interface comprises a rolling friction,
wherein the slanting surface is configured so that when the hanging element moves in a direction comprising a vertical direction, the second jaw moves away relative to the jaw support in a direction comprising a horizontal direction.
4920

*FIG. 49B*

CLAMPING DEVICE FOR LIFTING AND TRANSFER OBJECTS

The present invention is a continuation-in-part of application Ser. No. 15/438,735, filed on Feb. 21, 2017, entitled "Clamping device for lifting and transfer objects", U.S. Pat. No. 9,902,574, hereby incorporated by reference in its entirety.

The present invention is also a continuation-in-part of application Ser. No. 15/479,283, filed on Apr. 5, 2017, entitled "Clamping device with metal cores", U.S. Pat. No. 9,908,748, hereby incorporated by reference in its entirety.

The present invention relates to lifting devices. More particularly, it relates to clamping devices for lifting and transferring objects such as metal or ceramic plates.

BACKGROUND

In the heavy industry, large and heavy products can be difficult to handle manually. Thus, a hoist connecting to a clamping device can be used to lift and move heavy objects. An object can be clamped to a clamping device that is coupled to a hoist. The hoist can lift the object to a certain height, and then transfer to a proper location.

The clamping devices can utilize a mechanism that converts the weight of the object into a clamping force, thus the holding force on the object exerted by the clamping devices can be proportional to the weight of the object. A loading and unloading device, such as a crane or a hoist, can be coupled to the clamping device for lifting and transferring the objects.

A basic prior art clamping device can include a rotatable clamping jaw, which can rotate to change a spacing distance to a fixed clamping jaw. Rotation of the rotatable clamping jaw can enlarge or narrow the distance between the two clamp jaws. For example, an object can be placed between the two jaws from a bottom position, and the pushed upward toward the gap between the two jaws. The upward motion of the object can cause a clockwise rotation of the rotatable clamping jaw, which can make the distance between the two jaws larger, to accommodate an object. After the object is placed between the two jaws, the weight of the object can cause the object to move downward. The downward motion of the object can cause a counterclockwise rotation of the rotatable clamping jaw, which can narrow the distance between the two jaws, or to exert a clamping force on the object.

FIG. 1A illustrates a prior art rotatable clamping device according to some embodiments. A clamping device 100 can include a clamp body 110, which can house a fixed clamp jaw 130 and a rotatable clamp jaw 120. The fixed clamp jaw and the rotatable clamp jaw can be configured to clamp an object 160. The rotatable clamp jaw can have an offset center of rotation 150, thus when the rotatable clamp jaw rotates counter clockwise, it comes closer to the fixed clamp jaw 130. That way the clamping device can support a number of sizes of objects. A spring 140 can preload the rotatable clamp jaw, e.g., to push the rotatable clamp jaw toward the fixed clamp jaw.

In operation, when the clamping device 100 is empty, e.g., when there is no object in the clamping device, the spring 140 pushes the rotatable clamp jaw counterclockwise toward the fixed clamp jaw, so there is no gap between the two jaws. An object 160 can be pushed in the clamping device, for example, upward to the space between the two jaws from a bottom position. The pushing action can open the gap between the two jaws by rotating the rotatable clamp jaw clockwise.

Gravity then hold the object in place, e.g., when the object is pulling out of the clamping device, for example, in a downward direction, the rotatable clamp jaw is rotated counterclockwise due to friction between the object and the contact surface of the rotatable clamp jaw. The rotation exerts a force on the object, preventing the object from being pulled out of the clamping device.

The rotatable clamping device can be compact and simple. But there can be focused force at the rotatable clamp jaw, e.g., at the contact area of the rotatable clamp jaw with the object. Thus the rotatable clamping device is not designed to handle heavy object, since heavy object requires a large clamping force, and the focused large clamping force might cause damage to the object.

Another prior art clamping device can include a gripping device normally fabricated from structural steel components, that are designed to securely hold and lift construction materials though a scissor movement. The gripping device can use freely rotating pin connections to create a scissor configuration with two scissor arms.

A first end of the scissor arms is configured to rotate towards each other in reaction to the opposite second end of the scissor arms being lifted vertically. The first end of the scissor arms rotate inwards and generate a compression force clamping on the object to be lifted. Essentially, the weight of the object is used to generate this clamping action.

FIG. 1B illustrates a prior art gripping device according to some embodiments.

A gripping device 105 can include two scissor arms 125 and 155, which can freely rotate about a pivot point 135. The scissor arms 125 and 155 can include upper arms 121 and 151, together with lower arms 122 and 152, respectively, connected through the freely rotating pivot 135.

The upper arms 121 and 151 can be coupled to pulling elements 141 and 142, respectively. The coupling between the upper arms and the pulling elements can include freely rotating pin connections, e.g., the pulling element 141/142 can be rotated relative to the upper arm 121/151. The pulling elements 141 and 142 can be coupled to a lift 145, such as a hoist. The coupling between the pulling elements and the lift can include freely rotating pin connections, e.g., the pulling elements 141 and 142 can be rotated relative to the lift 145.

The lower arms 122 and 152 can be coupled to holding pads 111 and 112, respectively. The coupling between the lower arms and the holding pads can include freely rotating pin connections, e.g., the holding pads 111/112 can be rotated relative to the lower arm 122/152.

In operation, an object 165 is placed between the holding pads 111 and 112. The lift 145 is pulled up, which pulls on the pulling elements 141 and 142. The pulling elements 141 and 142 can in turn pull on the upper arms 121 and 151. The scissor movement between the upper arms 121/151 and the lower arms 122/152 around the pivot point 135 can turn the pulling action on the upper arm 121/151 into a pressing action of the lower arm 122/152, which presses on the object 165 through the holding pads 111 and 112.

Disadvantages of the gripper devices can include large sizes due to the long arms. For example, if the friction coefficient between the holding pads and the object is about 0.2, then a five times the weight of the object is needed to hold the object. In other words, the ratio of the upper arms and the lower arms is also about five to obtain the holding force.

SUMMARY OF THE EMBODIMENTS

In some embodiments, the present invention discloses a clamping device for lifting and transferring objects. The clamping device can employ slanting interfaces to convert a pulling action on the clamping device to a clamping action on the object.

The clamping device can include a jaw and a jaw assembly coupled to a clamp bar. The jaw assembly can include a second jaw and a jaw support facing each other. The jaw support can have a slanting surface, such as the jaw and the jaw support can form a hollow cavity in the shape of a triangle. A pulling element in the form of a mating triangle can be disposed in the hollow cavity between the jaw and the jaw support. When the pulling element is pulled up, the base of the triangle shape pulling element can exert a force on the jaw against the jaw support, for securing a gripping action on the object.

In some embodiments, components of the clamping device can include a metal core embedded in a body of a different material. The embedded core construction can allow a simplified fabrication of the clamping device for high stresses, high forces, high durability and high reliability.

BRIEF DESCRIPTION OF THE DRAWINGS

FIGS. 3A-3C illustrate flow charts for forming and operating a clamping device according to some embodiments.

FIGS. 5A-5B illustrate flow charts for forming and operating a three-part clamping device according to some embodiments.

FIGS. 7A-7B illustrate flow charts for forming and operating clamping devices with rolling frictions according to some embodiments.

FIGS. 8A-8D illustrate configurations for clamping devices with locking mechanisms according to some embodiments.

FIGS. 9A-9B illustrate flow charts for forming and operating clamping devices with rolling frictions according to some embodiments.

FIGS. 24A-24B illustrate flow charts for forming a clamping device according to some embodiments.

FIGS. 49A-49B illustrate operations of a clamping device according to some embodiments.

DETAILED DESCRIPTION OF THE EMBODIMENTS

Figure 1A:
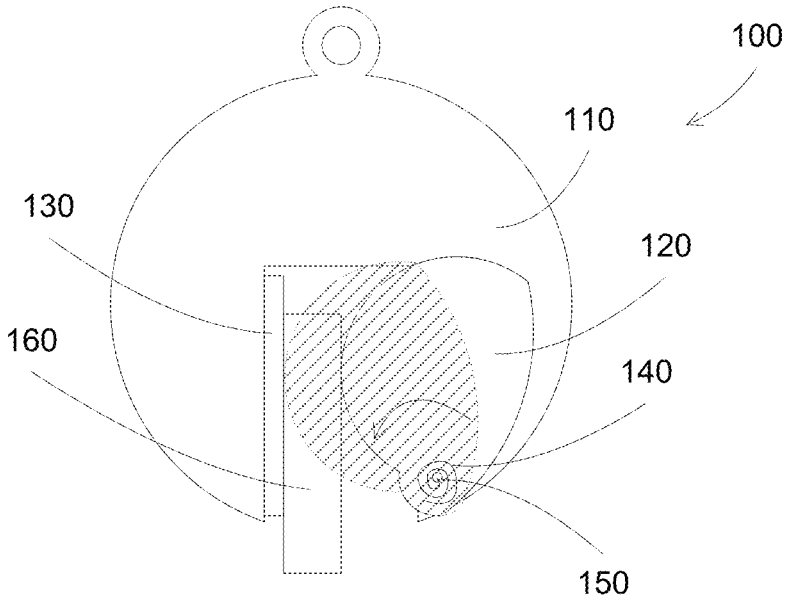
FIGS. 1A-1B illustrates a prior art devices according to some embodiments.
Figure 1B:
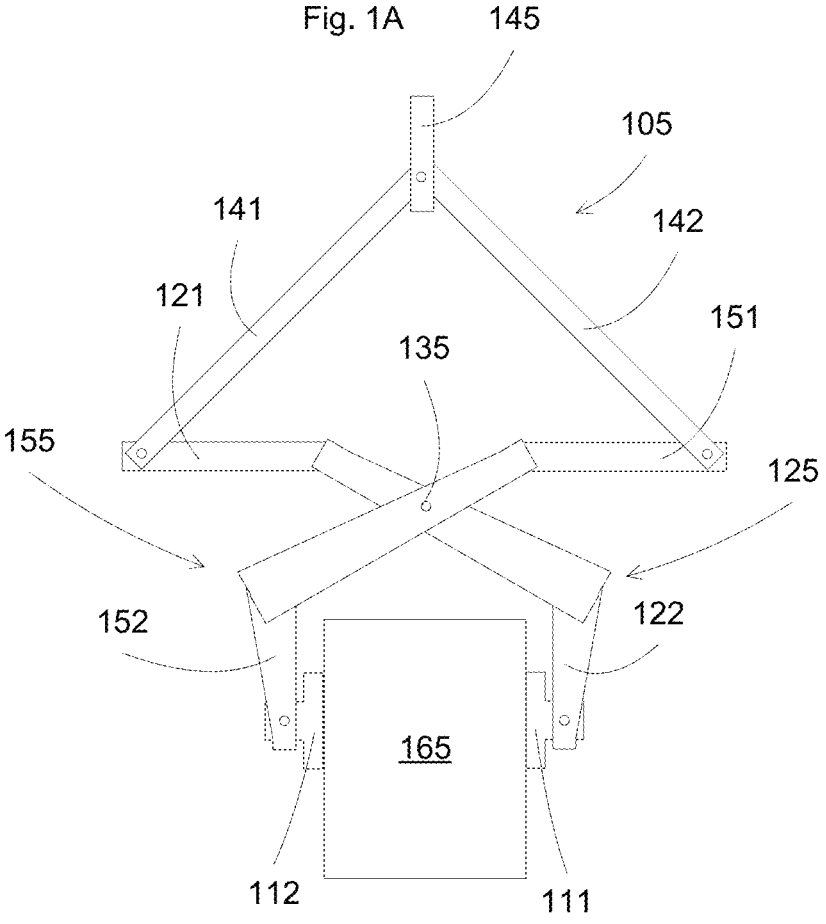
Fig. 1B (Prior Art)

In some embodiments, the present invention discloses a clamping device for lifting and/or transferring objects, such as metal, granite, ceramic, glass, quartz, or concrete plates. The clamping device can use a slanting surface to convert the weight of the object into a compression force for clamping and holding the object. The slanting surface can provide a high ratio of force transfer. Due to the high conversion ratio, the clamping devices using slanting surface can be compact for lifting and transferring heavy objects.

In some embodiments, a clamping device can include two jaw assemblies coupled to a clamp bar, e.g., a connection element. The jaw assemblies can be disposed away and facing each other. Each jaw assembly can include a jaw for clamping on an object. A jaw assembly can include other components, such as a high friction pad, e.g., a rubber pad with high surface area pattern, coupled to a surface of the jaw for holding the object. The jaw assembly can be coupled to the clamp bar through the jaw, e.g., it is the jaw that is coupled to the clamp bar, and the other components, such as the rubber pad, can be coupled to the jaw.

A jaw assembly can include a jaw support, in addition to the jaw and optionally the rubber pad. The jaw assembly can be coupled to the clamp bar through the jaw support, e.g., it is the jaw support that is coupled to the clamp bar, and the other components, such as the jaw, can be coupled to the jaw support. The other components can be coupled to the components that are coupled to the jaw support, such as the rubber pad is coupled to the jaw.

In some embodiments, there are two jaw supports coupled to the clamp bar. The clamping device thus can include a first jaw assembly having a first jaw and a first rubber pad coupled to the first jaw support, and a second jaw assembly having a second jaw and a second rubber pad coupled to the second jaw support.

In some embodiments, there are one first jaw and one jaw support coupled to the clamp bar. The clamping device thus can include a first jaw assembly having the first jaw and a first rubber pad. The clamping device can include a second jaw assembly having a second jaw and a second rubber pad coupled to the jaw support.

The jaw assemblies can be fixedly coupled to the clamp bar, or can be movably coupled to the clamp bar. If movably coupled to the clamp bar, the jaw assemblies can be secured, e.g., fixedly coupled to the clamp bar when secured, and movable when unsecured. The movable jaw assemblies can be used to adjust a distance between the jaws for accommodating different sizes of the object to be clamped and lifted. After the object is placed between the jaws, e.g., after the opening between the jaws is large enough to accommodate the object, the movable jaw assemblies can be secured, e.g., fixedly coupled to the clamp bar.

In some embodiments, there are two jaw assemblies movably and securely coupled to the clamp bar. For example, a first jaw assembly can include a first jaw having an opening in which the clamp bar can pass through. Thus the first jaw (and the first jaw assembly) can be movable along the clamp bar. A first locking mechanism can be included to secure the first jaw to the clamp bar, such as a latch or a spring-loaded latch. The locking mechanism can be engaged, e.g., securing the jaw (and the jaw assembly) to the clamp bar, and/or disengaged, e.g., releasing the jaw (and the jaw assembly) from the clamp bar so that the jaw (and the jaw assembly) can be freely movable along the clamp bar, with or without a key.

Alternatively, a first jaw assembly can include a first jaw coupled to a first jaw support which has an opening in which the clamp bar can pass through. Thus the first jaw support (and the first jaw assembly) can be movable along the clamp bar. A first locking mechanism can be included to secure the first jaw support to the clamp bar, such as a latch or a spring-loaded latch. The locking mechanism can be engaged, e.g., securing the jaw support (and the jaw assembly) to the clamp bar, and/or disengaged, e.g., releasing the jaw support (and the jaw assembly) from the clamp bar so that the jaw support (and the jaw assembly) can be freely movable along the clamp bar, with or without a key.

The second jaw assembly can be similarly constructed. For example, the second jaw assembly can include a second jaw having an opening in which the clamp bar can pass through and a second locking mechanism to secure the second jaw to the clamp bar. Alternatively, the second jaw assembly can include a second jaw coupled to a jaw support which has an opening in which the clamp bar can pass through and a second locking mechanism to secure the second jaw support to the clamp bar.

In some embodiments, there are one first jaw assembly movably and securely coupled to the clamp bar and one second jaw assembly fixedly coupled to the clamp bar. For example, a first jaw assembly can include a first jaw having an opening in which the clamp bar can pass through. Thus the first jaw (and the first jaw assembly) can be movable along the clamp bar. A first locking mechanism can be included to secure the first jaw to the clamp bar, such as a latch or a spring-loaded latch. The locking mechanism can be engaged, e.g., securing the jaw (and the jaw assembly) to the clamp bar, and/or disengaged, e.g., releasing the jaw (and the jaw assembly) from the clamp bar so that the jaw (and the jaw assembly) can be freely movable along the clamp bar, with or without a key.

Alternatively, a first jaw assembly can include a first jaw coupled to a first jaw support which has having an opening in which the clamp bar can pass through. Thus the first jaw support (and the first jaw assembly) can be movable along the clamp bar. A first locking mechanism can be included to secure the first jaw support to the clamp bar, such as a latch or a spring-loaded latch. The locking mechanism can be engaged, e.g., securing the jaw support (and the jaw assembly) to the clamp bar, and/or disengaged, e.g., releasing the jaw support (and the jaw assembly) from the clamp bar so that the jaw support (and the jaw assembly) can be freely movable along the clamp bar, with or without a key.

The second jaw assembly can be fixedly coupled to the clamp bar. For example, the second jaw assembly can include a second jaw fixedly coupled to the clamp bar. Alternatively, the second jaw assembly can include a second jaw coupled to a jaw support which is fixedly coupled to the clamp bar.

In some embodiments, there are two jaw assemblies fixedly coupled to the clamp bar. For example, a first jaw assembly can include a first jaw which is fixedly coupled to the clamp bar, such as with a bolt set. Alternatively, the first jaw assembly can include a first jaw coupled to a first jaw support which is fixedly coupled to the clamp bar. Similarly, the second jaw assembly can include a second jaw which is fixedly coupled to the clamp bar. Alternatively, the second jaw assembly can include a second jaw coupled to a second jaw support which is fixedly coupled to the clamp bar.

In some embodiments, the clamp bar can include a connection bar having a round or substantially rectangular cross section, such as a rectangular shape with rounded corners. The connection bar can be large enough so that a fixed jaw assembly can be secured to. The connection bar can also be configured to let a movable jaw assembly pass through for moving along the clamp bar.

In some embodiments, the clamp bar can include multiple connection bars, such as multiple round rods or polygon rods. Each connection bar can be secured to a fixed jaw assembly with bolts, for example, at one end of the connection bar. The multiple connection bars can be distributed to provide structural support to the jaw assemblies.

In some embodiments, the clamping device can use a slanting surface to convert the weight of the object into a compression force for clamping and holding the object. The slanting surface can provide a high ratio of force transfer. Due to the high conversion ratio, the clamping devices using slanting surface can be compact for lifting and transferring heavy objects.

A slanting interface can be included in a jaw assembly, for example, between a jaw and a jaw support, or between the jaw support (or the jaw) and another component of the clamping device. When a hoist coupled to a clamping device is pulling upward, the upward force can be converted to a side force due to the slanting interface. Alternatively, when an object is sliding down from the clamping device, the weight of the object can be converted to the side force due to the slanting interface. The side force can press on the jaw of the jaw assembly for clamping on the object, preventing the object from being released or slide or dropped from the clamping device.

The clamping device can have one slanting interface, e.g., a first jaw assembly having the slanting interface and a second jaw assembly without a slanting interface. Alternatively, the clamping device can have two slanting interfaces, e.g., a first jaw assembly having two slanting interfaces, or a first jaw assembly having a first slanting interface and a second jaw assembly having a second slanting interface.

Figure 2A:
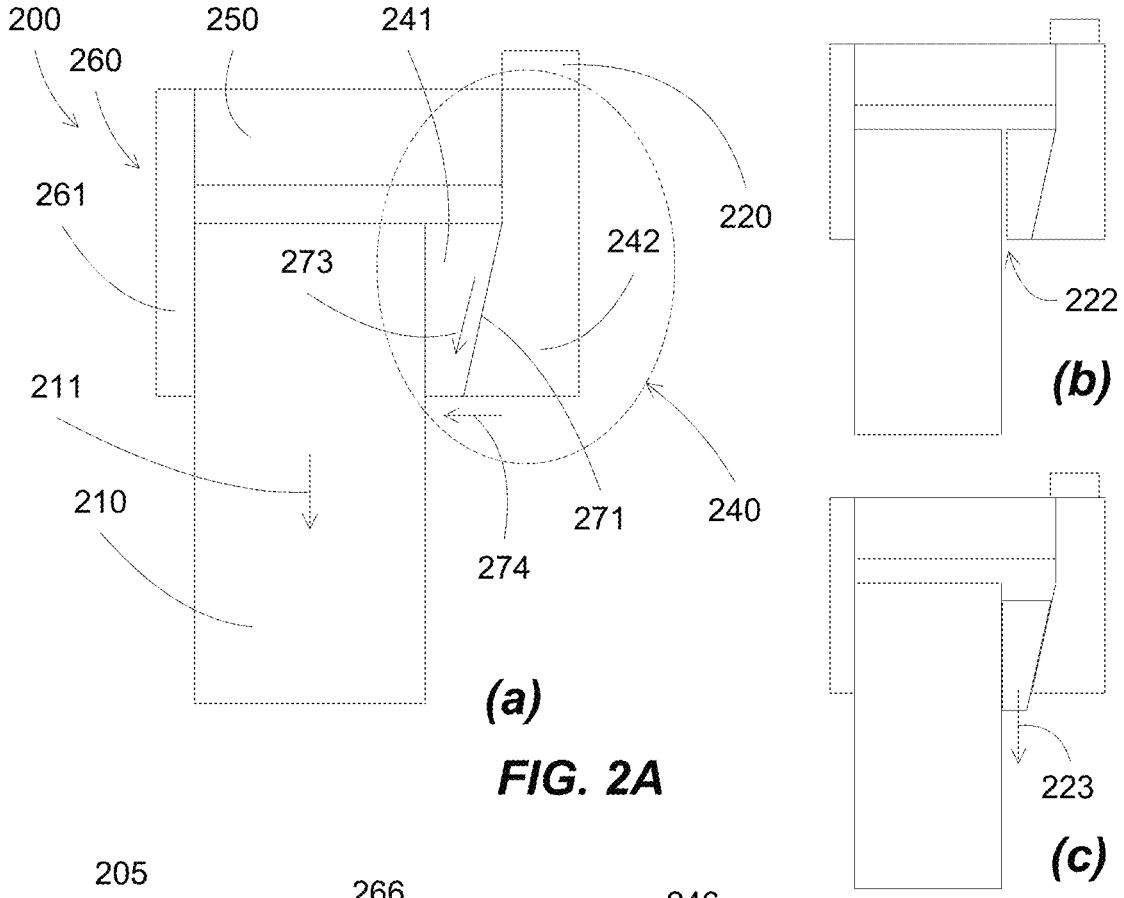
FIGS. 2A (a)-(c) and 2B illustrate clamping devices according to some embodiments.
Figure 2B:
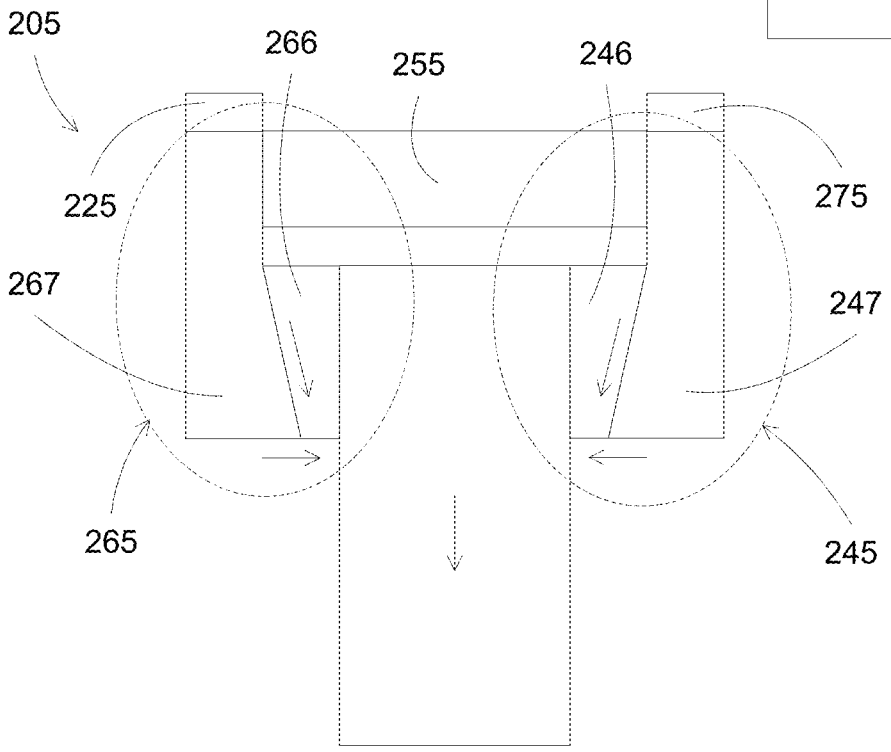

FIGS. 2A (a)-(c) and 2B illustrate clamping devices according to some embodiments. The clamping devices can have compact sizes for handle heavy objects. FIG. 2A (a)-(c) show a clamping device 200 having one slanting interface in a jaw assembly 240. FIG. 2B shows a clamping device 205 having two slanting interfaces in two jaw assemblies 245 and 265.

In FIG. 2A (a), a clamping device 200 can include two jaw assemblies 240 and 260 coupled to a clamp bar 250. The jaw assembly can include a jaw, or a jaw and a jaw support. As shown, the jaw assembly 260 includes a jaw 261. And the jaw assembly 240 includes a jaw 241 and a jaw support 242.

The jaw assembly can be fixedly coupled to the clamp bar, or can be movably and securably (or lockably) coupled to the clamp bar, using an optional locking mechanism. As shown, the jaw assemblies 260 and 240 are fixedly coupled to the clamp bar 250. Alternatively, the jaw assemblies can be movably coupled to the clamp bar, such as the jaw assembly 240 can be movably coupled to the clamp bar 250. For movable jaw assemblies, locking mechanisms, such as latch mechanisms, can be included for securing the jaw assemblies to the clamp bar.

The jaw assemblies 240 and 260 each can include a jaw for clamping on an object 210. For example, the jaw assembly 260 can include a first jaw 261. The jaw assembly 240 can include a second jaw 241, which together with the first jaw 261, pressing on the object 210 for clamping the object. The jaw assemblies can be fixedly coupled to the clamp bar. For example, the jaw assembly 260 can be fixedly coupled to the clamp bar 250 by securing the first jaw 261 with the clamp bar 250. The jaw assemblies can be movable along to the clamp bar, e.g., to accommodate different sizes of the object. Once the jaw opening between the jaws 241 and 261 is large enough to clamp on the object 210, the jaw support 240 can then be fixed to the clamp bar 250. For example, the jaw assembly 240 can be movable along the clamp bar 250 by sliding the jaw support 242 along the clamp bar 250. A locking mechanism 220 can be included to lock, e.g., to secure, the jaw assembly 240 to the clamp bar 250, for example, by latching the jaw support 242 to the clamp bar 250.

The jaw assembly 240 can include a slanting interface 271, which can include a slanting surface on the second jaw 241, mating with a slanting surface on the jaw support 242. At the slanting interface 271, e.g., at the mated slanting surfaces of the second jaw 241 and the jaw support 242, the second jaw 241 can move relative to the jaw support 242 along the slanting interface.

When the object 210 starts to move down due to gravity, the object can cause the second jaw to also start to move down due to a friction between the object and the second jaw. Alternatively, when the clamping device 200 starts to move up for lifting the object 210, the clamping device starts to cause the jaw support to move up.

The slanting interface 271 can be configured so that when the second jaw 241 starts to move down 273 (or when the jaw support 242 starts to move up), the second jaw can also start to move away 274 from the jaw support since the jaw support is secured to the clamp bar. The potential side movement of the second jaw can exert a force on the object, preventing the object from moving down, e.g., to clamp the object in place.

The slanting interface can be configured so that the second jaw 241 can move toward the object 210 when the second jaw 241 is moving down. Thus, if there is no obstacle blocking the movement of the second jaw, e.g., the object is not present or the object is not in contact with the second jaw, the second jaw is moving toward the object when the second jaw is moving downward.

The slanting interface can be configured so that when there is a downward force 273 acting on the second jaw 241, the downward force can be converted to a sideward force 274 toward the object. The downward force can be a force in any direction having a force component in a downward direction. The conversion of the downward force can be viewed as a decomposition or a splitting of the downward force into multiple force components, in which a force component has a sideward direction. Thus, if there is no obstacle blocking the movement of the second jaw, e.g., the object is not present or the object is not in contact with the second jaw, the second jaw is moving toward the object (in addition to the second jaw moving down) when there is a downward force acting on the second jaw. If there is an obstacle blocking the movement of the second jaw, e.g., the object is in contact with the second jaw, there is a sideward force from the second jaw pressing on the object.

The slanting interface can include a slanting surface making an acute angle with a vertical plane with a top portion of the slanting surface away from the object more than a bottom portion of the slanting surface. The slanting surface can be tilted toward the object at a bottom portion, or tilted away from the object at a top portion.

The slanting interface can have a low friction surface, e.g., lower than the friction between the object 210 and the second jaw 241. For example, the second jaw 241 can include a rubber layer facing the object, which can have high friction toward the object. The first jaw 261 can also include a rubber layer facing the object.

In some embodiments, the downward direction means the direction of the gravity. An upward direction means an opposite direction of the downward direction. A top portion can mean a portion in an upward direction, in opposite direction to a bottom portion, which can mean a portion in a downward direction.

A sideward direction means a horizontal direction, e.g., a direction perpendicular to the downward direction. Since the clamping device is configured to clamp, lift and transfer objects, the object exerts a downward force on the clamping device due to gravity, or the clamping device exerts an upward force on the object for lifting the object.

In operation, the object is first clamped between the jaws 261 and 241 of the clamping device. For clamping device with a movable jaw assembly, the locking mechanism of the movable jaw assembly can be disengaged, so that the movable jaw assembly is free to move along the clamp bar. The movable jaw assembly can be moving away from the jaw assembly to enlarge the opening between the two jaws. Once the opening is large enough to accommodate the object, the object can be placed between the jaws. The movable jaw assembly can then be moving toward the object so that the object is in contact with the jaws, or so that there is a minimum gap between the object and the jaws. The movable jaw assembly then can be secured to the clamp bar, for example, by engaging the locking mechanism.

There can be a gap 222 (FIG. 2A (b)) between the object and the jaws, e.g., the opening of the jaws of the clamping device configuration can be larger than the size of the object for ease of accepting the object. For example, a clamping device with fixed jaw assemblies can be selected to meet the object sizes. Alternatively, for clamping devices with fixed jaw assemblies, a locking mechanism can secure the movable jaw assembly to the clamp bar at discrete locations, and the engagable locations for the current object do not allow the object to be in contact. The location to engage the locking mechanism can be selected to ensure a minimum gap between the object and the jaws, meaning the distance between the object and the first and second jaw is smaller than the distance between two successive locking locations of the locking mechanism. The minimum gap can be achieved by moving the movable jaw assembly in a direction of narrowing the gap until the movable jaw assembly reaches the object, e.g., until the object is in contact with the jaws. The movable jaw assembly is then backed up, e.g., moving in an opposite direction of enlarging the gap, until reaching the first engagable location for the locking mechanism.

After placing the object between the jaws and locking the jaw assembly, one or both jaws can be adjusted, e.g., moved, so that the jaws are in contact with the object. The object can be moved so that it is in contact with the first jaw 261 (e.g., the jaw of the jaw assembly that cannot be moved), leaving a gap only between the object and the second jaw 241 (e.g., the jaw of the movable jaw assembly). Then the second jaw 241 can slide downward 223 (FIG. 2A (c)) (and moving toward the object at a same time due to the slanting interface), until the object is in contact with the second jaw. A force can be applied to the push the second jaw downward so that there is a good friction between the jaws and the object. This is to ensure that the object will not slide out the grip of the jaws. With a good friction between the object and the jaws, the slanting interface will assist in converting the weight of the object into a clamping force, which can hold the object between the jaws.

After the jaws are adjusted, e.g., the jaws are in contact with the object, the clamping device can be slowly lifted up. The weight of the object can pull the second jaw 241 down, since the friction at the slanting interface 271 is less than the friction between the object and the first and second jaws 261 and 241. Due to the slanting interface, the downward force 211 of the object weight can be converted to a force 273 along the slanting interface, which can be converted to a sideward force 274 toward the object. The sideward force 274 can exert a force on the object, holding the object in place, preventing the object from going down, e.g., slipping out of the jaws.

Advantages of the clamping device using the slanting interface can include compact size, since the clamping device includes two opposite jaw assemblies connected by a clamp bar. Further, the force clamping on the object can be well distributed throughout the surface of the jaws, meaning no focused point.

Further, the contact surfaces of the clamping device with the object can be scalable, meaning large size jaw pads can be used to accommodate heavy objects. Together with evenly distributed force, the clamping device can be gentle on the object, meaning the clamping device can be used on heavy fragile objects, such as granite, glass or ceramic plates.

FIG. 2B shows another configuration for a clamping device. A clamping device 205 can include two jaw assemblies 245 and 265 coupled to a clamp bar 255. The jaw assembly 265 includes a jaw 266 and a jaw support 267, together with a first slanting interface there between. And the jaw assembly 245 includes a jaw 246 and a jaw support 247, together with a second slanting interface there between. A first locking mechanism 225 can be used to secure the jaw assembly 265 to the clamp bar. A second locking mechanism 275 can be used to secure the jaw assembly 245 to the clamp bar.

With two jaw support assemblies, the object can be symmetrically oriented, thus the two jaws 246 and 266 can be pulling down together by the weight of the object. The two jaws then can be sliding toward the object, due to the slanting interfaces, and exerting forces on the object, keeping the object in place and preventing the object from moving out of the clamp device.

In some embodiments, the components of the clamping devices 200 and 205, such as the jaw supports 242, 247 and/or 267, the jaws 241, 261, 246, and/or 267, the clamp bars 250 and/or 255, can include a metal core embedded in a different material. The construction of the components using metal cores can be simpler and more cost effective while meeting the requirements of strength, hardness, durability and reliability.

FIGS. 3A-3C illustrate flow charts for forming and operating a clamping device according to some embodiments. In FIG. 3A, operation 300 forms a clamping device, wherein the clamping device comprises a jaw and a jaw support, wherein the jaw and the jaw support is coupled with a slanting surface, wherein the slanting surface is configured so that when the jaw moves down, the jaw also moves toward an object. The slanting surface can also be configured so that when there is a force comprising a downward direction acting on the jaw, there is a force comprising a sideward direction acting toward an object to be clamped by the clamping device.

In FIG. 3B, operation 320 forms a clamping device, wherein the clamping device comprises a clamp bar, a first jaw fixedly coupled to the clamp bar, and a jaw assembly movably and securely coupled to the clamp bar, wherein the jaw assembly comprises a second jaw and a jaw support, wherein the second jaw and the jaw support is coupled with a slanting surface, wherein the slanting surface is configured so that when the second jaw moves down, the second jaw also moves toward an object supported between the first and second jaw for keeping the object in place. The slanting surface can also be configured so that when there is a force comprising a downward direction acting on the second jaw, there is a force comprising a sideward direction acting toward the object.

In some embodiments, the jaw support can include a metal core at least partially embedded in a jaw support body. The metal core can include a steel or stainless steel material. The metal core can be configured to provide a structural support for the clamping device. The metal core can include a panel for coupling to the clamp bar, e.g., a connection element such as one or more connection bars or rods. The metal core can include welded panels. The metal core can include a first panel for coupling to the clamp bar such as to a connection bar. The metal core can include a slanting panel for translating a force of object lifting to a force pushing on a jaw for clamping on the object. For example, the slanting panel can be configured to be in a direction to provide that the dimension between the second jaw and the jaw support that is larger at a location farther from the clamp bar than at a location nearer the clamp bar. The metal core can include a structural support for strengthening the slanting panel.

The jaw support body can include a material different from the material of the metal core. For example, the jaw support body can include a polymer-based material or aluminum. The jaw support body can form a protective cover for the jaw assembly. The jaw support body can include a cast body with the metal core disposed therein. The jaw support body can include a portion protruded from the metal core. The jaw support body can include exposed portion of the metal core, e.g., there can be a portion of the metal core not covered by the jaw support body. The jaw support body can include through holes corresponded to through holes of the metal core.

In FIG. 3C, operation 340 places an object between a first jaw and a second jaw of a clamping device, wherein the second jaw is coupled to a jaw support with a slanting surface, wherein the slanting interface is configured so that when the object moves down, the object makes the second jaw moving toward the object for keeping the object in place.

The first and second jaws can be directly or indirectly coupled to a clamp bar. For example, the first jaw can be directly coupled to the clamp bar. The second jaw can be indirectly coupled to the clamp bar, e.g., the second jaw is coupled to jaw support while the jaw support is directly coupled to the clamp bar.

If the opening between the first jaw and the second jaw is not enough to accommodate the object, the first jaw, the second jaw, or the jaw support can be move along the clamp bar to enlarge the opening distance.

After placing the object between the jaws, the opening can be narrowed so that the object is in contact with the jaws, or there is a minimum gap between the object and the jaws. The first jaw, the second jaw, or the jaw support then can be securely coupled to the clamp bar.

If there is a gap between the object and the jaws, one or two jaws can be adjusted, e.g., changing the positions of the jaws or moving the jaws, so that the jaws can contact the object. For example, the jaws can be pressed down along the slanting interfaces. During the downward movements of the jaws, the jaws also move sideward toward the object. The jaws can be pressed down until the jaws are in contact with the object.

Operation 350 lifts the clamping device to move the object.

In some embodiments, the clamping device can include a pulling element, which is disposed between a jaw and a jaw support of a jaw assembly. A slanting interface can be included between the pulling element and at least one of the jaw and the jaw support. For example, there can be a slanting interface between the pulling element and the jaw support. There can be a second slanting interface between the pulling element and the jaw. The pulling element can simplify the operation of the clamping device, for example, by eliminating the adjustment of the jaws, e.g., moving the jaws so that the jaws can be in contact with the object if there are gaps between the jaws and the object after the jaw assemblies are secured to the clamp bar.

By pulling on the pulling element, when there is a gap, the jaw will move toward the object to narrow the gap. After the jaws are in contact with the object, further pulling action will exert a force from the jaws to the object, clamping the object in place. The clamping force can be evenly distributed at the clamping jaws.

Further, the pulling element can improve the clamping force on the object, for example, due to the wedging configuration of the jaw and the jaw support. The high clamping force can improve the gripping action of the clamping device on the object, further preventing the object from slipping out of the jaws of the clamping device.

In some embodiments, the present invention discloses a clamping device for lifting and/or for transferring heavy objects, such as granite plates, cement blocks, metal plates, and objects of other shapes and materials. The clamping device can grip the objects by clamping on portions of the objects, such as at edges of the objects.

The present clamping device can lift an object, or multiple objects placing next to each other, such as lifting a plate or a stack of multiple plates. The clamping device can be used for lifting heavy plates with large thicknesses without damaging the lifted plates, such as without deforming or cracking the plates. The center of the clamping action can be evenly distributed to the clamping jaws, to provide an even clamping force on the objects.

Further, the clamping device can be compact and light weight, e.g., which can include two jaw assemblies coupled to a clamp bar. The small size of the clamping device can allow the clamping device to be placed in the gaps of multiple objects to clamp on the selected object. For example, multiple heavy plates can be stacked against each other in a facility with small gaps in between. The clamping device can be placed at the gaps, and enclosing the plate to be clamped.

The small size and light weight of the clamping device can allow the clamping device to easily move along the object, for example, so that the clamping device can clamp on a vertical line with the center of gravity of the object. The alignment of the clamping device with the center of gravity can prevent excessive tilting of the object when lifted.

Figure 4A:
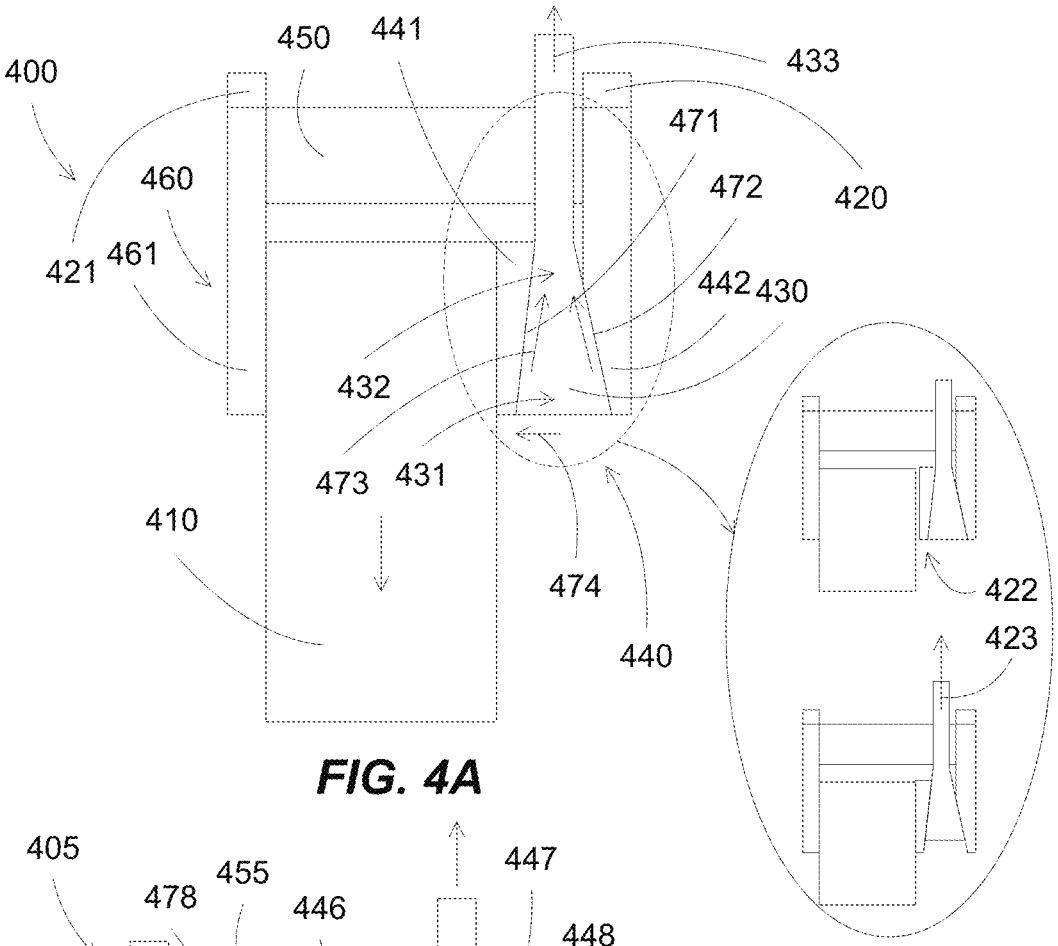
FIGS. 4A-4B illustrate clamping devices according to some embodiments.
Figure 4B:
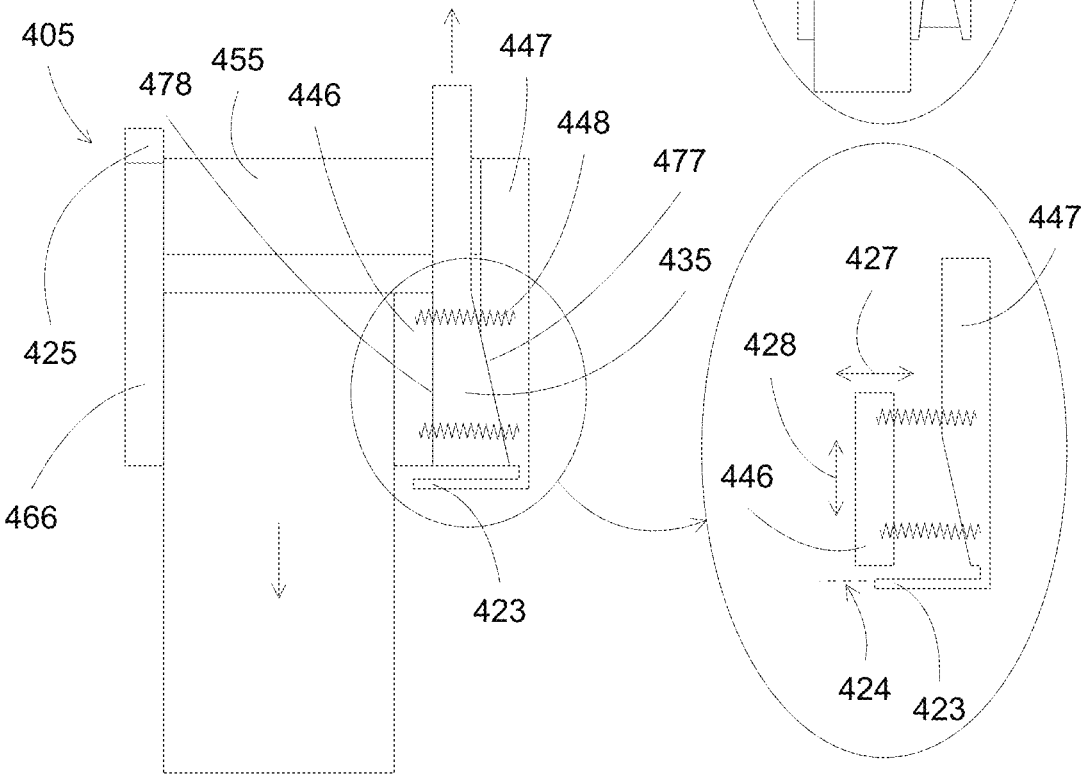

FIGS. 4A-4B illustrate clamping devices according to some embodiments. In FIG. 4A, a clamping device 400 can include two jaw assemblies 440 and 460 coupled to a clamp bar 450. The jaw assembly can include a jaw, or a jaw and a jaw support. As shown, the jaw assembly 460 includes a jaw 461. And the jaw assembly 440 includes a jaw 441 and a jaw support 442.

The jaw assembly can be fixedly coupled to the clamp bar, or can be movably and securably (or lockably) coupled to the clamp bar, using an optional locking mechanism. As shown, the jaw assembly 460 is movably coupled to the clamp bar 450, together with a locking mechanism 421 for securing the jaw assembly 460 to the clamp bar 450. And the jaw assembly 440 is movably coupled to the clamp bar 450, together with a locking mechanism 420 for securing the jaw assembly 440 to the clamp bar 450.

The jaw assemblies 440 and 460 each can include a jaw for clamping on an object 410. For example, the jaw assembly 460 can include a first jaw 461. The jaw assembly 440 can include a second jaw 441, which together with the first jaw 461, pressing on the object 410 for clamping the object. The jaw assemblies can be fixedly or movably coupled to the clamp bar. For example, the jaw assembly 460 can be movably coupled to the clamp bar 450 by the first jaw 461 movably along the clamp bar 450. The jaw 461 can be secured to the clamp bar by the locking mechanism 421, for example, through a latching mechanism that latches the jaw 461 to the clamp bar 450.

The jaw assemblies can be movable along to the clamp bar, e.g., to accommodate different sizes of the object. Once the jaw opening between the jaws 441 and 461 is large enough to clamp on the object 410, the jaw support 440 can then be fixed to the clamp bar 450. For example, the jaw assembly 440 can be movable along the clamp bar 450 by sliding the jaw support 442 along the clamp bar 450. A locking mechanism 420 can be included to lock, e.g., to secure, the jaw assembly 440 to the clamp bar 450, for example, by latching the jaw support 442 to the clamp bar 450.

A pulling element 430 can be disposed between the jaw 441 and the jaw support 442 of the jaw assembly 440. The pulling element can be loosely coupled to the clamp bar. For example, the pulling element can include a hollow space, such as a through hole, in which the clamp bar can pass through. The hollow space can be larger than the cross section of the clamp bar, so that the pulling element can move relative to the clamp bar.

Alternatively, the clamp bar between the two jaw assemblies, e.g., the connection element between the two jaw assemblies, can include one connection bar or multiple connection bars. The multiple connection bars can be secured to the jaw assemblies, and the pulling element can be disposed between the connection bars.

In some embodiments, the pulling element can be constrained to prevent sideward movements, e.g., the pulling element can move in the up and down directions, e.g., in the directions of gravity and in the directions along the clamp bar. Thus the hollow space of the pulling element can be larger above and below the clamping bar, to allow the pulling element to move up and down with respect to the clamp bar. The hollow space can be close to the clamp bar at sides, such as in contact or having a small gap. The closeness of the pulling element and the clamp bar in sideward directions, e.g., in directions perpendicular to the gravity directions, can constrain the pulling element from moving in the sideward directions. Similarly, the multiple clamp bar configuration with the pulling element disposed between the clamp bars can allow the pulling element to move freely in directions except the sideward directions.

There can be slanting interfaces between the pulling element and the jaw assembly in which the pulling element is disposed within. For example, slanting interface 471 can be between the pulling element 430 and the jaw 441. Slanting interface 472 can be between the pulling element 430 and the jaw support 442. There can be two slanting interfaces, or there can be one slanting interface, with the other interface being a non-slanting interface, e.g., a vertical surface or a tilted surface sloped in an opposite direction as the slanting interface. As shown, the pulling element can move up and down along the slanting interfaces 471 and 472.

The slanting interfaces can be configured so that when the pulling element moves up, e.g., in a direction 433 for lifting the object, the jaw can move in a direction that increases a separation between the jaw and the jaw support. For example, a bottom portion 431 of the pulling element, e.g., a dimension of the pulling element at the bottom portion 431 in a direction between the jaw and the jaw support, can be larger than a top portion 432 of the pulling element, e.g., a dimension of the pulling element at a top portion 432 in a direction between the jaw and the jaw support, or a dimension of the pulling element at a portion above the dimension of the pulling element at a top portion 431, in a direction between the jaw and the jaw support.

That way, when the pulling element moves up, the larger bottom portion also moves up, further separating the jaw and the jaw support. The slanting interface between the pulling element and the jaw support can provide that the corresponding bottom portion of the jaw support can be smaller than the corresponding top portion of the jaw support. The slanting interface between the pulling element and the jaw can provide that the corresponding bottom portion of the jaw can be smaller than the corresponding top portion of the jaw.

In some embodiments, the slanting interfaces can be provided at a portion of the surface that the pulling element is facing the jaw or the jaw support. Thus a bottom portion 431 or a top portion 432 of the pulling element can be only a portion of the interface between the pulling element and the jaw/jaw support.

The slanting interfaces 471 and 472 can be configured so that when the pulling element 430 starts to move up 433, the pulling element can move along the slanting interfaces. With the slanting interfaces, the jaw 441 can also start to move away 474 from the jaw support since the jaw support is secured to the clamp bar by the locking mechanism 420. The potential side movement of the second jaw can exert a force on the object, preventing the object from moving down, e.g., to clamp the object in place.

The slanting interface can be configured so that the second jaw 441 can be moving toward the object 410 when the pulling element 430 is moving up. Thus, if there is no obstacle blocking the movement of the second jaw, e.g., the object is not present or the object is not in contact with the second jaw, the second jaw is moving toward the object or away from the jaw support when the pulling element is moving upward.

The slanting interface can be configured so that when there is an upward force 433 acting on the pulling element 430, there is an upward force 473 (e.g., a force having a component in the upward direction) along the slanting interfaces. The upward force 473 can be converted to a sideward force 474 toward the object. The conversion of the upward force can be viewed as a decomposition or a splitting of the upward force into multiple force components, in which a force component has a sideward direction. Thus, if there is no obstacle blocking the movement of the jaw, e.g., the object is not present or the object is not in contact with the jaw, the jaw is moving toward the object (in addition to the jaw potentially moving down) when there is the upward force acting on the pulling element. If there is an obstacle blocking the movement of the jaw, e.g., the object is in contact with the jaw, there is a sideward force from the jaw pressing on the object.

The slanting interface can include a slanting surface 471 making an acute angle with a vertical plane with a top portion of the slanting surface away from the object more than a bottom portion of the slanting surface. The slanting surface can be tilted toward the object at a bottom portion, or tilted away from the object at a top portion.

The slanting interface can include a slanting surface 472 making an acute angle with a vertical plane with a top portion of the slanting surface nearer the object more than a bottom portion of the slanting surface. The slanting surface can be tilted away from the object at a bottom portion, or tilted toward the object at a top portion.

The slanting interface can have a low friction surface, e.g., lower than the friction between the object 410 and the jaws 461 and 441. For example, the jaws 461 and 441 can include a rubber layer facing the object, which can have high friction toward the object.

There can be one or two slanting interfaces. The combination of these slanting interfaces is configured so that the jaw moves toward the object when the pulling element moves up, and that the jaw moves away from the object when the pulling element moves down. For example, there can be two slanting interfaces 471 and 472, and both of them are configured to exert a force toward the object when the pulling element experiences an upward force.

There can be one slanting interface 477, for example, as shown in FIG. 4B, between a pulling element 435 and a jaw support 447. The interface 478 between the jaw 425 and the pulling element 435 can be a non-slanting surface, such as a vertical surface. Other configurations can be used, such as the surface 478 can be slanted either way (same as the slanting surface 471 or can be tilted the opposite way, as long as the combination of the two surfaces is configured to move the jaw toward the object when the pulling element moves up). Alternatively, the slanting surface 477 can be tilted oppositely or can be vertical.

In some embodiments, the components of the clamping devices 200 and 205, such as the jaw supports 242, 247 and/or 267, the jaws 241, 261, 246, and/or 267, the clamp bars 250 and/or 255, can include a metal core embedded in a different material. The construction of the components using metal cores can be simpler and more cost effective while meeting the requirements of strength, hardness, durability and reliability.

In operation, the object is first clamped between the jaws 461 and 441 of the clamping device. For example, the locking mechanism 421 can be engaged to secure the jaw 461 to the clamp bar 450. The locking mechanism 420 can be disengaged, so that the jaw support 442 is free to move along the clamp bar 450. The jaw assembly 440 can be moving away from the jaw assembly 460 to enlarge the opening between the jaw 461 and 441. Once the opening is large enough to accommodate the object, the object can be placed between the jaws. The jaw assembly 440 can then be moving toward the object so that the object is in contact with the jaws, or so that there is a minimum gap between the object and the jaws. The jaw assembly 440 then can be secured to the clamp bar, for example, by engaging the locking mechanism 420.

Alternatively, the jaw assembly 440 can be locked first, and the jaw assembly 460 can be adjusted to ensure a minimum gap between the object and the jaws.

There can be a gap 422 between the object and the jaws, if the locking mechanism 420 is a discrete locking mechanism, e.g., the locking mechanism can secure the jaw assembly 440 to the clamp bar 450 at discrete locations, and the engagable locations for the current object do not allow the object to be in contact. The location to engage the locking mechanism can be selected to ensure a minimum gap between the object and the jaws, meaning the total gap between the object and the first jaw and between the object and the second jaw is smaller than the distance between two successive locking locations of the locking mechanism.

After placing the object between the jaws and locking the jaw assemblies, the pulling element can be pulled up. For example, the pulling element can be coupled to a hoist, and the hoist can move upward. The upward movement 423 of the pulling element can push the jaw 441 toward the object, closing the gap 422 until the jaw 441 is in contact with the object. A slow upward pulling of the pulling element can be applied when the jaws are not yet in contact with the object, so that the object does not escape the clamping element.

After the jaws clamp on the object, the pulling element, e.g., the hoist, can be further pulled up to lift the object. The hoist then can move and transfer the object to a new location.

Additional advantages of the clamping device having a pulling element include that the jaw can be fixed in location with respect to the object, meaning the pulling element can move to press on the jaw without the need to move the jaw. A further advantage of the clamping device having a pulling element is a high transfer coefficient between the upward force of the pulling element and the sideward force of the jaw on the object.

In some embodiments, in a jaw assembly, the jaw and the jaw support can be flexibly coupled, e.g., there can be limited movements of the jaw relative to the jaw support. For example, the jaw can include hollow spaces, such as through holes. One or more rods or bars can pass through the hollow spaces, which constrain the movements of the jaw. The hollow spaces can be larger than the rods or bars, e.g., larger than a cross section of the rods or bars, thus the jaw can move within the constraints of the rods and bars. For example, the jaw can slide in a direction along the rods or bars. With the hollow spaces larger than the rods or bars, the jaw can also move in a direction perpendicular to the direction along the rods or bars. The rods or bars can be a part of the clamp bar, e.g., the connection element, meaning the rods and bars can be secured at both ends to the jaw support if the jaw assembly includes a jaw and a jaw support. The clamp bar can include additional rods or bars.

In addition, by shaping the hollow spaces with respect to the rods or bars, the jaw can be further constrained to move in linear directions instead of moving in a plane perpendicular to the rods or bars. For example, the hollow spaces can include elongated holes along up and down directions. The elongated hollow spaces thus can allow the rods or bars to move within the hollow spaces in the up and down directions. The elongated holes can form minimum gaps with the rods or bars in horizontal directions perpendicular to the up/down directions and to the directions along the rods or bars. Thus the rods or bars is constrained, e.g., not able to move in the horizontal directions perpendicular to the up/down directions and to the directions along the rods or bars. With the elongated hollow spaces in the jaw, the jaw can move in upward direction, downward directions, direction toward the jaw support, and direction away from the jaw support.

FIG. 4B shows a clamping device 405, including a clamp bar 455, a jaw assembly including a first jaw 466, and a jaw assembly including a second jaw 446 and a jaw support 447. The first jaw 466 can be secured to the clamp bar 455 by a locking mechanism 425. A pulling element 435 can be disposed between the second jaw 446 and the jaw support 447. The pulling element can be movably coupled to the clamp bar, e.g., coupled to the clamp bar but can move in up and down directions.

The pulling element can form a slanting interface 477 with the jaw support 447, and a vertical plane interface 478 with the second jaw 446.

The jaw 446 can be flexibly coupled to the jaw support 447, e.g., the second jaw can be coupled to the jaw support with limited movements and/or with constrained movements. For example, the second jaw 446 can be coupled to the jaw support 447 through one or more springs 448. The spring coupling can allow the jaw to move in all directions with respect to the jaw support, such as moving in up or down directions 428, or moving in toward or away directions 427 relative to the jaw support. However, the spring coupling can constrain the second jaw to have limited movements. For example, the springs can extend when the second jaw moves away from the jaw support, but the second jaw cannot move too far away from the jaw support, or the springs 448 would break. Similarly, the springs can contract when the second jaw moves toward the jaw support. The springs can bend when the second jaw moves up or down relative to the jaw support. An advantage of the spring coupling is that when the clamping device is at rest, e.g., when the pulling element is at a lowest position, the springs can pull the second jaw back toward the jaw support. This can allow the clamping device to freely approach object for clamping, since the jaws are at positions that maximize the opening distance between the two jaws.

In some embodiments, a pulling element lock can be included to secure the pulling element to a rest position, e.g., a lowest position or a position that allows the second jaw to be closest to the jaw support. Together with the spring coupling, locking the pulling element can pull the jaws back to positions with largest jaw opening.

In some embodiments, there can be a limiter to restrict the movements of the jaw with respect to the jaw support. The limiter can be coupled to the jaw support, and include a stopper to prevent the jaw from moving pass a certain position. The limiter can be coupled to other components, such as coupled to the clamp bar, or to any component that is fixed coupled to the jaw support. For example, the jaw support 447 can include a limiter 423, which can constrain the second jaw 446 from moving down too far, e.g., stopping at the limiter limit 424. Alternatively, the rods or bars passing through the hollow spaces in the second jaw can also act as limiters for the second jaw, limiting the movements of the second jaw in directions perpendicular to the directions along the rods or bars.

In some embodiments, the slanting interfaces can have low friction, e.g., lower than the friction at the interfaces between the jaws and the object. For example, the friction at the interfaces between the jaws and the object can be increased by adding a high friction layer, such as a rubber pad, to the jaw external surfaces. Alternatively, the friction at the slanting interface can be reduced by using rolling friction, e.g., the pulling element can include rollers, which roll on a surface of the jaw, providing a rolling friction at the slanting interface between the pulling element and the jaw; or the rollers can roll on a surface of the jaw support, providing a rolling friction at the slanting interface between the pulling element and the jaw support. Inversely, the jaw or the jaw support can include rollers for rolling on surfaces of the pulling element.

FIGS. 5A-5B illustrate flow charts for forming and operating a three-part clamping device according to some embodiments. In FIG. 5A, operation 500 forms a clamping device, wherein the clamping device comprises a first jaw fixedly coupled to a clamp bar, and a second jaw assembly movably and fixedly coupled to the clamp bar, wherein the second jaw assembly comprises a second jaw and a jaw support, together with a pulling element disposed between the second jaw and the jaw support, wherein there is at least a slanting interface coupling between the pulling element and the second jaw or between the pulling element and the jaw support, wherein the slanting interface is configured so that when the pulling element moves up, the second jaw moves toward an object for keeping the object in place.

In some embodiments, the components of the clamping device, such as the jaw supports, the jaws, and the clamp bars, can include a metal core embedded in a different material. The construction of the components using metal cores can be simpler and more cost effective while meeting the requirements of strength, hardness, durability and reliability.

In FIG. 5B, operation 520 places an object between a first jaw and a second jaw of a clamping device, wherein the second jaw is part of a jaw assembly, wherein the jaw assembly further comprises a jaw support and a pulling element disposed between the second jaw and the jaw support, wherein there is at least a slanting interface coupling between the pulling element and the second jaw or between the pulling element and the jaw support.

In some embodiments, a distance between the first jaw and the second jaw can be enlarged, for example, by disengaging a locking mechanism that is used to secure the jaw assembly to a clamp bar. If there are two locking mechanisms, either one can be disengaged. After the locking mechanism is disengaged, the jaw assembly can be freely moved along the clamp bar, and the jaw assembly can be moved away from the other jaw or the other jaw assembly.

After placing the object in between the jaws, the distance between the first jaw and the second jaw can be narrowed, for example, by moving one jaw assembly toward the other jaw assembly. For example, if the first jaw assembly is fixedly coupled to the clamp bar, then the second jaw assembly can be pushed toward the first jaw assembly to narrow the distance between the two jaws. The second jaw assembly can be stopped, e.g., after being pushed toward the first jaw assembly, when the total gap between the object and the jaws is at a minimum.

Operation 530 optionally locks the jaw assembly so that the object is disposed between the first jaw and the second jaw. The locking mechanism can be a discrete locking mechanism, meaning the jaw assembly can be secured to the clamp bar at discrete locations. The jaw assembly is then locked, e.g., the locking mechanism is engaged, at a location that the total gap between the object and the jaws is minimum, e.g., the total gap is smaller than a distance between two discrete locations that the locking mechanism can be engaged.

Operation 540 lifts the pulling element which moves the second jaw toward the object, since the slanting interface is configured so that when the pulling element moves up, the second jaw moves toward the object. The pulling element can be lifted slowly, to ensure that the object is still placed on the ground when there is a gap between the object and the jaws. After the jaws contact the object, the pulling element can be further lifted to lift the object from the ground. The pulling force, and/or the weight of the object, can be converted to a clamping force of the jaws against the object, keeping the object within the grip of the clamping device.

In some embodiments, a clamping device can be formed by forming a clamp bar, e.g., a connection element for the two jaw assemblies, forming a first jaw, and then coupling the first jaw with the clamp bar. A second jaw can be formed, which includes a jaw support and a second jaw. The jaw support can include a metal core, which can be configured to provide a structural support for the clamping device. The jaw support can include a jaw support body surrounding the metal core and protruding from the metal core. The jaw support body can include a material different from the material of the metal core. The jaw support body can include a hollow portion mating with the second jaw as a lid. The hollow portion can include a dimension between the second jaw and the jaw support that is larger at a location farther from the clamp bar than at a location nearer the clamp bar. The hollow portion can include a slanting surface. The jaw support can be coupled with the clamp bar. The second jaw can be coupled with the jaw support by a set of springs.

In some embodiments, a pulling element can be formed, which can include rollers. The rollers can be placed in a hollow portion between the jaw support and the second jaw. Some rollers can be configured to roll on a surface of the jaw support. Some rollers can be configured to roll on a surface of the second jaw.

In some embodiments, one or more slanting interfaces of the clamping device can have a low friction, such as a low coefficient of friction. The friction of the slanting interfaces can be lower than that of the gripping interfaces, e.g., the interfaces between the object and the jaws gripping the object.

The lower friction can be achieved by increasing the friction of the gripping interfaces or gripping surfaces. For example, the jaw outer surfaces, e.g., the surfaces of the jaws to be in contact with the object, can have a high friction layer disposed thereon. For example, a rubber layer can be coupled to the jaw, to increase the friction of the jaw with the object, which can prevent the object from slipping from the jaw during the handling of the object.

The lower friction can be achieved by decreasing the friction of the slanting interfaces. For example, the slanting interfaces, e.g., the mating surfaces between two parts in the jaw assembly, such as the interface between the jaw and the pulling element, or the interface between the pulling element and the jaw support, can have smoother surfaces, such as having a grease coating, or low contact area surfaces, such as rolling frictions from balls or rollers. The low friction interfaces can make it easier for the pulling element to move with respect to the jaw while the jaws grip the object.

For example, the pulling element can have rolling balls on one or two surfaces, e.g., on one surface facing the second jaw, or on one surface facing the jaw support, or on both surfaces. Alternatively, the second jaw can have rolling balls on the surface facing the pulling element, or the jaw support can have rolling balls on the surface facing the pulling element.

Figure 6A:
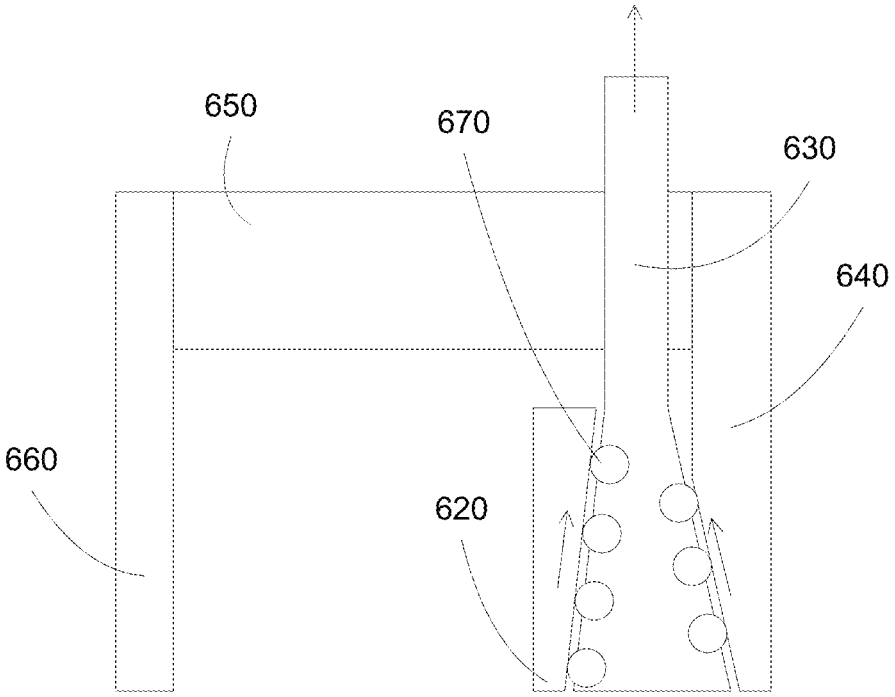
FIGS. 6A-6B illustrate configurations for clamping devices with rolling frictions according to some embodiments.
Figure 6B:
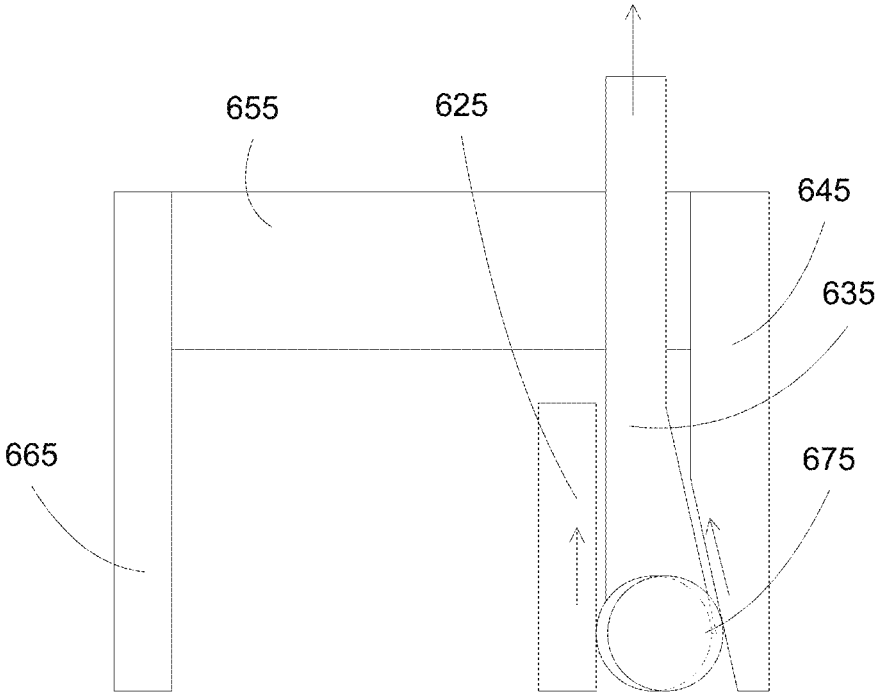

FIGS. 6A-6B illustrate configurations for clamping devices with rolling frictions according to some embodiments. In FIG. 6A, a clamping device can include a first jaw 660 fixedly coupled to a clamp bar 650; a movable and fixable (e.g., lockable) jaw support assembly that includes a second jaw 620, a jaw support 640; and a pulling element 630 disposed between the second jaw and the jaw support. The interfaces between the pulling element and the second jaw and between the pulling element and the jaw support can include slanting surfaces, for translating a vertical movement of the pulling element to a horizontal movement of the second jaw.

The pulling element can have one or more rolling balls or rollers 670 on one or both interfaces, meaning on a surface facing the second jaw and/or on a surface facing the jaw support. The rolling balls or rollers can provide a low friction interface between the pulling element and the second jaw and/or the jaw support.

In FIG. 6B, a clamping device can include a first jaw 665 fixedly coupled to a clamp bar 655, and a movable and fixable (e.g., lockable) jaw support assembly that includes a second jaw 625, a jaw support 645, and a pulling element 635 disposed between the second jaw and the jaw support. The interface between the pulling element and the second jaw can be a substantially vertical surface. The interface between the pulling element and the jaw support can include a slanting surface, for translating a vertical movement of the pulling element to a horizontal movement of the second jaw. Other interface configurations can be included for different surface configurations.

The pulling element can have rolling balls or rollers 675 on one or both interfaces, meaning on a surface facing the second jaw and/or on a surface facing the jaw support. One set of rolling balls or rollers can be used. As shown, the rolling balls or rollers have offset centers, so that the left rolling balls or rollers can roll on the surface of the jaw 625 and the right rolling balls or rollers can roll on the surface of the jaw support 645.

In some embodiments, the rolling balls or roller can have centers of rotation aligned in a horizontal line. Recesses in the jaw and/or in the jaw support can be included, so that the rolling balls or roller only contact the jaw or the jaw support. For example, a roller can contact the jaw and the surface of the jaw support facing the roller can be recessed, so that the roller does not contact the jaw support.

FIGS. 7A-7B illustrate flow charts for forming and operating clamping devices with rolling frictions according to some embodiments. In FIG. 7A, operation 700 forms a clamping device, wherein the clamping device comprises a first jaw fixedly coupled to a clamp bar, and a second jaw assembly movably and fixedly coupled to the clamp bar, wherein the second jaw assembly comprises at least two components coupled through a slanting surface interface, wherein the slanting surface is configured so that when one component moves down, it also moves toward an object disposed between the first jaw and the second jaw assembly, wherein the slanting surface comprises a rolling friction.

In some embodiments, the second jaw assembly comprises a second jaw and a jaw support, together with a pulling element disposed between the second jaw and the jaw support, wherein there is at least a slanting surface interface between the pulling element and the second jaw or between the pulling element and the jaw support, wherein the slanting interface is configured so that when the pulling element moves up, the second jaw moves toward an object for keeping the object in place, wherein the slanting surface comprises a rolling friction.

In FIG. 7B, operation 720 places an object between a first jaw and a second jaw of a clamping device, wherein the second jaw is part of a jaw assembly, wherein the jaw assembly further comprises a jaw support and a pulling element disposed between the second jaw and the jaw support, wherein there is at least a slanting surface interface coupling the pulling element and the second jaw or coupling the pulling element and the jaw support, wherein the slanting surface comprises a rolling friction.

Operation 730 optionally locks the jaw assembly so that the object is disposed between a fixed first jaw and a fixed jaw support. Operation 740 lifts the pulling element which moves the second jaw toward the object, since the slanting surface interface comprises a rolling friction, the second jaw moves toward the object when the pulling element moves up.

In some embodiments, the components of the clamping device, such as the jaw support, can include a metal core, which can be configured to provide a structural support for the clamping device. The jaw support can include a jaw support body surrounding the metal core and protruding from the metal core. The jaw support body can include a material different from the material of the metal core.

In some embodiments, a locking mechanism can be formed to secure a movable jaw assembly to the clamp bar. The locking mechanism can be used to secure the jaw or the jaw support of a movable jaw assembly to the clamp bar.

The jaw assembly can be fixedly coupled to the clamp bar, e.g., the jaw assembly cannot be moved. For example, a jaw or a jaw support of the fixed jaw assembly can be secured to the clamp bar, for example, with bolts.

The jaw assembly can be movable along the clamp bar to accommodate different sizes of the objects. For example, the jaw or the jaw support of the jaw assembly can have a hollow portion for the clamp bar to pass through.

The locking mechanism can secure the movable jaw assembly to the clamp bar. The locking mechanism can be continuous, meaning the jaw assembly can be moved and secured, e.g. locked, along the clamp bar until the object is placed between the two jaws, meaning there is zero or a very little gap between the object and the jaws.

The continuous locking mechanism can include a screw type, meaning a lead screw can be used to move the jaw support assembly along the clamp bar. A lock can be included, such as a screw or a clamp to lock the lead screw or to lock the handle that turns the lead screw.

The locking mechanism can be discrete, meaning the jaw assembly can be moved continuously along the clamp bar, but can only be secured, e.g. locked, at predetermined locations along the clamp bar. Thus the jaw assembly can move from a lockable location to another lockable location, until there is a minimum gap between the object and the jaws, meaning the next lockable location would not be large enough to accommodate the object.

The discrete locking mechanism can include a peg fitting into one of multiple holes, or a cyclic pattern bar (such as a rack bar, or a bar having repeat triangle shapes)

A cyclic pattern bar and a mating pattern component can be used for securing the jaw support assembly to the clamp bar at discrete locations, meaning at locations that the pattern of the patent component fitted to one of the multiple patterns of the cyclic pattern bar. The cyclic pattern bar can include a rack bar, a tooth bar, a cog bar, or a linear gear bar, which can be fixedly coupled to the clamp bar. For example, the pattern can be a triangle. The pattern component can have a recess with the shape of the triangle. The cyclic pattern bar can have multiple mating triangles, e.g., triangles that match with the triangle of the pattern component, such as with the base of the triangles at the base of the cyclic pattern bar, and the tip of the triangle protruded from the base. Alternatively, the pattern component can have one or more triangles protruded from the pattern component. The cyclic pattern bar can have multiple recesses of triangle shapes. Thus the jaw support can be locked onto various locations of the cyclic pattern bar. For example, the jaw support can be released from the cyclic pattern bar, such as by pulling the jaw support assembly in a downward direction for disengaging with the cyclic pattern bar. In this disengaged position, the released jaw support assembly can be moved along the clamp bar (and the cyclic pattern bar), to adjust the size of the opening between the first jaw and the second jaw, to accommodate different object sizes.

At the appropriate opening size, the jaw support assembly can be engaged, such as by pushing up the mating pattern component, thus the pattern component is engaged with the cyclic pattern bar. In this engaged position, the jaw assembly can be locked to the clamp bar.

In some embodiments, one way pattern locking can be used, meaning the jaw support assembly can be moved along the clamp bar to narrow the opening between the two jaws, but cannot be moved in the opposite direction to enlarge the opening. For example, the triangle pattern can have an acute angle in one side and an obtuse angle in another side. The asymmetric triangle can prevent movement against the acute side while allowing movement against the obtuse side.

In some embodiments, the pattern can be asymmetric, for example, so that the jaw assembly can be easier to move toward the object, while it is much more difficult to move back away from the object. This will provide a further security against the losing the clamping action of the clamping device.

In some embodiments, the locking mechanism can include a cyclic pattern configuration, such as a series of holes on the clamp bar. The locking mechanism can include a mating pattern component, such as a pin, a rod or a bar which can fit into the holes. The mating pattern component can be movably coupled to the jaw assembly, such as to the jaw support. For example, the mating pattern component, e.g., the pin, can be movable, such as pulling back for disengaging with the clamp bar, e.g., out of the hole. In this disengaged position, the jaw assembly can be free to move along the clamp bar. The mating pattern component, e.g., the pin, can be pushed up, entering one hole in the holes in the clamp bar. In this engaged position, the jaw assembly can be locked to the clamp bar.

The jaw support can include a pattern component, which is a peg, which can be mated to various positions of a cyclic pattern bar, which includes multiple holes. As shown, the mating is in the shape of pegs and holes, e.g., the cyclic pattern bar can have multiple holes, and the pattern component can have a peg, such as a round peg. Thus the jaw support can be locked onto various locations of the cyclic pattern bar. For example, the jaw component can be released from the cyclic pattern bar, such as by pulling the peg in a generally downward (or sideway) direction. The released jaw support assembly can be moved along the clamp bar (and the cyclic pattern bar), to adjust the size of the opening between the first jaw and the second jaw, to accommodate different object sizes. At the appropriate opening size, the jaw support assembly can be engaged, meaning the pattern component is engaged with the cyclic pattern bar, to lock the jaw support assembly in place.

FIGS. 8A-8D illustrate configurations for clamping devices with locking mechanisms according to some embodiments. In FIG. 8A, a clamping device 800 can have a locking mechanism 870 for securing a movable jaw assembly, such as securing a jaw support 840, to a clamp bar 850. The locking mechanism 870 can include a cyclic pattern bar 871, such as a rack bar, a tooth bar, a cog bar, or a linear gear bar. The cyclic pattern bar 871 can be fixedly coupled to the clamp bar. The locking mechanism 870 can include a mating pattern component 872, such as a rod or a bar having a mated pattern at one end, such as a tooth pattern, a gear pattern, or a cog pattern. The mating pattern component 872 can be movably coupled to the jaw assembly, such as to the jaw support 840. For example, the mating pattern component 872 can be movable 873, such as pulling back for disengaging with the cyclic pattern bar 871. In this disengaged position, the jaw assembly can be free to move along the clamp bar. The mating pattern component 872 can be pushed up, contacting the cyclic pattern bar 871 to engage with the cyclic pattern bar 871. In this engaged position 841, the jaw assembly can be locked to the clamp bar.

As shown, the mating is in the shape of triangles, e.g., the cyclic pattern bar can have multiple triangles protruded from a base, and the pattern component can have multiple triangular recesses. Thus the jaw support can be locked onto various locations of the cyclic pattern bar. For example, the jaw component can be released from the cyclic pattern bar, such as by pulling the jaw support assembly in a downward direction. The released jaw support assembly can be moved along the clamp bar (and the cyclic pattern bar), to adjust the size of the opening between the first jaw and the second jaw, to accommodate different object sizes. At the appropriate opening size, the jaw support assembly can be engaged, meaning the pattern component is engaged with the cyclic pattern bar, to lock the jaw support assembly in place.

In some embodiments, one way pattern locking can be used, meaning the jaw support assembly can be moved along the clamp bar to narrow the opening between the two jaws, but cannot be moved in the opposite direction to enlarge the opening. For example, the triangle pattern can have an acute angle in one side and an obtuse angle in another side. The asymmetric triangle can prevent movement against the acute side while allowing movement against the obtuse side.

In some embodiments, the pattern can be asymmetric, for example, so that the jaw assembly can be easier to move toward the object, while it is much more difficult to move back away from the object. This will provide a further security against the losing the clamping action of the clamping device.

In FIG. 8B, a clamping device 805 can have a locking mechanism 875 for securing a movable jaw assembly, such as securing a jaw support 845, to a clamp bar 855. The locking mechanism 875 can include a cyclic pattern configuration 876, such as a series of holes on the clamp bar. The locking mechanism 870 can include a mating pattern component 877, such as a pin, a rod or a bar which can fit into the holes. The mating pattern component 877 can be movably coupled to the jaw assembly, such as to the jaw support. For example, the mating pattern component 877, e.g., the pin 877, can be movable 878, such as pulling back for disengaging with the clamp bar, e.g., out of the hole 876. In this disengaged position, the jaw assembly can be free to move along the clamp bar. The mating pattern component 877, e.g., the pin 877, can be pushed up, entering one hole in the holes 876 in the clamp bar. In this engaged position 842, the jaw assembly can be locked to the clamp bar.

The jaw support can include a pattern component 877, which is a peg, which can be mated to various positions of a cyclic pattern bar 876, which includes multiple holes. As shown, the mating is in the shape of pegs and holes, e.g., the cyclic pattern bar can have multiple holes, and the pattern component can have a peg, such as a round peg. Thus the jaw support can be locked onto various locations of the cyclic pattern bar. For example, the jaw component can be released from the cyclic pattern bar, such as by pulling the peg in a generally downward (or sideway) direction. The released jaw support assembly can be moved along the clamp bar (and the cyclic pattern bar), to adjust the size of the opening between the first jaw and the second jaw, to accommodate different object sizes. At the appropriate opening size, the jaw support assembly can be engaged, meaning the pattern component is engaged with the cyclic pattern bar, to lock the jaw support assembly in place.

FIG. 8C shows an operation to clamp the object with the clamping device with a discrete locking mechanism. The lock mechanism can be disengaged, e.g., the pattern component can be pulled back 836, so that the pattern component is disengaged 882 from the cyclic pattern bar. The jaw support assembly can slide back to enlarge the opening between the two jaws. An object 810, such as a slap, can be placed between the two jaws. The jaw support assembly can be slide forward to make sure that the total gaps 812+814 between the jaws and the object is minimal, meaning that that total gaps are the smallest when the lock mechanism is engaged.

The lock mechanism is then engaged, e.g., the pattern component can be pushed up 838 toward the cyclic pattern bar, so that the pattern component is engaged 883 with the cyclic pattern bar. The jaw assembly is now fixedly coupled to the clamp bar.

The pulling element 837 can be pulled up, e.g., in a substantially vertical direction 885. Due to the slanting surface between the jaw support and the pulling element 837, and since the jaw support is locked, the upward movement 885 of the pulling element can have a component moving toward the object, e.g., the pulling element moves in a direction 886 upward and toward the object.

The side movement of the pulling element can move the second jaw 827 toward the object, until the second jaw is in contact with the object.

When the second jaw is not yet in contact with the object, the second jaw can be freely moved, and therefore the second jaw can move in a downward direction 884 (due to gravity) toward the object, meaning sliding vertically down and horizontally sideway.

When the second jaw contacts the object, the upward movement 885 of the pulling element can push on the second jaw. With a good friction between the second jaw and the object, the second jaw can only be pushed toward the object without actually moving, thus clamping on the object.

In FIG. 8D, a clamping device 807 can have a screw type mechanism, such as lead screw, ball screw, or other screw type mechanism 860, for securing a movable jaw assembly, such as securing a jaw support 847, to a clamp bar 857. When the lead screw 860 is turned, the jaw support 847 can move linearly. For example, the lead screw 860 can turn in one direction (depending on the direction of the teeth of the lead screw), and the jaw support can move toward the fixed jaw. When the lead screw 860 turns in an opposite direction, the jaw support can move away from the fixed jaw. The lead screw can allow a continuous movement of the jaw support. For example, the jaw support can move backward, e.g., away from the jaw, to widen the gap between the jaw and the jaw support. After an object, such as a slap, is positioned between the jaw and the jaw support, the lead screw can be turned to secure the object between the jaw and the jaw support. The lead screw can have a large enough dimension to prevent bending, due to the pulling action of the weight of the object.

In some embodiments, a secure mechanism can be used to lock the lead screw, for example, to prevent the lead screw from moving. In general, the jaw support can only move linearly, and thus it is not easy for the lead screw to turn due to the force acting on the jaw support. However, vibration can loosen the lead screw. Thus, a secure mechanism can be used to lock the lead screw, after setting the lead screw to an appropriate location for securing the object. The secure mechanism can include a lock washer and a nut 861, which can be tightened against the clamp bar, to prevent any movement of the lead screw.

FIGS. 9A-9B illustrate flow charts for forming and operating clamping devices with rolling frictions according to some embodiments. In FIG. 9A, operation 900 forms a clamping device, wherein the clamping device comprises a first jaw fixedly coupled to a clamp bar, and a second jaw assembly movably and fixedly coupled to the clamp bar, wherein the second jaw assembly comprises a locking mechanism for fixedly coupling the second jaw assembly to the clamp bar, wherein the locking mechanism is configured to secure the second jaw assembly to the clamp bar continuously or at discrete locations.

In FIG. 9B, operation 920 an object between a first jaw and a second jaw of a clamping device, wherein the second jaw is part of a jaw assembly, wherein the jaw assembly further comprises a locking mechanism for securing the jaw assembly with respect to the first jaw, wherein the locking mechanism is configured to secure the jaw assembly at discrete locations.

Operation 930 unlocks the locking mechanism to place an object between the first jaw and the second jaw. Operation 940 locks the locking mechanism at a location to achieve a minimum gap between the first and second jaws with the object. Operation 950 lifts the clamping device to secure the object between the first and second jaws. Operation 960 lifts the clamping device to move the object.

Figures 10A, 10B, 10C, 10D:
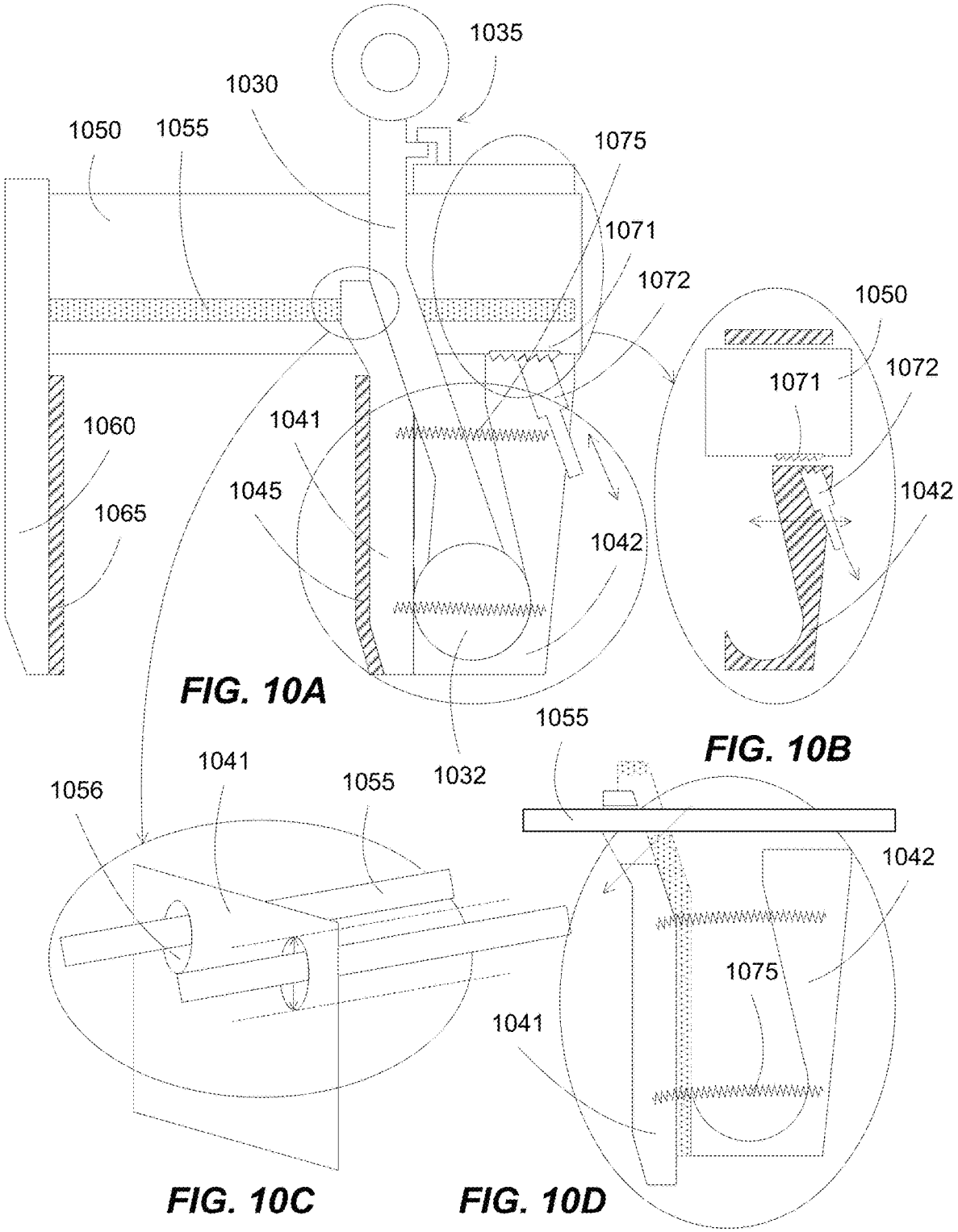
FIGS. 10A-10D illustrate a clamping device according to some embodiments.

FIGS. 10A-10D illustrate a clamping device according to some embodiments. FIG. 10A shows a cross section of a clamping device, which can include a first jaw 1060 fixedly coupled to a clamp bar 1050, such as a single bar or multiple connection bars. The first jaw can include a rubber pad 1065 to increase a friction with objects to be clamped. In some embodiments, the first jaw can be removably coupled to the clamp bar, together with a locking mechanism for securing the first jaw to the clamp bar. Alternatively, the first jaw can be a part of a first jaw assembly, which can also include a first jaw support. The first jaw of the first jaw support can be coupled to the clamp bar, such as fixedly coupled or removably coupled with a locking mechanism.

The clamping device can include a second jaw assembly, which can be movably and lockably coupled to the clamp bar. The second jaw assembly can include a second jaw 1041 disposed opposite the first jaw. The second jaw can include a rubber pad 1045 to increase a friction with objects to be clamped. The second jaw assembly can include a jaw support 1042, which can slide along the clamp bar for movably coupled to the clamp bar. As shown, the first jaw is fixedly coupled to the clamp bar, and the second jaw assembly is movably coupled to the clamp bar. Other configurations can be used, such as the first jaw is movably coupled to the clamp bar, and the second jaw assembly is fixedly coupled to the clamp bar. Alternatively, the first jaw and the second jaw assembly can both be movably coupled to the clamp bar. A jaw or a jaw assembly, if movably coupled to the clamp bar, can include a locking mechanism for securing the jaw or the jaw assembly to the clamp bar.

There can be flexible couplings between the second jaw and the jaw support. The flexible couplings can allow the second jaw to move in multiple directions with respect to the jaw support, such as down and away from the jaw support. The flexible couplings can include springs 1075 (FIG. 10D) having two ends fixedly coupled to the second jaw 1041 and the jaw support 1042. The springs can bend and flex, allowing the second jaw to move relative to the jaw support.

In addition, end point limits can be included to prevent the second jaw from moving too far from the jaw support. The second jaw can be blocked in the horizontal directions by the jaw support and the object, so there can be no need for end point limits in the horizontal directions. Support bars 1055 (FIG. 10C) can be coupled to the clamp bar and passing through the second jaw with large openings 1056. Thus the second jaw can be freely moved within the confinement of the openings. For example, the second jaw cannot move too far down, since the support bar can prevent such as movement. The openings 1056 can be configured to limit the movements of the second jaw. For example, the openings can be close or touching the support bars in horizontal directions, e.g., the openings can have an elongated shape in the up and down directions. The elongated openings can prevent the second jaw from moving in directions parallel to the jaw support, e.g., perpendicular to the up/down directions and perpendicular to the directions of toward to/away from the jaw support.

The second jaw assembly can be movably coupled to the clamp bar by having the jaw support movably coupled to the clamp bar, and the second jaw flexibly coupled to the jaw support. For example, the jaw support can have a hollow space in which the clamp bar can pass through (FIG. 10B). The dimension of the hollow space can be just about the size of the cross section of the clamp bar, which can allow the jaw support to move along the clamp bar, with zero or minimum movements in other directions, such as in directions perpendicular to the direction along the clamp bar.

The second jaw assembly can include a locking mechanism having first mated component 1071, e.g., the cyclic pattern bar, and second mated component 1072, e.g., the mating pattern component, for locking the jaw assembly, such as locking the jaw support, to the clamp bar. When the locking mechanism is disengaged (FIG. 10B), e.g., when the second mated component 1072 is pulled back to not contacting or not mating with the first mated component 1071, the jaw support 1042 can be freely moved along the clamp bar. When the locking mechanism is engaged (FIG. 10A), e.g., when the second mated component 1072 is pushed up to contact or mate with the first mated component 1071, the jaw support 1042 can be securely and fixedly coupled to the clamp bar.

The clamping device can include a pulling element 1030, which can be configured to be pulled on for lifting the clamped object. The pulling element can be disposed between the second jaw and the jaw support. The pulling element can also be disposed between the clamp bar, e.g., between the multiple connection bars. The pulling element can freely move in an up direction. In the down direction, the jaw support can block the pulling element. In the horizontal directions toward to/away from the jaw support, the pulling element can be constraint by the second jaw and the jaw support. The pulling element can be constrained in directions parallel to the jaw support, e.g., in directions perpendicular to the up/down directions and also perpendicular to directions toward to/away from the jaw support, for example, by having a hollow space that the clamp bar can pass through. The hollow space can have an elongated shape along the up/down directions, and a tight fit with the clamp bar in directions parallel to the jaw support. Similar to the support bar that limits the movements of the second jaw, the elongated shape of the hollow space in the pulling element can limit the movements of the pulling element in directions parallel to the jaw support.

The pulling element can be configured to exert a clamping force on the object when being pulled, for example, through a slanting surface of the jaw support. For example, the pulling element can include a set of rollers 1032, which can provide rolling friction with the second jaw and the jaw support. Thus there can be minimum friction when the pulling element is pulled up, pushing the second jaw away from the jaw support due to the slanting surface of the jaw support. The set of rollers can include first rollers contacting the second jaw surface, and second rollers contacting the jaw support surface. There can be recesses at the jaw support at location where the first rollers face the jaw support, so that the first rollers only contact the second jaw and not the jaw support. There can be recesses at the second jaw at location where the second rollers face the second jaw, so that the second rollers only contact the jaw support and not the second jaw.

The clamping device can include a second locking mechanism 1035, which can be coupled to either the clamp bar or to the second jaw assembly to prevent the pulling element from being pulled up. The pulling element can be constrained from going down by the jaw support, thus the second locking mechanism, when engaged, when secure the pulling element to the clamp bar. The pulling element can be locked to a bottommost location, which can provide that the second jaw is closest to the jaw support. The springs can assist in pulling the second jaw toward the jaw support, which can form a largest opening between the two jaws of the clamping device.

In operation, the locking mechanism, e.g., the locking mechanism that locks the second jaw assembly to the clamp bar, can be unlocked, for example, by pulling back the second mated component 1072 to disengage the second mated component 1072 from the first mated component 1071. This will release the second jaw assembly from the clamp bar, and thus the second jaw assembly can slide along the clamp bar so that the distance between the two jaws can be large enough to accommodate the object.

After putting the object within the first and second jaw, the locking mechanism can be engaged, e.g., the second mated component can be pushed up to engage with the first mated component, locking the second jaw assembly to the clamp bar. If the locking mechanism is a discrete locking mechanism, there can be gaps between the object and the jaws.

Next, the second locking mechanism 1035, e.g., the locking mechanism that locks the pulling element to the clamp bar, can be unlocked, so the pulling element can be pulled up. Due to the rollers, the pulling element can easily move against the second jaw and the jaw support. Since a dimension of the rollers is larger than the distances between the second jaw and the jaw support at upper locations (e.g., at locations above the resting location or the locked location of the pulling element), the moving up action of the pulling bar (and the rollers) can force the second jaw to move away from the jaw support. The springs can flex, to accommodate the movement of the second jaw away from the jaw support. The second jaw can move away from the jaw support, until the second jaw is in contact with the object. If there is a gap between the object and the first jaw, the second jaw can keep moving to narrow that gap. The second jaw then continue to move until the first and second jaws all contact the object.

In some embodiments, the second jaw can move down, in addition to moving away from the jaw support, due to gravity (FIG. 10D). The springs can bend to accommodate the downward movement of the second jaw. The support bars 1055 can prevent the second jaw from going down too far, e.g., the support bars can stop the second jaw movement when the support bars contact the upper portions of the hollow spaces 1056 of the second jaw.

FIGS. 11-21 illustrate additional views of the clamping device according to some embodiments. A clamping device can include a first jaw assembly and a second jaw assembly disposed in substantially perpendicular with a clamp bar. The clamp bar can include a hollow bar with rectangular cross section, which can be coupled to one end of the first and second jaw assembly. The first jaw assembly can be fixedly coupled to the clamp bar. The second jaw assembly can be movably coupled to the clamp bar, such as moving along the clamp bar. The movable second jaw assembly can be secured to the clamp bar, for example, by a locking mechanism. The locking mechanism can be spring loaded, so that it can always lock the jaw assembly to the clamp bar. Operator action can be required to release the lock to move the jaw assembly.

The clamping device can include a pulling element, which can be coupled to a jaw assembly, such as the fixed first jaw assembly or the movable second jaw assembly. For example, the jaw assembly can include a jaw facing a jaw support. The pulling element can be disposed between the jaw and the jaw support. The pulling element can also be coupled to the clamp bar, e.g., so that the jaw assembly and the pulling element can move as one unit along the clamp bar.

An interface between the pulling element and the jaw assembly can include a slanting surface, which can be configured so that when the pulling element is pulled up, the jaw is moving away from the jaw support if there is no obstacle blocking the movement of the jaw. Alternatively, if an object is already present between the jaws of the clamping device, the slanting surface can convert the action of pulling the pulling element to an action, e.g., a force, pushing on the jaw, to clamp on the object.

Figure 11:
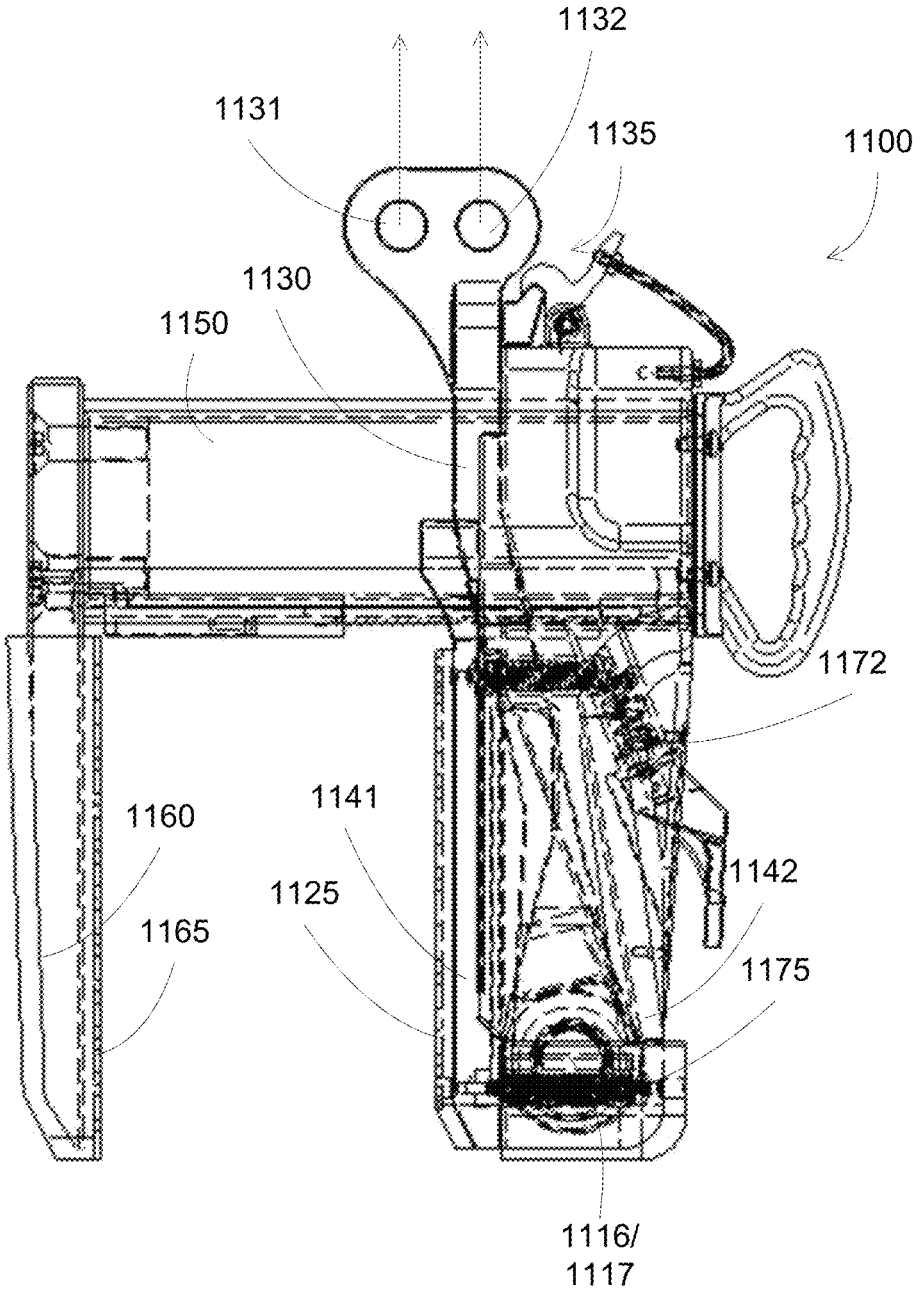
FIG. 11 shows a transparent view of the clamping device.

FIG. 11 shows a transparent view of the clamping device. A clamping device 1100 can include a first jaw 1160 which is fixedly coupled to a clamp bar 1150. A rubber pad 1165 can be coupled to the first jaw to increase friction with clamped objects. A jaw assembly including a second jaw 1141 and a jaw support 1142 can be movably coupled to the clamp bar. A locking mechanism 1172 can be included, to secure the jaw assembly, and as shown, to secure the jaw support, to the clamp bar. A rubber pad 1125 can be coupled to the first jaw to increase friction with clamped objects. Springs 1175 can couple the second jaw with the jaw support.

A pulling element 1130 can be disposed between the second jaw and the jaw support, which can have slanting interfaces with the jaw assembly. The pulling element can include rollers 1116 and 1117, which can roll on the slanting surface of the jaw support. The pulling element 1130 can include one or more elements for coupling with a hoist. For example, the pulling element 1130 can include eyelets 1131 and 1132, which can be disposed parallel to the clamp bar 1150. The eyelets can provide a changing of center of gravity, to keep the clamp bar somewhat parallel with different slap thicknesses. For example, when the clamping device is used to secure and lift a thick slap, e.g., a heavy slap, the center of gravity can be shifted toward the slap, e.g., toward the left direction as shown in the figure. Eyelet 1131 can be used for lifting the clamping device, keeping the clamping device parallel. When the clamping device is used to secure and lift a thin slap, e.g., a lighter slap, the center of gravity can be shifted away from the slap, e.g., toward the right direction as shown in the figure. Eyelet 1132 can be used for lifting the clamping device, keeping the clamping device parallel.

A second locking mechanism 1135 can be coupled to the jaw support for securing the pulling element with the jaw support.

Figure 12:
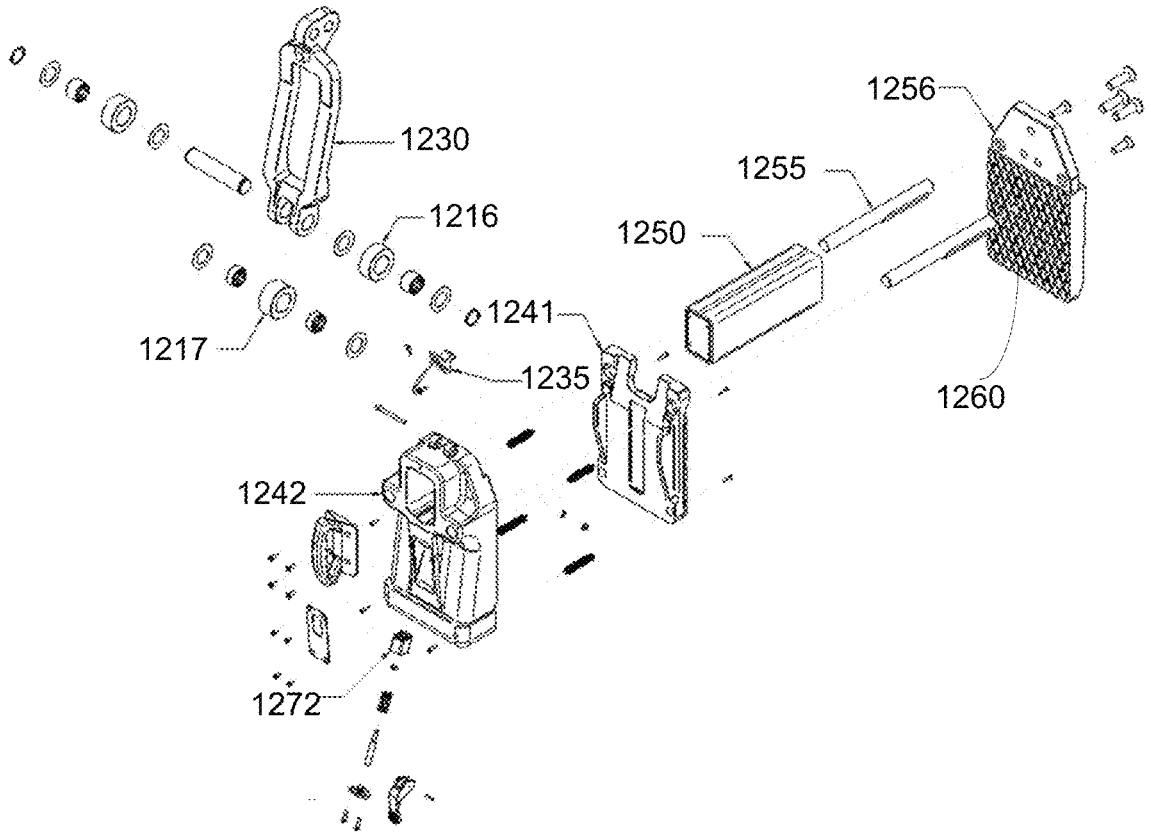
FIG. 12 shows an exploded view of the clamping device.

FIG. 12 shows an exploded view of the clamping device. The components of the clamping device are shown in exploding relationship, including the first jaw 1260, the second jaw 1241, the jaw support 1242, the clamp bar 1250, the pulling element 1230, the locking mechanism 1272, the second locking mechanism 1235, and the rollers 1216 and 1217. In addition, support bars 1255 acting as limiter for the second jaw car shown, together with the hollow spaces 1256 in the second jaw.

Figure 13A:
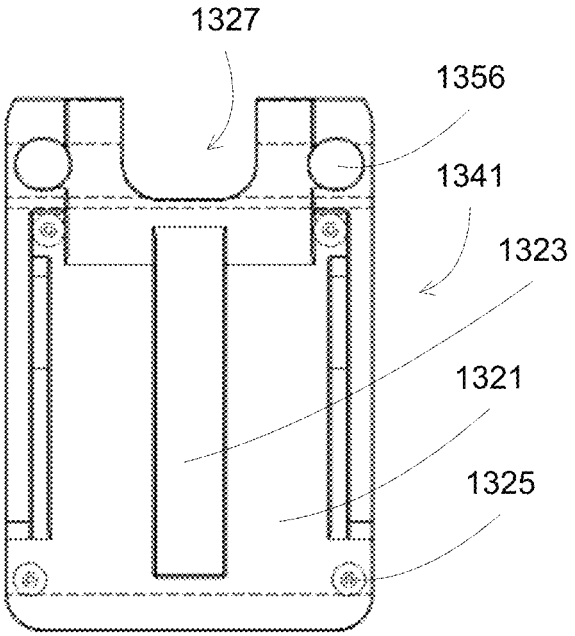
FIGS. 13A-13C show different views of a jaw of in jaw assembly in the clamping device.
Figure 13B:
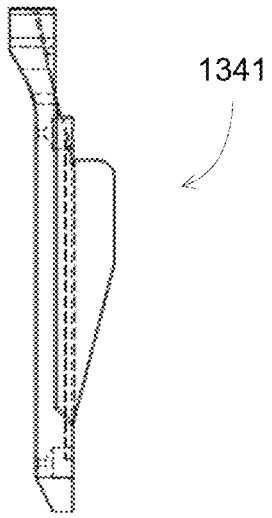
Figure 13C:
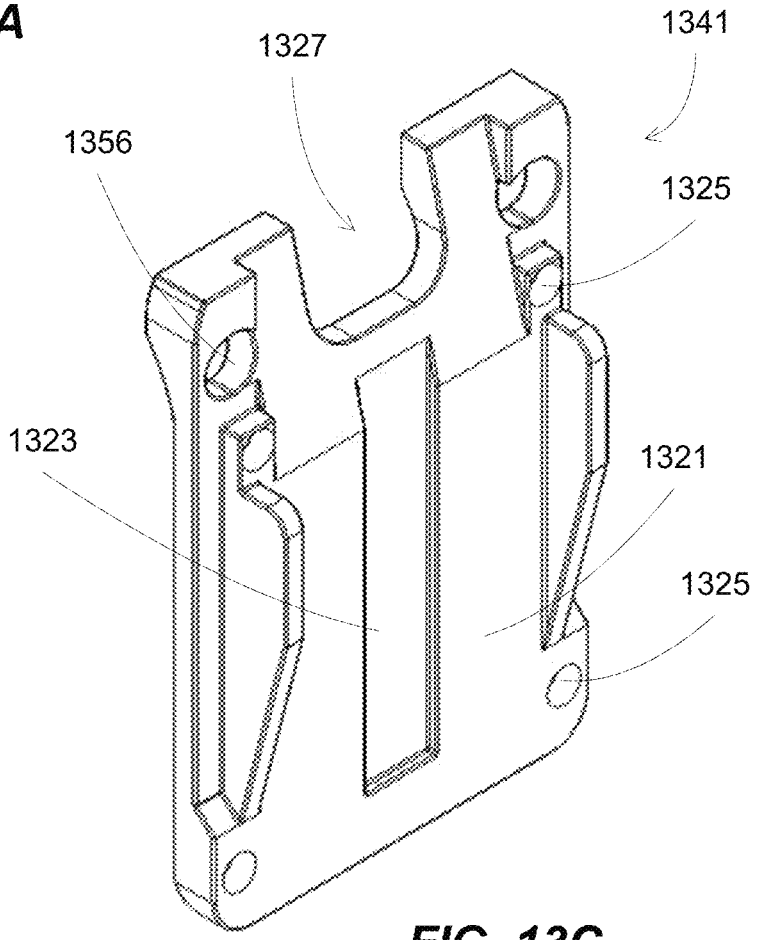

FIGS. 13A-13C show different views of a jaw of in jaw assembly in the clamping device. In FIG. 13A, a jaw 1341, such as the second jaw in a jaw assembly of a clamping device, can include hollow spaces 1356, which can allow the support bars to pass through to act as limiters for the jaw 1341, e.g., to limit the movements of the jaw 1341. A recess 1327 at a top portion of the jaw 1341 can allow the clamp bar to pass through. The recess can have the shape of a portion of the shape of the clamp bar, which can be rectangular. FIG. 13B shows a different view of the jaw 1341 of in jaw assembly in the clamping device. In the FIG. 13C, the jaw 1341 can include coupling terminals 1325, which can be used to secure the ends of the springs to the jaw 1341. The jaw 1341 can include a wall surface 1321, which can allow rollers of a pulling element to roll on. The jaw 1341 can include a recess 1323 on a portion of the wall surface 1321, which can prevent other rollers of the pulling element from contacting the jaw 1341. The other rollers can be configured to roll on surface of a jaw support, and not contacting surfaces of the jaw.

Figure 14A:
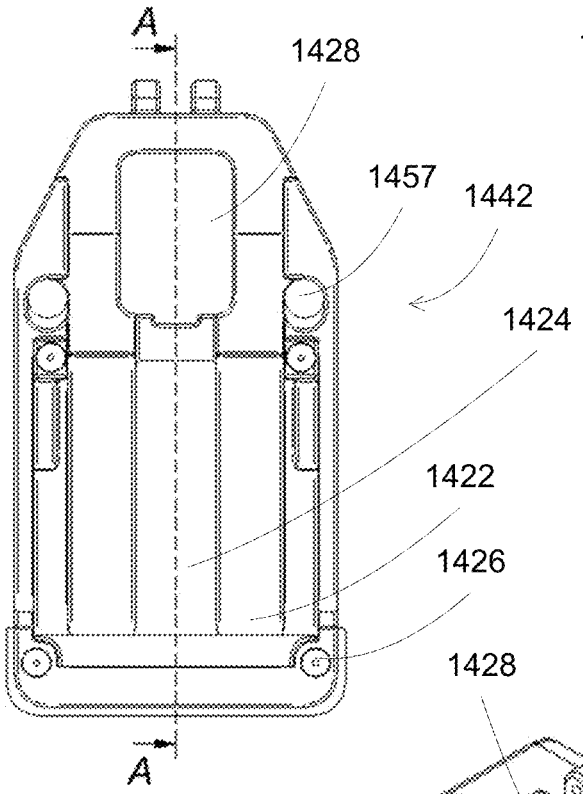
FIGS. 14A-14C show different views of a jaw support portion of a jaw assembly in the clamping device.
Figure 14B:
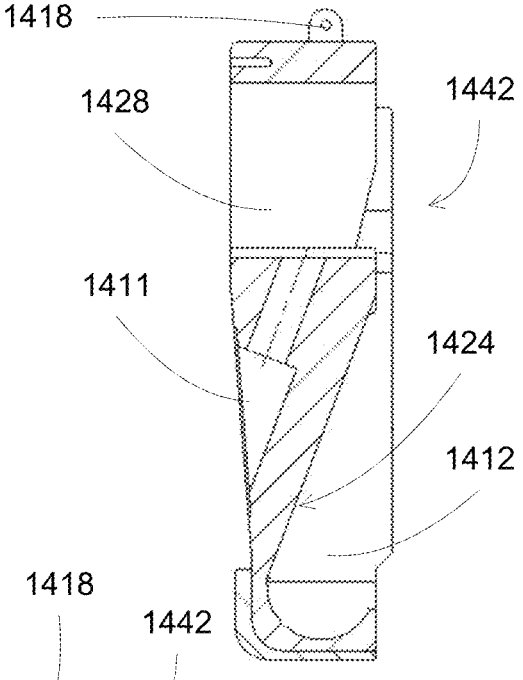
Figure 14C:
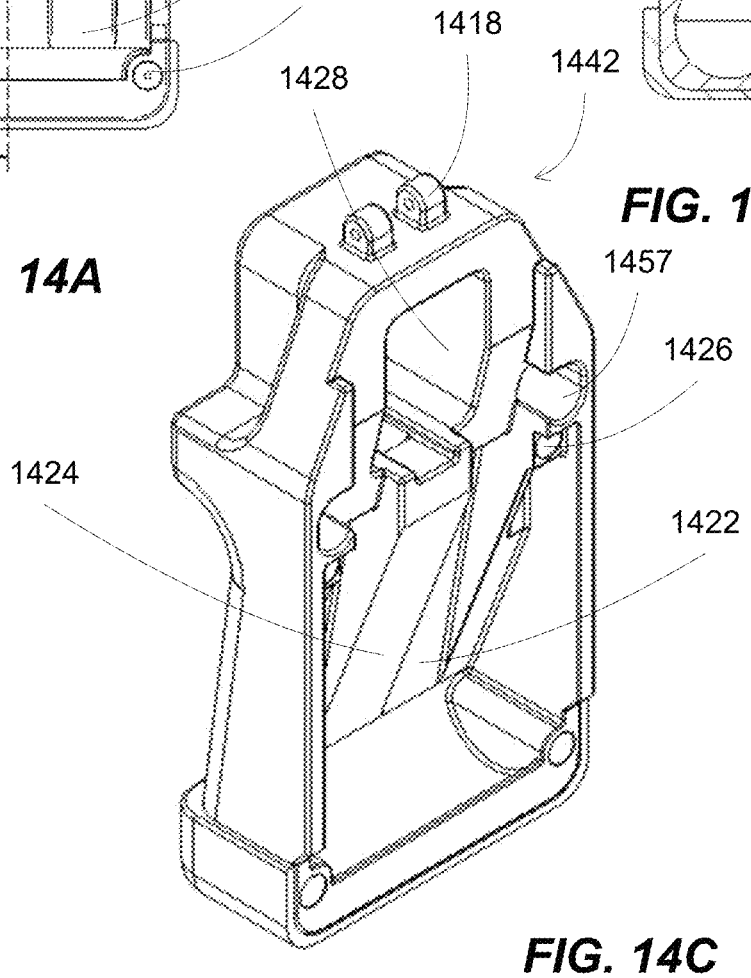

FIGS. 14A-14C show different views of a jaw support portion of a jaw assembly in the clamping device. In FIG. 14A, a jaw support 1442, such as the jaw support in a jaw assembly of a clamping device, can include a hollow space 1428, which has the same shape and size as a clamp bar, to allow the clamp bar to pass through. Further, there can be a tight fit of the hollow space with the clamp bar, so that the jaw support can move along the clamp bar without moving in directions perpendicular to the moving directions.

The jaw support 1442 can include hollow spaces 1457, which can allow the passing the support bars, which act as limiters for the corresponding jaw in the jaw assembly. The hollow spaces 1457 can allow the jaw support to move along the support bars.

The jaw support 1442 can include coupling terminals 1426, which can be used to secure the ends of the springs to the jaw support 1442, e.g., the other ends of the springs can be secured to the coupling terminals of the jaw (FIG. 14A and FIG. 14C).

The jaw support can include an opening 1411 for the installation of a clocking mechanism. The opening can be used to install a mating component to a cyclic pattern bar, which is fixedly coupled to the clamp bar (FIG. 14B).

The jaw support can include a hollow cavity 1412 (FIG. 14B), which can be used to house the pulling element. The jaw support can include a slanting surface 1424, on which the rollers of the pulling element can roll on, for moving relative to the jaw support, and for pushing the jaw toward the object. Near the slanting surface 1424 are recesses 1422, which can be used to prevent the other rollers of the pulling element from contacting the jaw support.

Figure 15A:
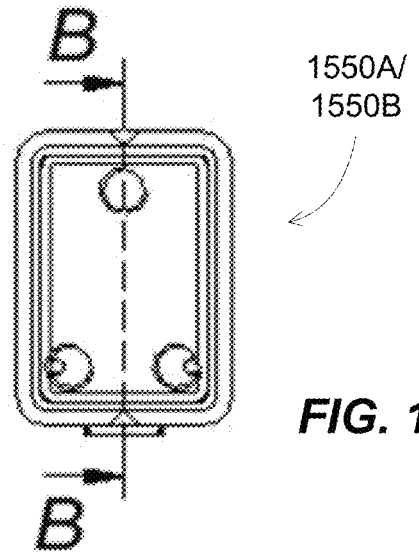
FIGS. 15A-15C show different views of different configurations for a clamp bar portion of a jaw assembly in the clamping device.
Figure 15B:
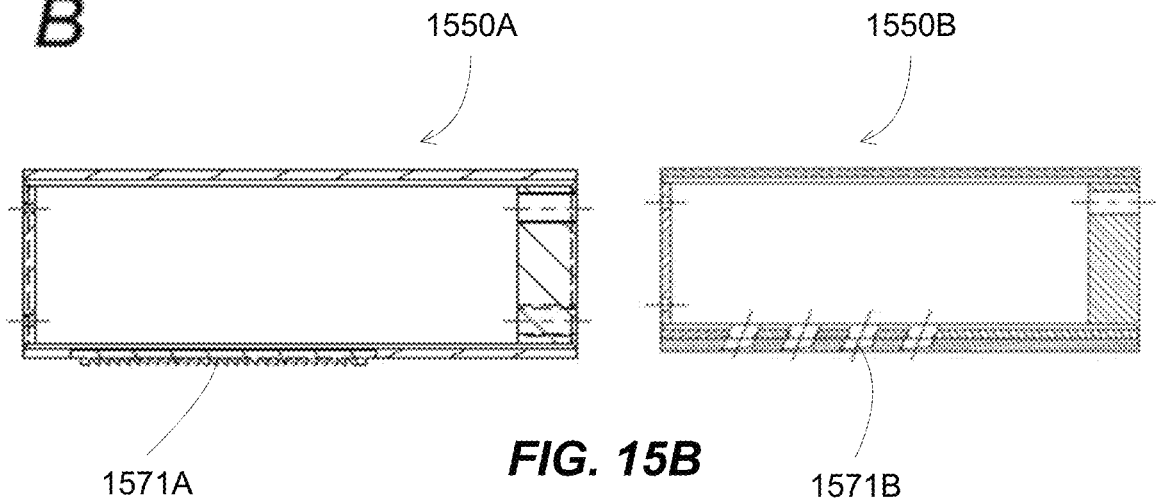
Figure 15C:
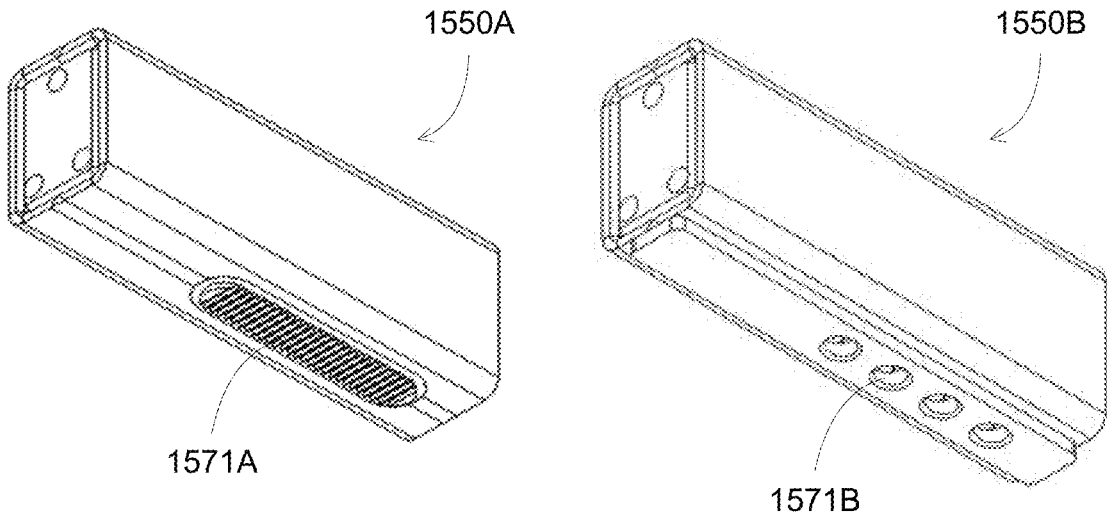

FIGS. 15A-15C show different views of different configurations for a clamp bar portion of a jaw assembly in the clamping device. FIG. 15A shows a side view of clamp bars 1550A and 1550B, with cross section BB. FIG. 15B shows cross sections BB of clamp bar 1550A and 1550B, showing cyclic pattern bars 1571A and 1571B. The cyclic pattern bar 1571A can be a rack bar (or a cog bar, with protruded teeth). The cyclic pattern bar 1571B can include multiple holes. FIG. 15C show perspective views of the clamp bars 1550A and 1550B. The clamp bar can have a rectangular cross section. The clamp bar can include a hollow bar, for example, to reduce the weight of the clamp device.

Figure 16A:
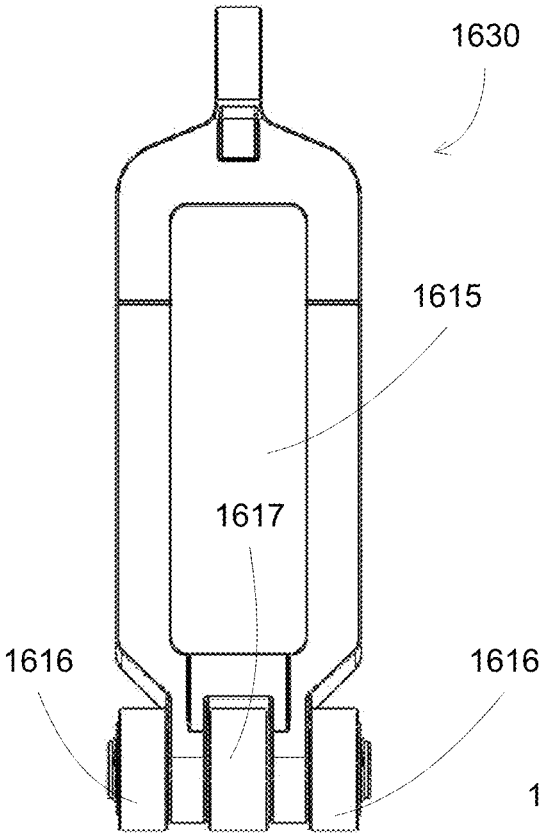
FIGS. 16A-16C show different views of a pulling element portion of a jaw assembly in the clamping device.
Figure 16B:
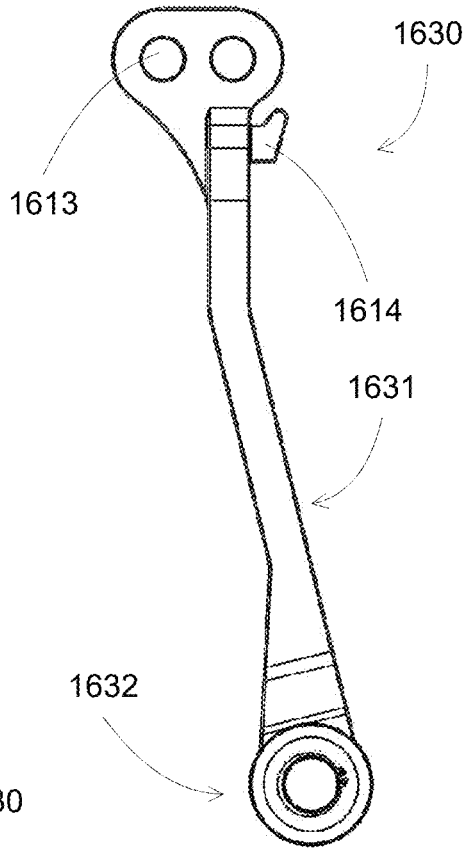
Figure 16C:
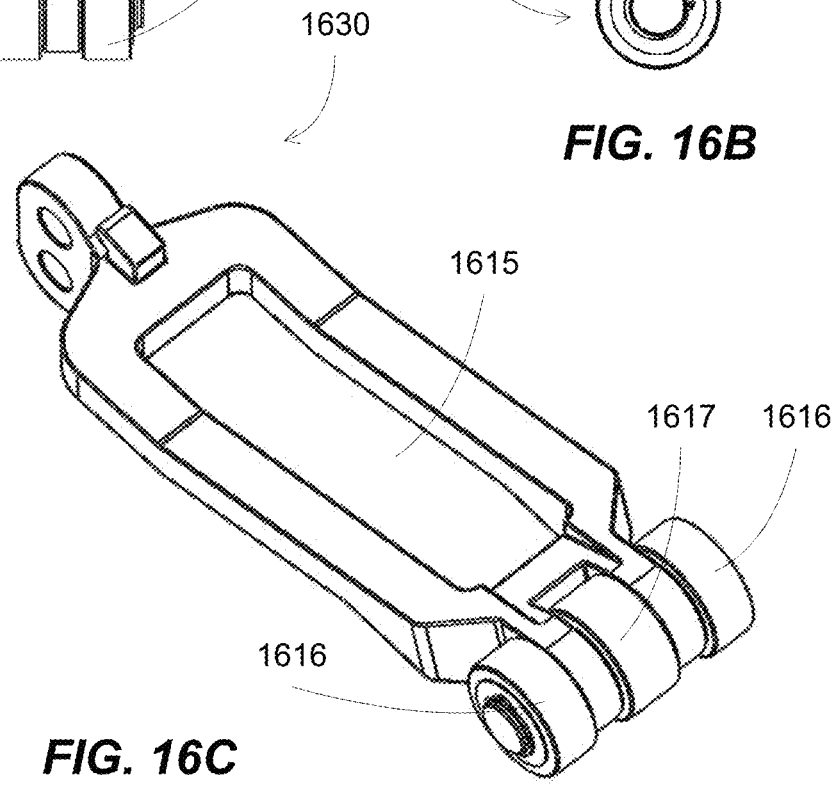

FIGS. 16A-16C show different views of a pulling element portion of a jaw assembly in the clamping device. The pulling element 1630 can include a connector 1613 for coupling to a hoist, such as a hook or one or two holes for accepting a hook terminal from a hoist. Thus the pulling element can be pulled up by the hoist. Since the pulling element is coupled to the clamping device, the hoist then can pull up the clamping device. Since the clamping device clamps on the object, the hoist then can pull up and then transfer the object.

The pulling element can include a hollow space 1615 (FIG. 16A and FIG. 16C), which can be configured for the clamp bar to pass through. Thus the pulling element can be coupled to the clamp bar, and in turn, coupled to the clamp device. The hollow space 1615 can be larger in a vertical direction, e.g., in the direction of gravity or the up/down directions, e.g., larger than a cross section of the clamp bar. Thus the pulling element can move in the up and down directions. The hollow space can be used as a limiter, to limit the up/down movements of the pulling element. For example, the top end of the hollow space can limit the pulling element from going downward, after the pulling element contacts the clamp bar. In this position, the pulling element can be secured to the jaw support, through a locking mechanism that includes a locking component 1614, such as a hook. A mating latch can be disposed in the jaw support, thus when the mating latch locks onto the hook 1614, the pulling element can be constrained from moving upward.

The hollow space can be configured to have a tight fit in a horizontal direction with the clamp bar, which can prevent the pulling element from moving in a horizontal direction. In another horizontal direction, e.g., directions along the clamp bar, the pulling element can move, but because the pulling element is disposed between the jaw and the jaw support of a jaw assembly, the pulling element is constrained and can only move when the jaw assembly moves. Thus the pulling element can be coupled to the clamp bar in such a way as to be able to move up and down, but not sideway.

The pulling element can include a set of rollers 1616 and 1617 (FIG. 16A and FIG. 16C). The rollers 1616 can be configured to roll on surfaces of the jaw support. The rollers 1617 can be configured to roll on surfaces of a jaw, which is facing the jaw support and which, in combination with the jaw support, forms a jaw assembly.

In some embodiments, the rollers are concentric, e.g., aligned in a horizontal line, and have a same dimension, e.g., diameter. The surfaces of the jaw facing the rolled surface of the jaw support can be recessed, so that the rollers 1616 can roll on the jaw support surface in the gap between the jaw and the jaw support. The surfaces of the jaw support facing the rolled surface of the jaw can be recessed, so that the rollers 1617 can roll on the jaw surface in the gap between the jaw and the jaw support.

The pulling element is configured to form a slanting interface with the jaw assembly, e.g., with at least one of the jaw and the jaw support. In some embodiments, a slanting interface can be formed by having a triangle shape in a gap between the jaw and the jaw support, together with the pulling element having a triangle shape when view from a horizontal direction parallel to the gap (FIG. 16B). Thus the pulling element can have a small top portion 1631, e.g., a small handle at the top and middle portion of the pulling element. The pulling element can have a larger bottom portion 1632, which can be achieve by having a larger bottom portion of the pulling element, together with larger diameter rollers.

Since the diameters of the rollers are larger than the middle portion 1631, when the pulling element moves up, the rollers can enlarge the gap, e.g., the separation between the jaw and the jaw support, or can exert a force on the jaw away from the jaw support, if the jaw is constrained from moving.

Figure 17A:
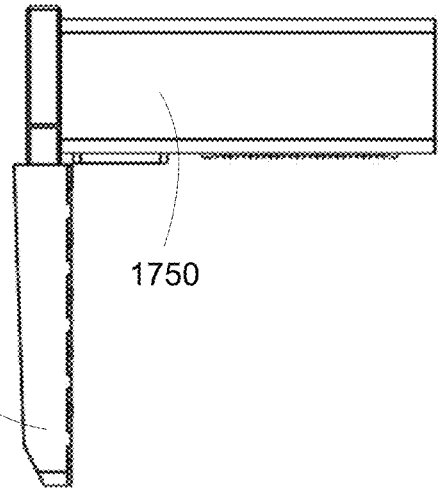
FIGS. 17A-17C show configurations for a jaw coupling to a clamp bar in the clamping device.
Figure 17B:
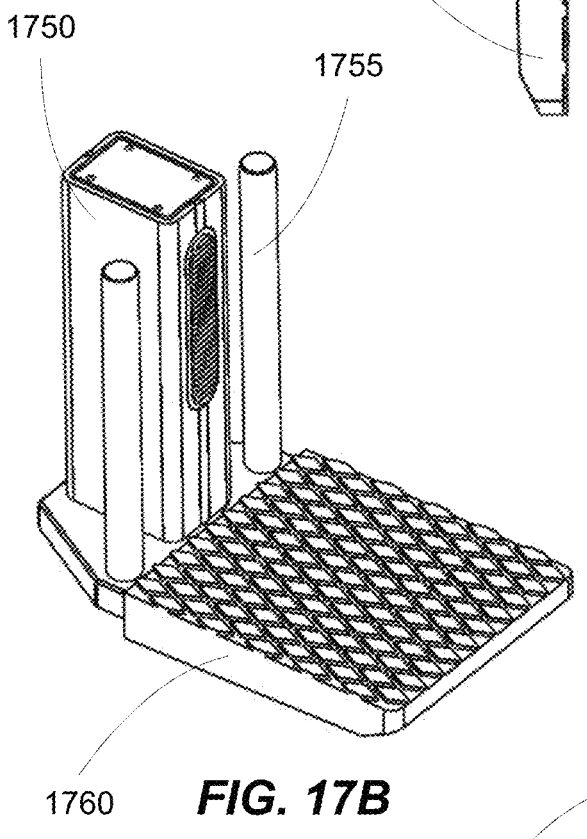
Figure 17C:
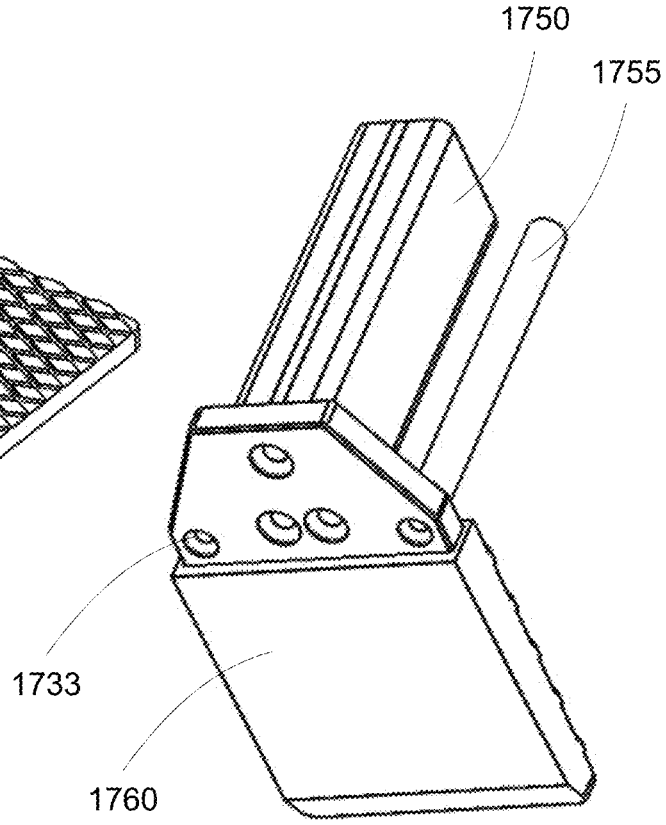

FIGS. 17A-17C show configurations for a jaw coupling to a clamp bar in the clamping device. A jaw, such as a first jaw 1760, can be fixedly coupled to a clamp bar 1750 (FIG. 17A), for example, through screw holes 1733 (FIG. 17C). The jaw and the clamp bar can form a right angle. Support bars 1755 can be fixedly coupled to the jaw 1760 (FIG. 17B). The support bar can be used as limiters for a second jaw, which is disposed in opposite of the first jaw 1760. A jaw assembly can slide along the clamp bar, and the support bars.

FIGS. 18A-18D show configurations for a jaw coupling to a limiter in the clamping device. A jaw 1841 (FIG. 18A, FIG. 18B, FIG. 18C and FIG. 18D), such as a second jaw (e.g., in addition to the first jaw fixedly coupled to the clamp bar), can be coupled to a jaw support. The jaw support is then coupled to the clamp bar.

Figure 18A:
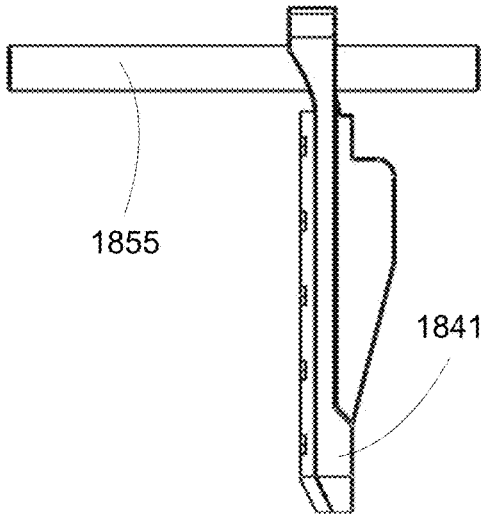
FIGS. 18A-18D show configurations for a jaw coupling to a limiter in the clamping device.
Figure 18B:
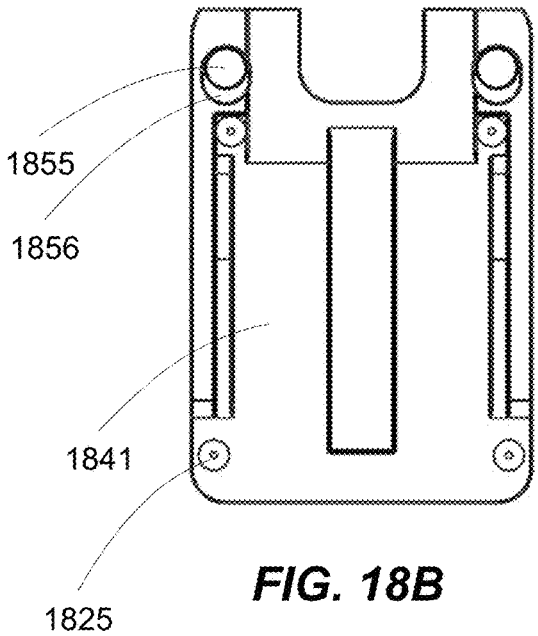
Figure 18C:
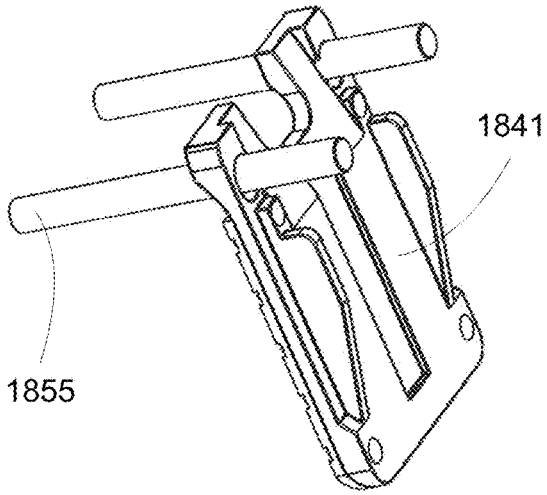
Figure 18D:
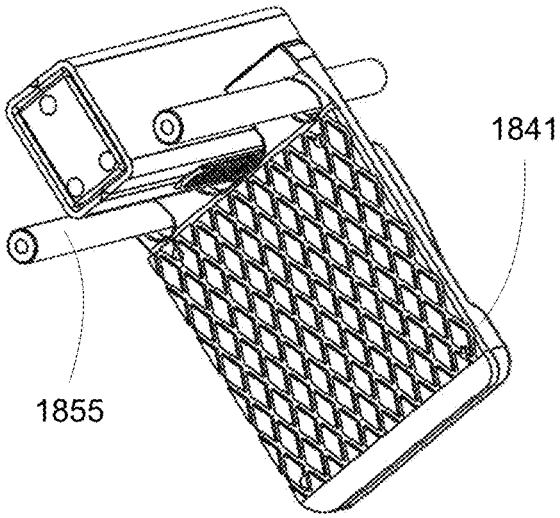

The second jaw can be coupled to the support bars, e.g., loosely coupled as to be able to move in limited distances. For example, the second jaw can include through holes 1856, which is larger than the cross section of the support bars 1855 (FIG. 18A, FIG. 18B, FIG. 18C and FIG. 18D). As shown, the second jaw can move up a small distance, and can have a much more restricted movement in the horizontal direction, due to the shape of the through holes 1856 as compared to the support bars 1855 (FIG. 18B).

In the FIG. 18B, the second jaw can include connector terminals 1825, such as recesses in the second jaw, for coupling with flexible elements such as springs, to couple the second jaw with the jaw support.

Figure 19A:
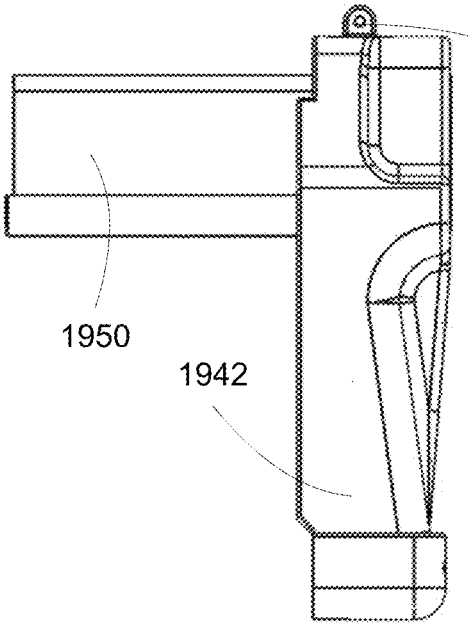
FIGS. 19A-19D show configurations for a jaw support coupling to a clamp bar in the clamping device.
Figure 19B:
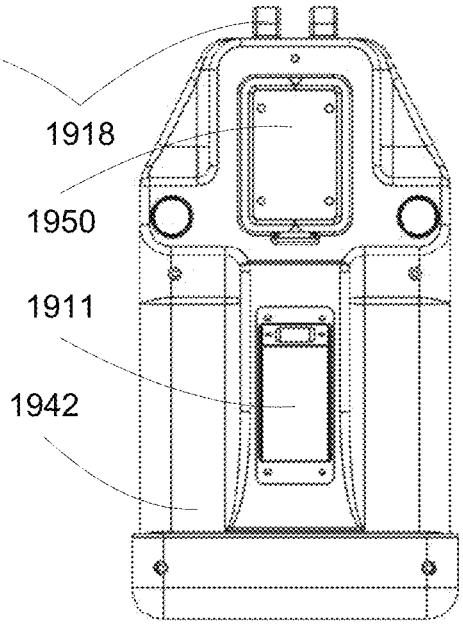
Figure 19C:
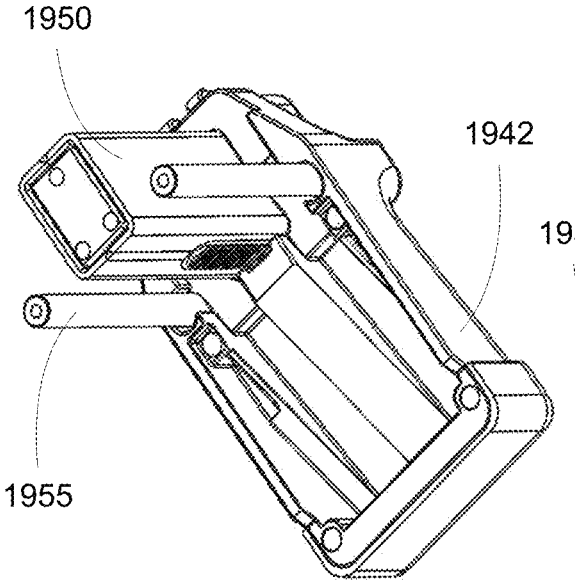
Figure 19D:
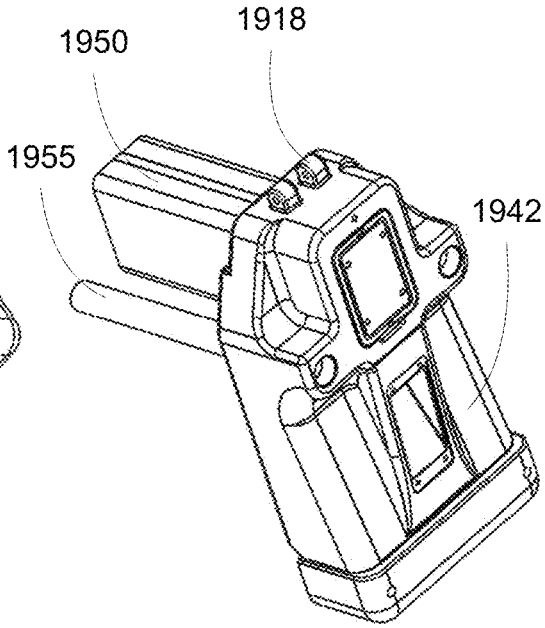

FIGS. 19A-19D show configurations for a jaw support coupling to a clamp bar in the clamping device. The jaw support 1942 can have a hollow space with tight fit to the clamp bar 1950, so that the jaw support can move in directions along the clamp bar, but is restricted or constrained in other directions, such as up/down or sideway, e.g., perpendicular to the directions along the clamp bar (FIG. 19A, FIG. 19B, FIG. 19C and FIG. 19D). The jaw support can also have hollow spaces for the support bars 1955 to pass through with tight fit (FIG. 19D).

The jaw support can include a cavity 1911 for housing components of a locking mechanism for securing the jaw support with the clamp bar (FIG. 19B). The jaw support can include a mounting component 1918 for housing components of a second locking mechanism for securing the pulling element with the jaw support.

Figure 20A:
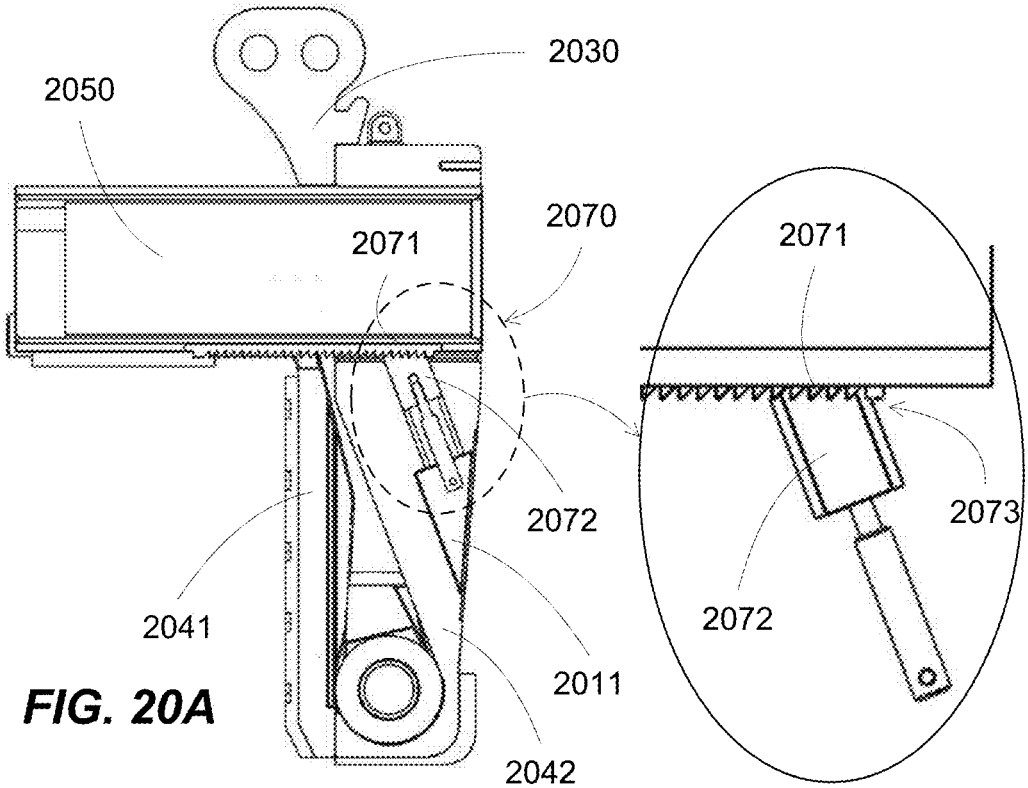
FIGS. 20A-20B show configurations for a locking mechanism to secure a jaw support to a clamp bar in the clamping device.
Figure 20B:
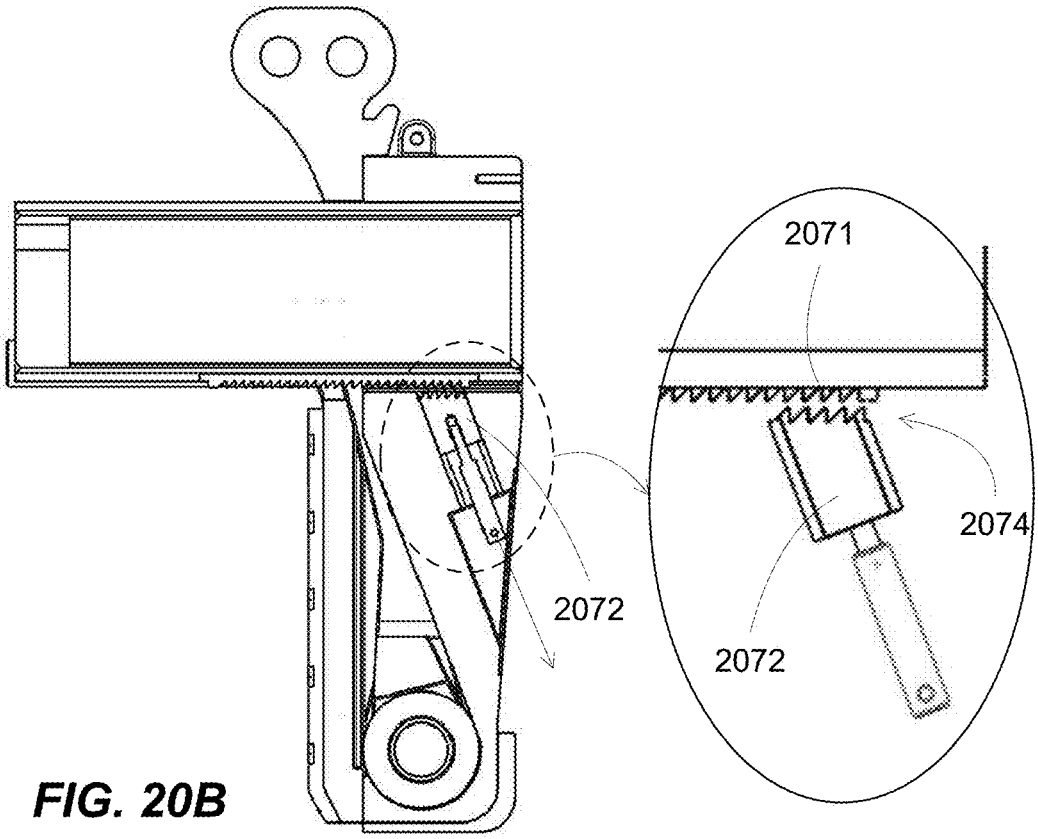

FIGS. 20A-20B show configurations for a locking mechanism to secure a jaw support to a clamp bar in the clamping device. A jaw assembly can include a jaw 2041 and a jaw support 2042. A pulling element 2030 can be disposed between the jaw and the jaw support. A clamp bar 2050 can pass through the jaw assembly and the pulling element, thus can allow the jaw assembly and the pulling element to move along the clamp bar.

A locking mechanism 2070 can be used to secure the jaw support to the clamp bar. The locking mechanism 2070 can include a cyclic pattern bar 2071 coupled to the clamp bar. As shown, the cyclic pattern bar 2071 includes a cog bar, which has multiple protruded gear teeth. The gear teeth can be asymmetric, such as having a triangle shape tilted toward the opposite jaw. In that way, it can be easier to move the jaw support toward the jaw than to move the jaw support away from the jaw. Other cyclic pattern bars can be used, such as a number of holes.

The locking mechanism 2070 can include a mated pattern component 2072, which can have a top portion mated with the cyclic pattern bar. The mated pattern component can be housed in a cavity 2011 in the jaw support. The mated pattern component can be engaged or disengaged from the cyclic pattern bar, locking to or unlocking the jaw support from the clamp bar, respectively.

FIG. 20A shows an engagement configuration 2073 of the locking mechanism, in which the mated pattern component 2072 is pushed toward the clamp bar to contact the cog bar 2071. FIG. 20B shows a disengagement configuration 2074 of the locking mechanism, in which the mated pattern component 2072 is pushed backward away from the clamp bar, e.g., from the cog bar 2071. The jaw support then can be free to move along the clamp bar.

Figure 21A:
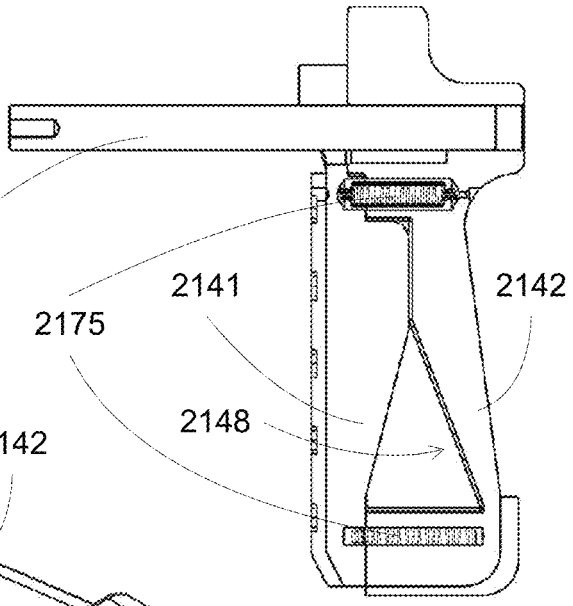
FIGS. 21A-21C show configurations for a jaw coupling to a jaw support in the clamping device.
Figure 21B:
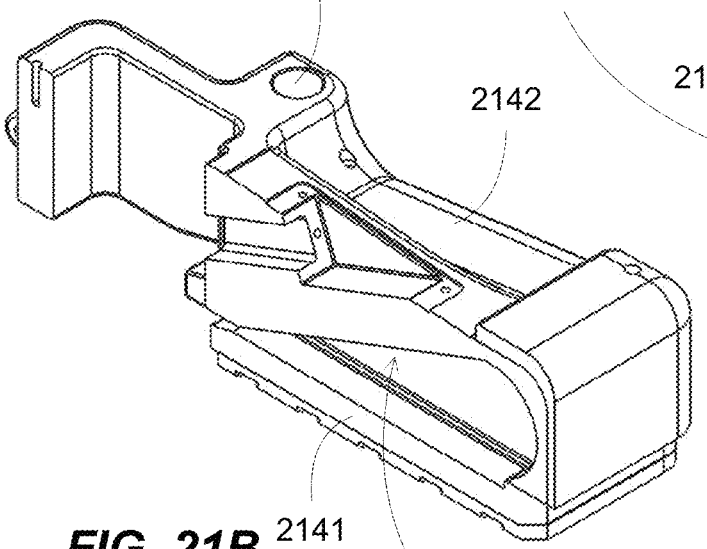
Figure 21C:
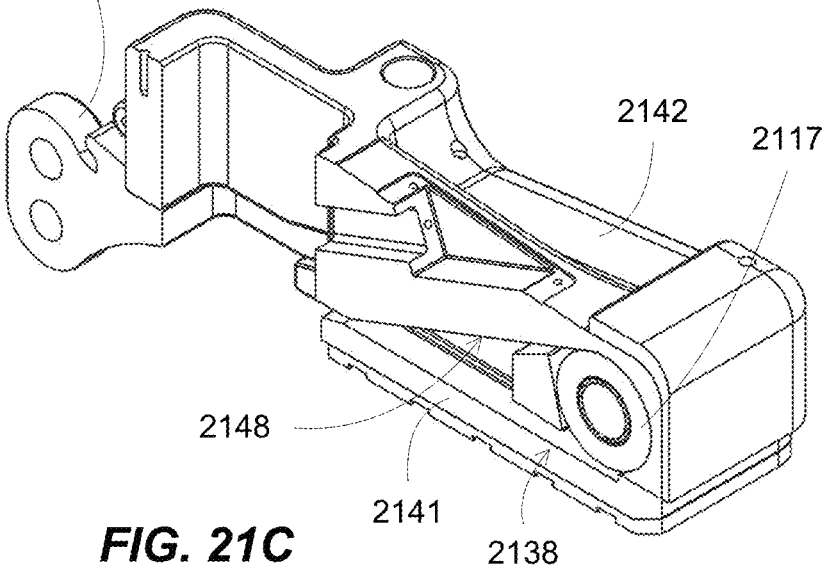

FIGS. 21A-21C show configurations for a jaw coupling to a jaw support in the clamping device. A jaw 2141 can be coupled to a jaw support 2142 in a way that can allow the jaw to move relative to the jaw support. Support bars 2155 can be used to pass through both the jaw and the jaw support (FIG. 21A). The support bars can make a tight fit with the jaw support, e.g., passing the jaw support at through holes 2157 with about the same dimension as the cross section of the support bars, so as allow the jaw support to move along the support bars without any sideward movements (FIG. 21B). The support bars can make a loose fit with the jaw, so as allow the jaw support to move along the support bars together with limited sideward movements.

Springs 2175 can also be used to couple the jaw to the jaw support. The springs can be fixed at one end to the jaw, and the opposite end to the jaw support. The springs can be configured so that there is a small force pulling the jaw to the jaw support, e.g., enough to allow the jaw to contact the jaw support and to prevent the jaw, when at rest, from leaving the jaw support.

The jaw support can include a slanting surface 2148, which is tapered toward the jaw in the direction toward the clamp bar, e.g., the jaw and the jaw support can form a cavity in the shape of a triangle, with the bottom portion larger than the top portion.

Couple with a pulling element 2130 having rollers 2117, the slanting surface 2148 can allow the jaw to separate from the jaw support when the pulling element is pulled up, e.g., the rollers 2117 is rolled toward the clamp bar direction. The jaw can have a recess 2138, so that when the rollers 2117 roll on the slanting surface 2148 of the jaw support, the rollers do not contact the surface of the jaw (FIG. 21C).

Figure 22A:
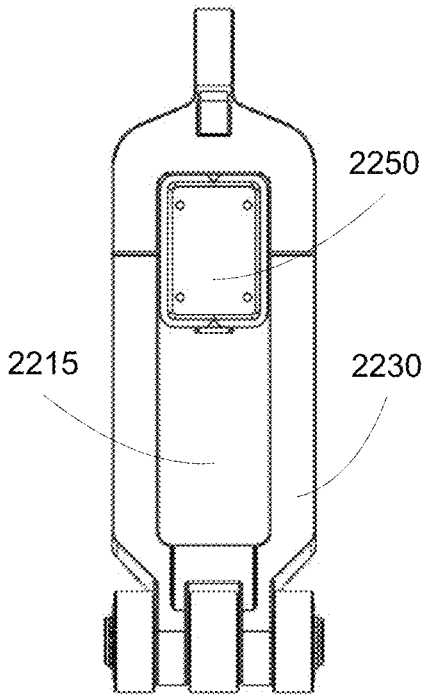
FIGS. 22A-22C show configurations for a pulling element to a clamp bar in the clamping device.
Figure 22B:
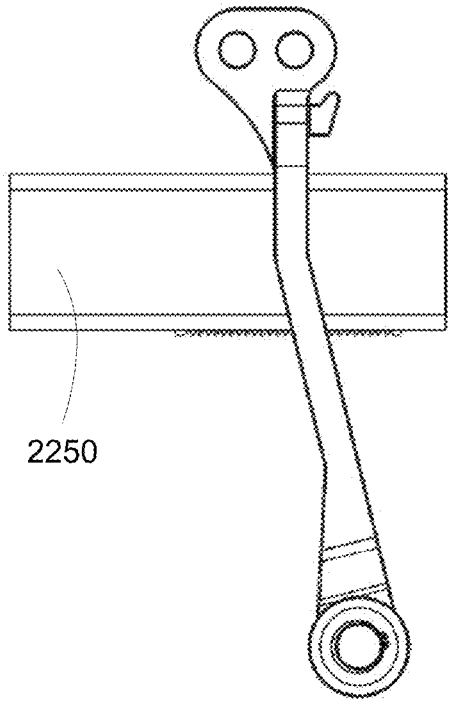
Figure 22C:
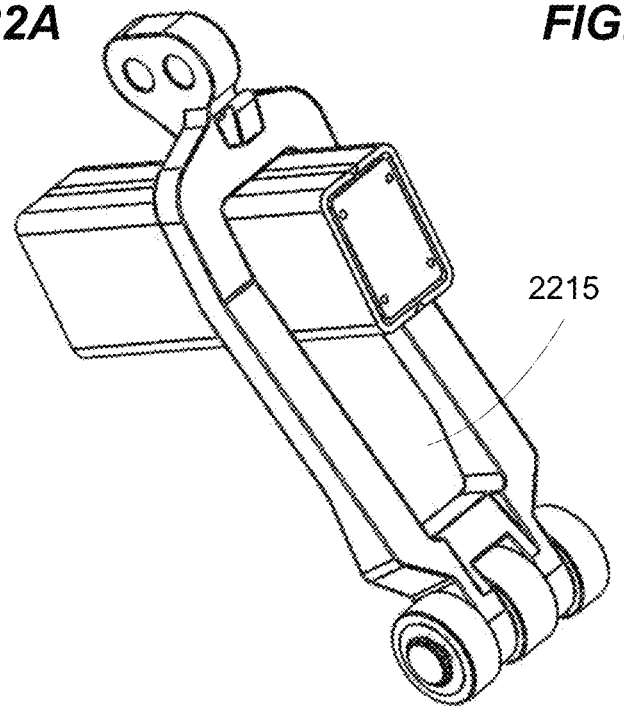
Figure 23A:
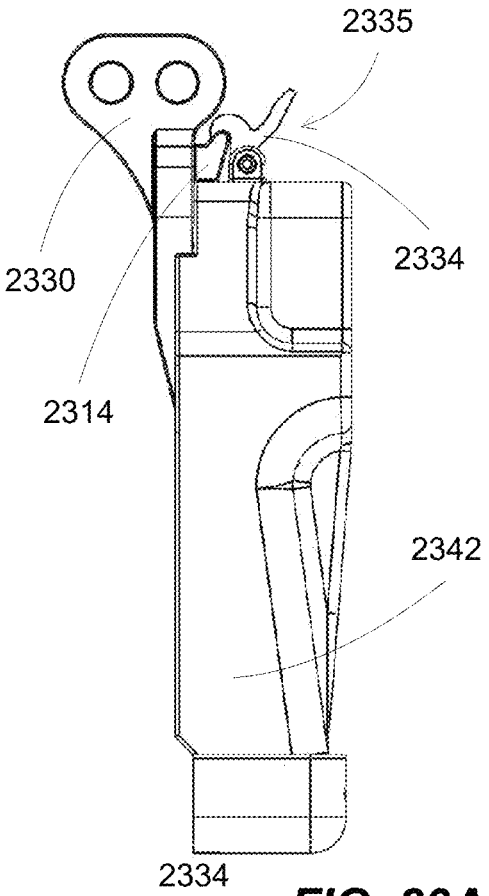
FIGS. 23A-23D show configurations for a locking mechanism to secure a jaw support to a clamp bar in the clamping device.
Figure 23B:
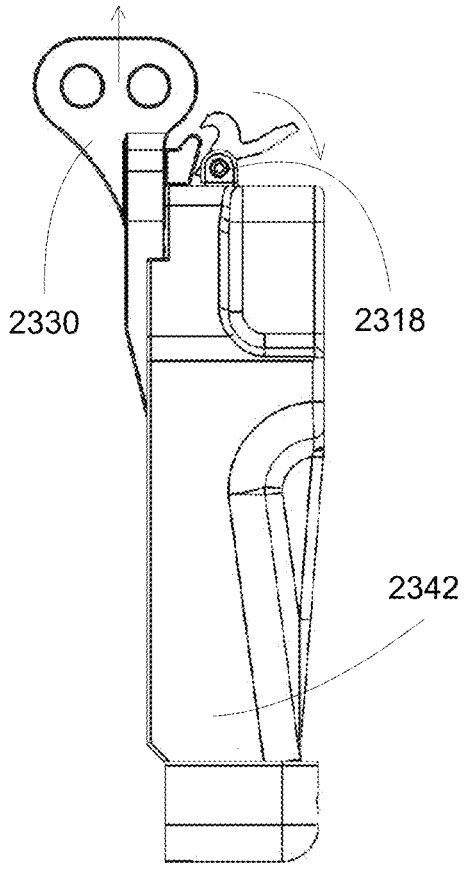
Figure 23C:
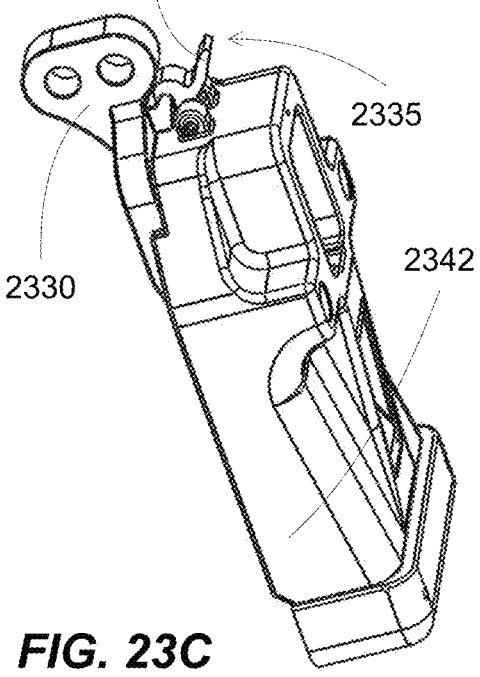
Figure 23D:
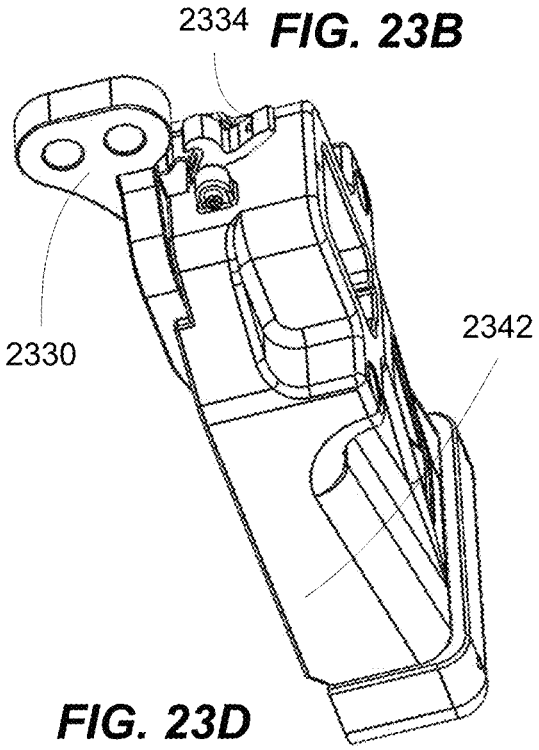

FIGS. 22A-22C show configurations for a pulling element to a clamp bar in the clamping device. A pulling element 2230 (FIG. 22A) can be coupled to a clamp bar 2250 (FIG. 22B) in such a way as to allow the pulling element to move up and down but not sideway. For example, the clamp bar can have a rectangular cross section. And the pulling element can have a hollow space 2215 (FIG. 22C) with a corresponding rectangular shape. The up/down dimensions of the hollow space can be larger than the clamp bar cross section, thus can allow the pulling element to move up or down with respect to the clamp bar. The sideward dimensions of the hollow space, e.g., the horizontal dimensions of the hollow space 2215 in FIG. 22A, can be similar to the clamp bar cross section, thus can allow the pulling element to move up and down but not sideway.

FIGS. 23A-23D show configurations for a locking mechanism to secure a jaw support to a clamp bar in the clamping device. In addition to a locking mechanism used to secure the jaw support to the clamp bar, a second locking mechanism 2335 can be included to secure the pulling element 2330 to the jaw support 2342. The second locking mechanism can lock the pulling element to a downward most position, e.g., a position that minimizes the gap distance between the jaw and the jaw support, or a position that makes the jaw closest to the jaw support. Together with the springs pulling on the jaw toward the jaw support, the second locking mechanism can keep the jaw of the jaw assembly away from the opposite jaw in the clamping device, e.g., making sure that the opening between the jaws of the clamping device is largest possible so that it can be easier to put the object into the jaws.

The second locking mechanism can include a latch 2334, which can be rotated around a center or rotation 2318 on the jaw support. Rotating forward in one direction, such as counterclockwise as in FIG. 23A or 23C, the latch can engage with a hook 2314 in the pulling element, preventing the pulling element from moving upward. Rotating backward, such as clockwise as in FIG. 23B or 23D, the latch can disengage from the hook 2314, allowing the pulling element to move upward.

The latch can be configured for automatic lock, e.g., from the unlocked or disengaged position, the pulling element can be pushed down, and the hook 2314 can push on a level of the latch 2334, swinging the latch counterclockwise to lock or engage with the hook. A spring can be included, to keep the latch in engaged position. The pulling element, when pushed down, can swing the latch clockwise to open the latch. When the pulling element is at the lowest position, the latch can swing back to lock with the hook.

FIGS. 24A-24B illustrate flow charts for forming a clamping device according to some embodiments. In FIG. 24A, operation 2400 forms a clamping device, wherein the clamping device comprises a first jaw coupled to a clamp bar, and a jaw assembly coupled to the clamp bar, wherein the jaw assembly comprises a second jaw disposed opposite the first jaw for clamping on an object, wherein the jaw assembly comprises a jaw support, wherein the jaw assembly comprises a pulling element disposed between the second jaw and the jaw support, wherein at least an interface between the pulling element and the jaw support and an interface between the pulling element and the second jaw comprises a slanting surface, wherein the slanting surface is configured so that when the clamping device is lifted up from the pulling element, the second jaw is configured to press on the object.

In FIG. 24B, operation 2420 forms a clamping device, wherein the clamping device comprises a clamp bar, a first jaw, and a jaw assembly, wherein the jaw assembly comprises a jaw support, wherein at least one of the first jar or the jaw support is configured to movably couple to the clamp bar and to lockably coupled to the clamp bar at discrete positions through a locking mechanism, wherein the jaw assembly comprises a second jaw disposed opposite the first jaw for clamping on an object, wherein the second jaw is coupled to the jaw support through a flexible component to allow the second jaw to move in multiple directions with respect to the jaw support, wherein the jaw assembly comprises a pulling element disposed between the second jaw and the jaw support, wherein at least an interface between the pulling element and the jaw support and an interface between the pulling element and the second jaw comprises a slanting surface, wherein the slanting surface interface comprises a rolling friction, wherein the slanting surface is configured so that when the pulling element moves in a direction comprising a vertical direction, the second jaw moves away relative to the jaw support in a direction comprising a horizontal direction.

Figure 25A:
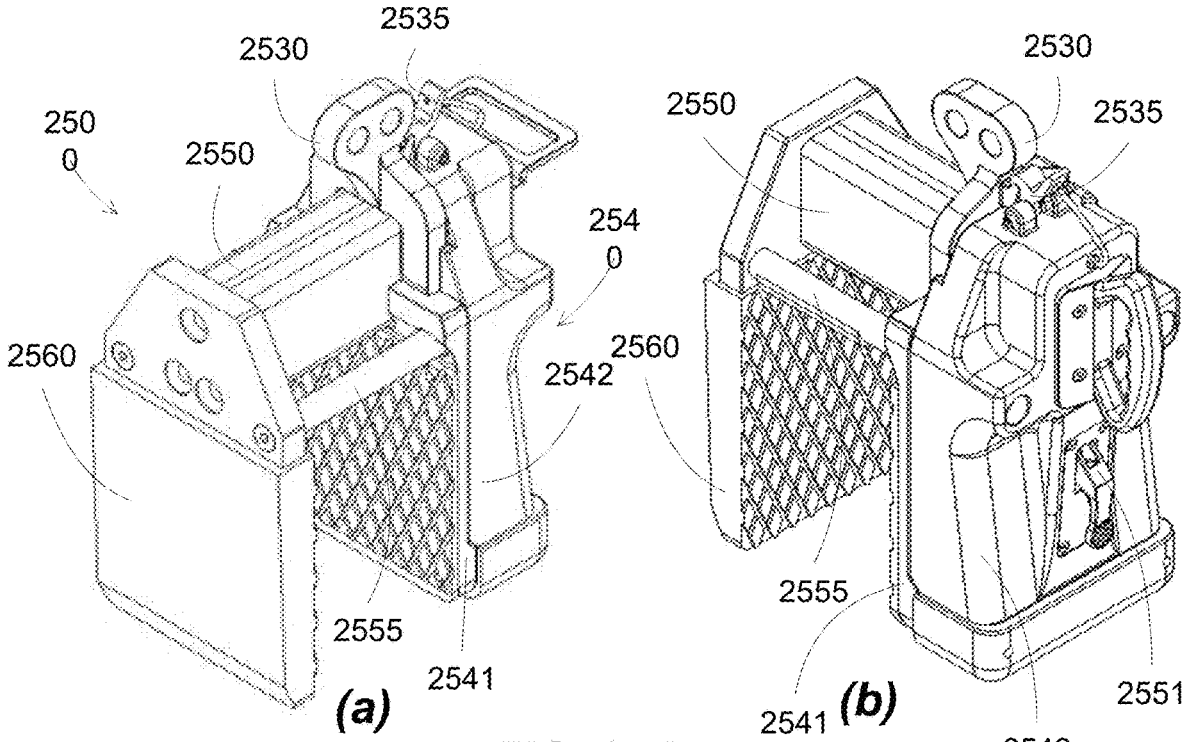
FIGS. 25A (a)-(b) and 25B (a)-(c) illustrate an operation of a clamping device according to some embodiments.

FIGS. 25A (a)-(b) and 25B (a)-(c) illustrate an operation of a clamping device according to some embodiments. FIG. 25A (a)-(b) show perspective views of a clamping device 2500 configured for lifting heavy objects. The clamping device can include a first jaw 2560 fixedly coupled to a clamp bar 2550. The clamping device can include a second jaw assembly 2540, which can be movably and lockably coupled to the clamp bar. The second jaw assembly can include a second jaw 2541 disposed opposite the first jaw. The second jaw assembly can include a jaw support 2542, which can slide along the clamp bar for movably coupled to the clamp bar. The second jaw assembly can include a discrete locking mechanism 2551 for locking to the clamp bar. The second jaw assembly can include stretchable elements, such as springs (not shown), which can be coupled to the second jaw and the jaw support, for pulling the second jaw toward the jaw support. The stretchable elements can allow the second jaw to move away from the jaw support, for a limited distance, such as a distance equal or smaller than a distance between the discrete locking locations of the discrete locking mechanism.

End point limits 2555 can be included to prevent the second jaw from moving too far from the jaw support, such as support bars 2555 fixedly coupled to the first jaw, passing through the second jaw with large openings, and stopping after passing the jaw support.

The clamping device can include a pulling element 2530, which can be configured to be pulled on for lifting the clamped object. The pulling element can freely move in an up direction. The pulling element can be configured to exert a clamping force on the object when being pulled, for example, through slanting surfaces of the components of the second jaw assembly, such as a slanting interface between the pulling element and the jaw support.

A second locking mechanism 2535 can be coupled to either the clamp bar or to the second jaw assembly to prevent the pulling element from being pulled up.

Figure 25B:
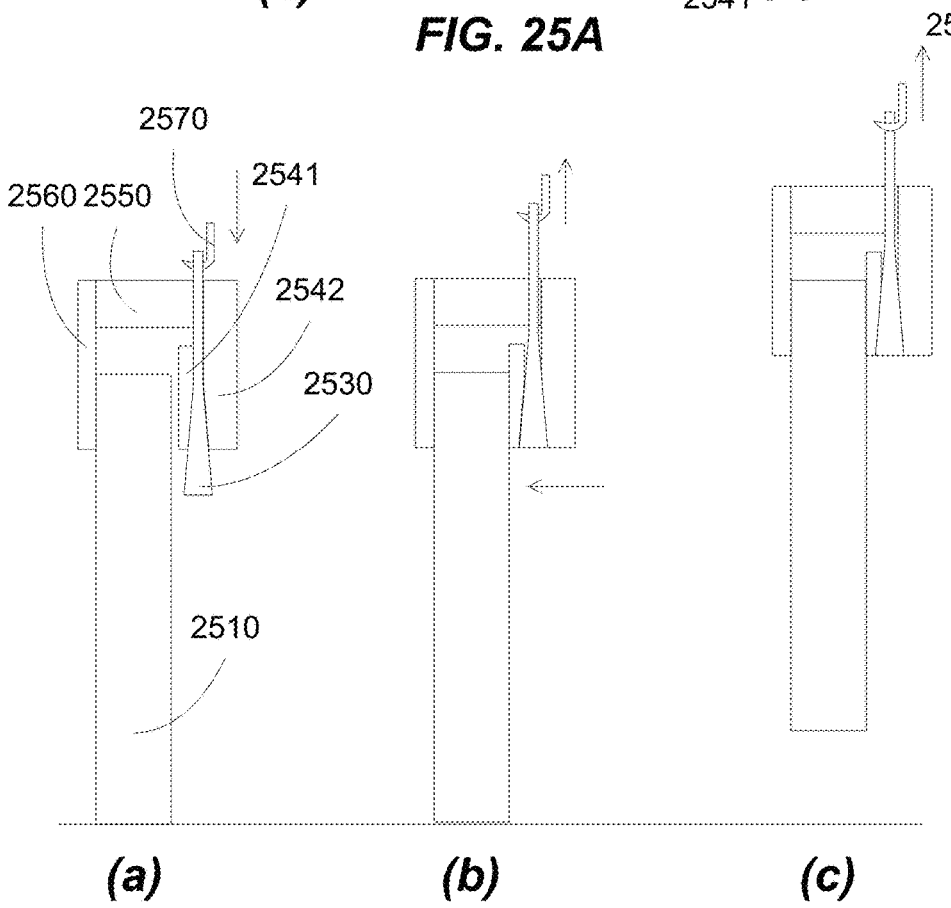

FIG. 25B (a)-(c) show an operation of the clamping device. In FIG. 25B (a), the pulling element 2530 can be in a down most position, and locked by the second locking mechanism. Due to the stretchable elements, the second jaw 2541 can be pulled toward the jaw support 2542.

The first locking mechanism can be disengaged, and the second jaw assembly can be moving along the clamp bar, to enlarge a distance between the first jaw 2560 and the second jaw 2541 for accommodating an object 2510. The object can be placed between the two jaws of the clamping device. The second jaw assembly then can be pushed back, e.g., moving toward the first jaw to narrow the gaps between the object and the jaws. When the total gaps between the object and the jaws are at a minimum, the second jaw assembly can be locked to the clamp bar, for example, by engaging the first locking mechanism.

In FIG. 25B (b), the pulling element can be pulled up, for example, by a hoist 2570 hooking to the pulling element. The pulling on the pulling element can push the second jaw toward the object for clamping the object. In FIG. 25B (c), further pulling on the pulling element can lift the object above the ground to move to a new location.

Figure 26A:
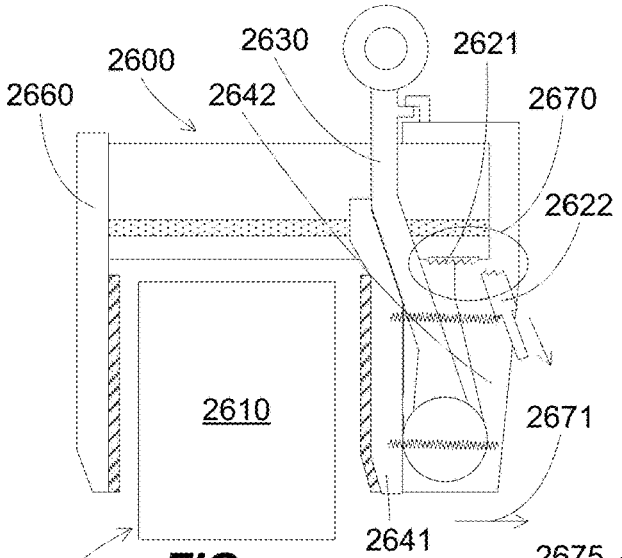
FIGS. 26A-26E illustrate detailed operations of a clamping device according to some embodiments.

FIGS. 26A-26E illustrate detailed operations of a clamping device according to some embodiments. In FIG. 26A, the locking mechanism can be unlocked 2670, for example, by pulling back the pattern component 2622 to disengage the pattern component from the cyclic pattern bar 2621. This will release the second jaw assembly from the clamp bar, and thus the second jaw assembly (the second jaw 2641, the jaw support 2642, together with the pulling element 2630) can slide 2671 along the clamp bar away from the first jaw 2660 so that the distance between the first jaw and the second jaw can be large enough to accommodate the object 2610. The object is then can be placed 2672 between the two jaws of the clamping device 2600.

Figure 26B:
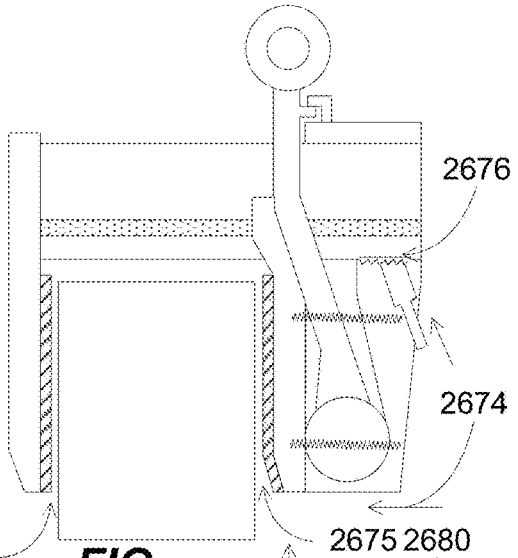

In FIG. 26B, the second jaw assembly is then moved 2674 toward the object, so that the total gaps 2675 between the object and the two jaws are minimum. For example, the second jaw assembly can move 2674 so that the object is in contact with the two jaws. Then the second jaw assembly can be slowly pulled back in an opposite direction to a position that the pattern component can engage 2676 with the cyclic pattern bar. The pattern component then can be pushed up to engage with the cyclic pattern bar, locking the second jaw assembly to the clamp bar.

Figure 26C:
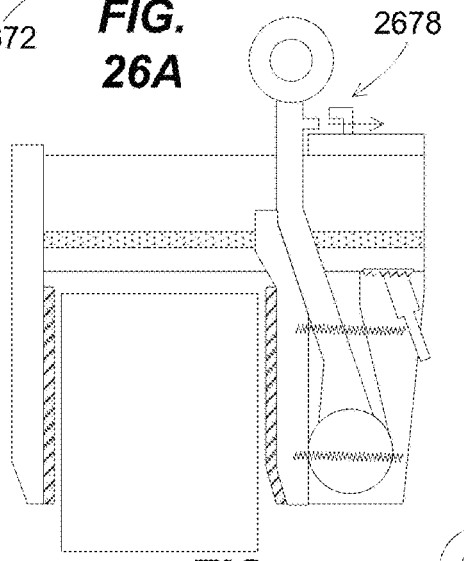

In FIG. 26C, the second locking mechanism can be unlocked 2678, to free the pulling element, so the pulling element can be pulled up. For example, a latch can be released from its hold on the pulling element.

Figure 26D:
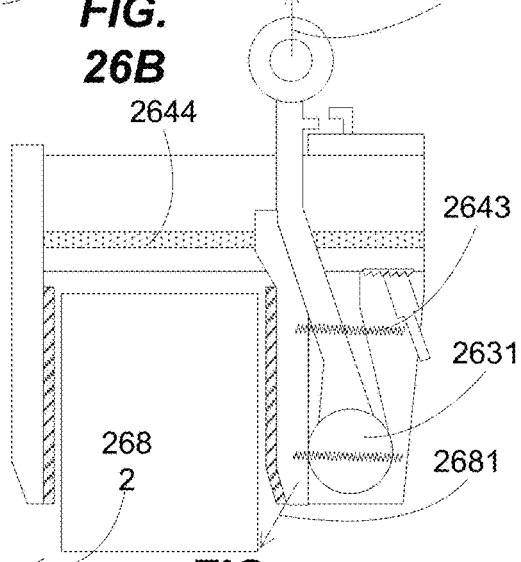
Figure 26E:
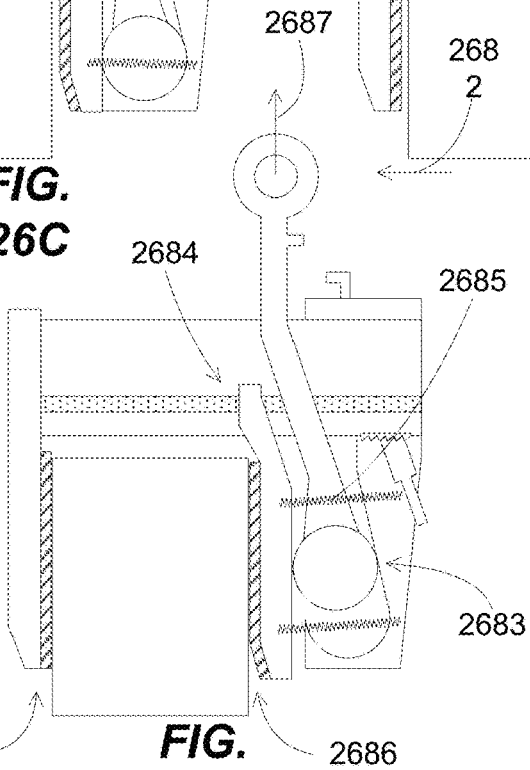

In FIGS. 26D and 26E, the pulling element can pull up 2680. The pulling action can be easily accomplished due to the rollers 2631 facing the second jaw and the jaw support. Due to the rollers, the pulling element can easily roll 2683 on the surfaces of the second jaw and the jaw support. The second jaw can move away 2681 from the jaw support, due to the movement of the pulling element. The springs 2643 can be bend and flex, to accommodate the movement of the second jaw. The support bar 2644 can prevent 2684 the second jaw from going down too far.

Since the second jaw is freely coupled to the jaw support, it can move, especially in response to the pulling motion of the pulling element. The movement 2681 of the second jaw can include two components. A downward component due to gravity. And a sideway component away from the jaw support, due to the movement of the pulling element. The motion limiter (support bar 2644) can limit the downward movement of the second jaw. Thus the second jaw can move down until stopped by the support bar. The springs 2643 can assist in limiting the movements of the second jaw, such as stretching and flexing downward.

The sideway component can be restrained by the object, meaning the second jaw can move away from the jaw support until the second jaw contacts the object. The second jaw can then push 2682 the object toward the first jaw until the object contacts 2685 the first jaw and the second jaw. Thus there is no gap 2686 between the object and the two jaws.

Further pulling movement 2687 on the pulling element can lift the object.

Figure 27A:
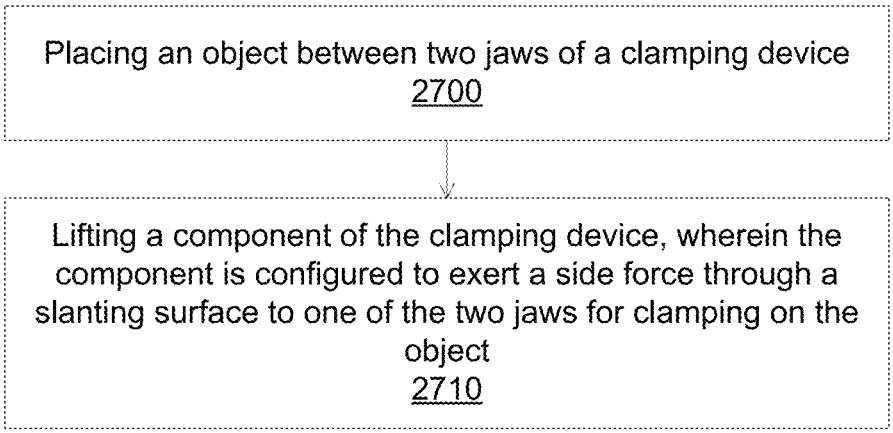
FIGS. 27A-27B illustrate flow charts for operating a clamping device according to some embodiments.
Figure 27B:
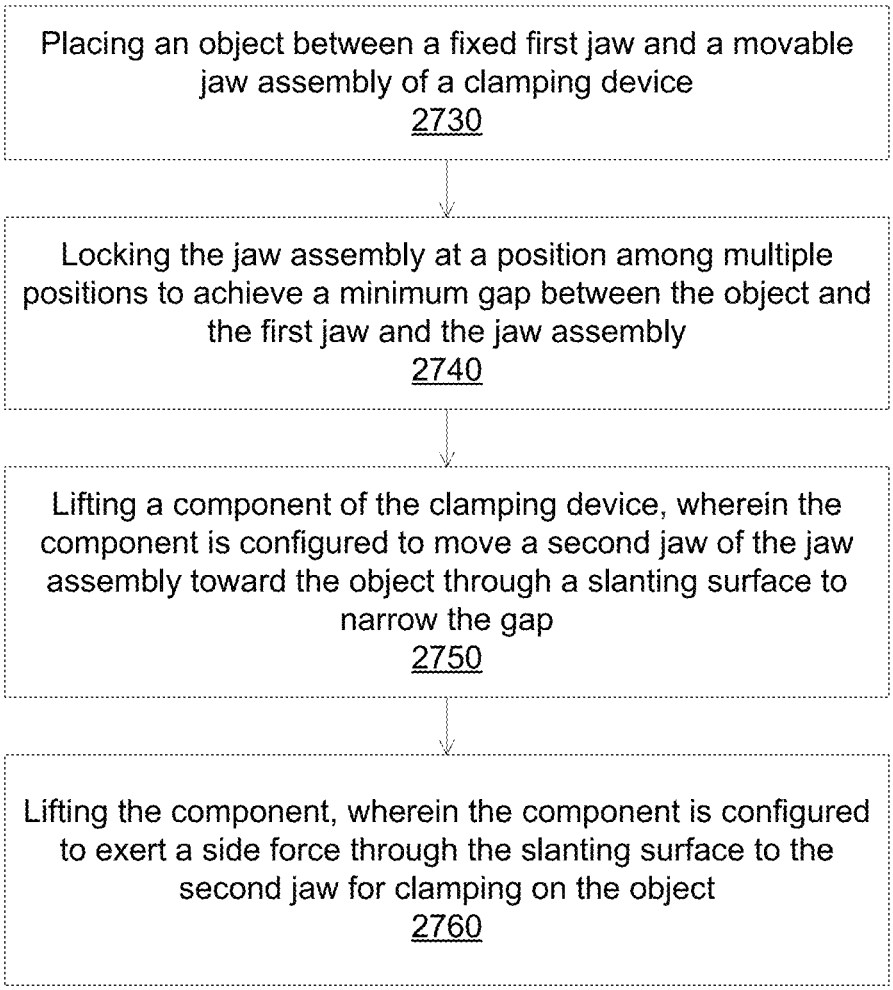

FIGS. 27A-27B illustrate flow charts for operating a clamping device according to some embodiments. In FIG. 27A, operation 2700 places an object between two jaws of a clamping device. Operation 2710 lifts a component of the clamping device, wherein the component is configured to exert a side force through a slanting surface to one of the two jaws for clamping on the object.

In FIG. 27B, operation 2730 places an object between a fixed first jaw and a movable jaw assembly of a clamping device.

Operation 2740 locks the jaw assembly at a position among multiple positions to achieve a minimum gap between the object and the first jaw and the jaw assembly.

Operation 2750 lifts a component of the clamping device, wherein the component is configured to move a second jaw of the jaw assembly toward the object through a slanting surface to narrow the gap.

Operation 2760 lifts the component, wherein the component is configured to exert a side force through the slanting surface to the second jaw for clamping on the object.

In some embodiments, other configurations for a clamping device can be used, which can include a first jaw assembly and a second jaw assembly coupled to a clamp bar. For example, a pulling element can be disposed between the jaw and the jaw support of a jaw assembly that is fixedly coupled to the clamp bar, e.g., the jaw can be flexibly coupled to the jaw support while the jaw support is fixedly coupled to the clamp bar. The other jaw assembly can be movably coupled to the clamp bar. The other jaw assembly can include only a jaw, which is movably coupled to the clamp bar together with a locking mechanism to lock the jaw to the clamp bar. The other jaw assembly can include a jaw and a jaw support, with the jaw flexibly coupled to the jaw support and the jaw support movably coupled to the clamp bar together with a locking mechanism to lock the jaw support to the clamp bar.

In some embodiments, there can be two pulling elements, one for each jaw assembly.

In some embodiments, the present invention discloses methods, and clamping devices formed from the methods, for cost effective constructions of clamping devices with high strength, hardness, durability, and reliability. The clamping devices can include components having a metal core embedded in a body of different material, such as a softer and easier to form material. For example, the metal core can include a steel or stainless steel frame, which can be designed for sustain the high forces and high stresses of the clamping devices in handling heavy objects. The body can include a polymer or aluminum, which can be design for cosmetic, protection, and low forces or low stresses.

The metal core can be constructed of welded panels, after an analysis of the clamping device operations to determine the areas of high forces and stresses. The body can be cast, using the metal core disposed therein.

Figure 28A:
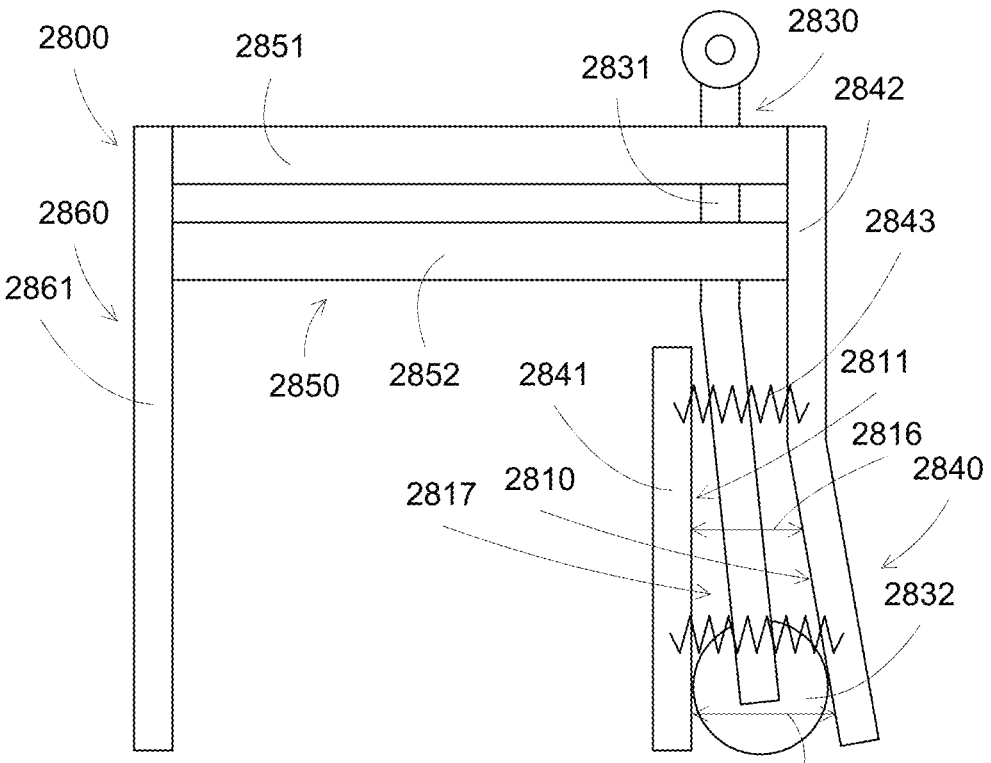
FIGS. 28A-28C illustrate a clamping device with metal cores according to some embodiments.
Figure 28B:
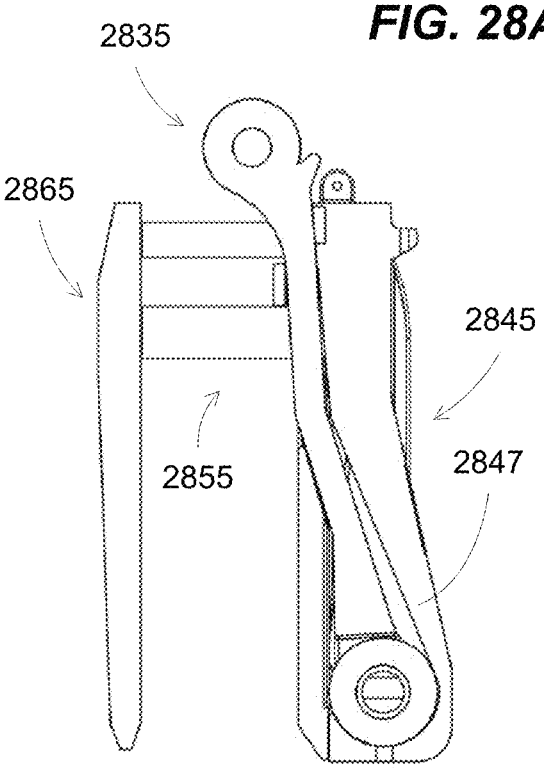
Figure 28C:
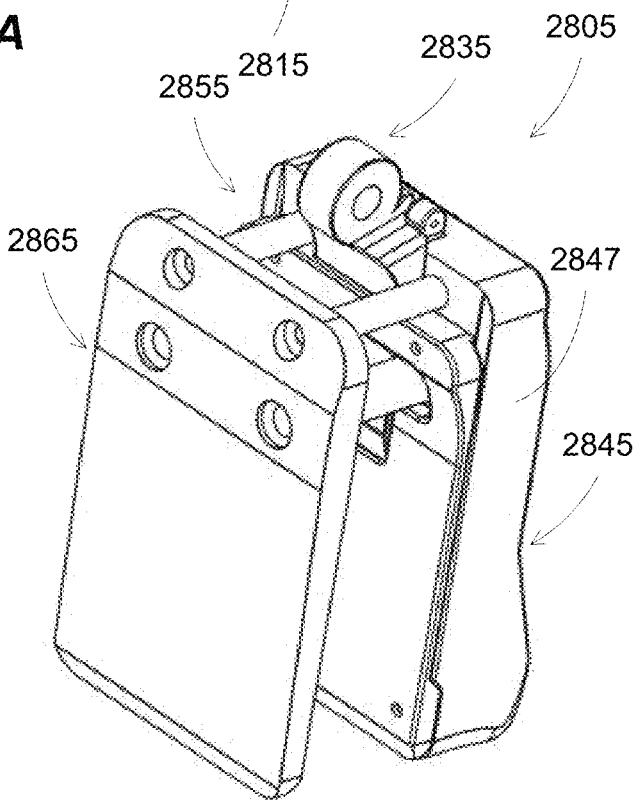

FIGS. 28A-28C illustrate a clamping device with metal cores according to some embodiments. In FIG. 28A, a clamping device frame 2800 can include two jaw assemblies 2860 and 2840 coupled to a clamp bar 2850. The clamp bar 2850 can include multiple connection bars 2851 and 2852. The jaw assembly 2860 can include a jaw 2861, which can be fixedly coupled to the clamp bar. The jaw assembly 2840 can include a jaw 2841 and a jaw support 2842. The jaw support can be fixedly coupled to the clamp bar. The jaw 2841 can be flexibly coupled to the jaw support, for example, through a set of springs 2843.

A pulling element 830 can include rollers 2832 coupled to a handle 2831. The rollers can be disposed between the jaw 2841 and the jaw support 2842. Some rollers of the rollers 2832 can be configured to roll on a surface 2810 of the jaw support 2842. Some rollers of the rollers 2832 can be configured to roll on a surface 2811 of the jaw 2841. Due to the low rolling friction of the rollers 2832 (as compared to the sliding friction between two flat surfaces), the pulling element 2830 can easily move up and down, e.g., toward the clamp bar 2850 and away from the clamp bar 2850. The pulling element can also be constrained by the clamp bar, in addition to the jaw and the jaw support, thus the pulling element can typically move in the up/down directions, e.g., with some small variation movements along the up/down directions.

The jaw support 2842 can include a slanting surface 2810. The slanting surface 2810 can be configured to translate a lifting force acting on the pulling element 2830 to a pushing force on the jaw 2841, with the pushing force in a direction toward the other jaw 2861. Thus the lifting action of the pulling element can assist in clamping an object disposed between the jaws 2841 and 2861.

The slanting surface can be configured so that a dimension 2815 between the jaw 2841 and the jaw support 2842 at a location farther from the clamp bar 2850 is larger than a dimension 2816 between the jaw 2841 and the jaw support 2842 at a location nearer the clamp bar 2850. In that configuration, when the rollers 2832 move up, e.g., moving toward the clamp bar 2850, since the distance 2816 between the jaw and the jaw support is smaller (e.g., as compared to the distance 2815 at the original location of the rollers), the jaw 2841 can be pushed away from the jaw support 2842. If there is no obstacle, e.g., no clamped object, the jaw 2841 can move in a direction toward the opposite jaw 2861. If there is an object clamped between the jaws 2841 and 2861, the pulling action of the pulling element, e.g., the moving up action of the rollers, can be translated to a pushing force for clamping the object.

The jaw 2841 and the jaw support 2842 can form a hollow portion 2817, e.g., a space between the jaw and the jaw support. The hollow portion can be configured so that when the pulling element moves up, for example, by rolling the rollers against the surfaces of the jaw and the jaw support, the jaw and the jaw support can experience forces pushing them apart. The rollers can push on the jaw to move the jaw away from the jaw support. Or a force can be generated on the jaw or applied to the jaw to separate the jaw from the jaw support.

FIGS. 28B and 28C show a cross section view and a perspective view of a clamping device 2805, which corresponded to the clamping device frame 2800. For example, the clamping device frame 2800, e.g., the jaw assembly 2860, the jaw assembly 2840, the pulling element 2830, and the clamp bar 2850, can form metal cores of the corresponding components, e.g., the jaw assembly 2865, the jaw assembly 2845, the pulling element 2835, and the clamp bar 2855, of the clamping device 2805. For example, the jaw support 2842 can form the metal core for a jaw support 2847, which can further include a body. The metal core, e.g., the jaw support 2842, can provide structure support for the jaw support 2847, and the body can form protective cover, plus fixtures for attaching other components of the clamping device 2805, such as fixtures for attaching a locking mechanism for securing the pulling element to the clamp bar, or fixtures to attach the springs, for fixtures to attach the clamp bar.

Figure 29A:
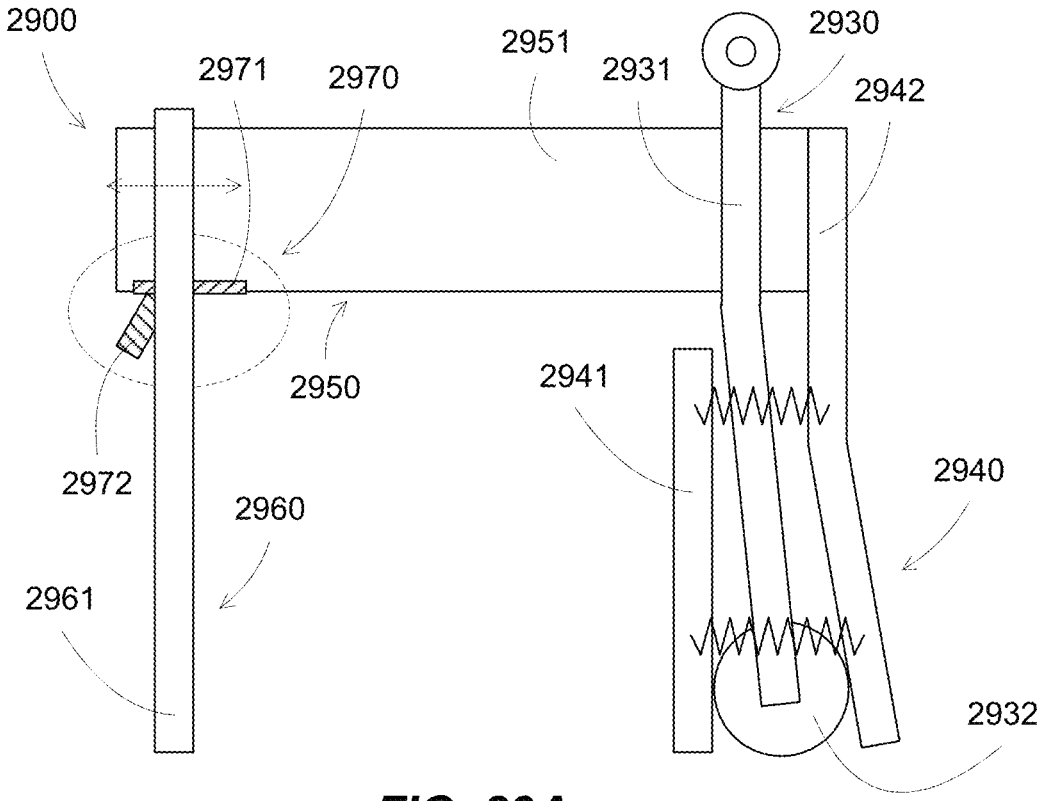
FIGS. 29A and 29B illustrate configurations for clamping device frames according to some embodiments.
Figure 29B:
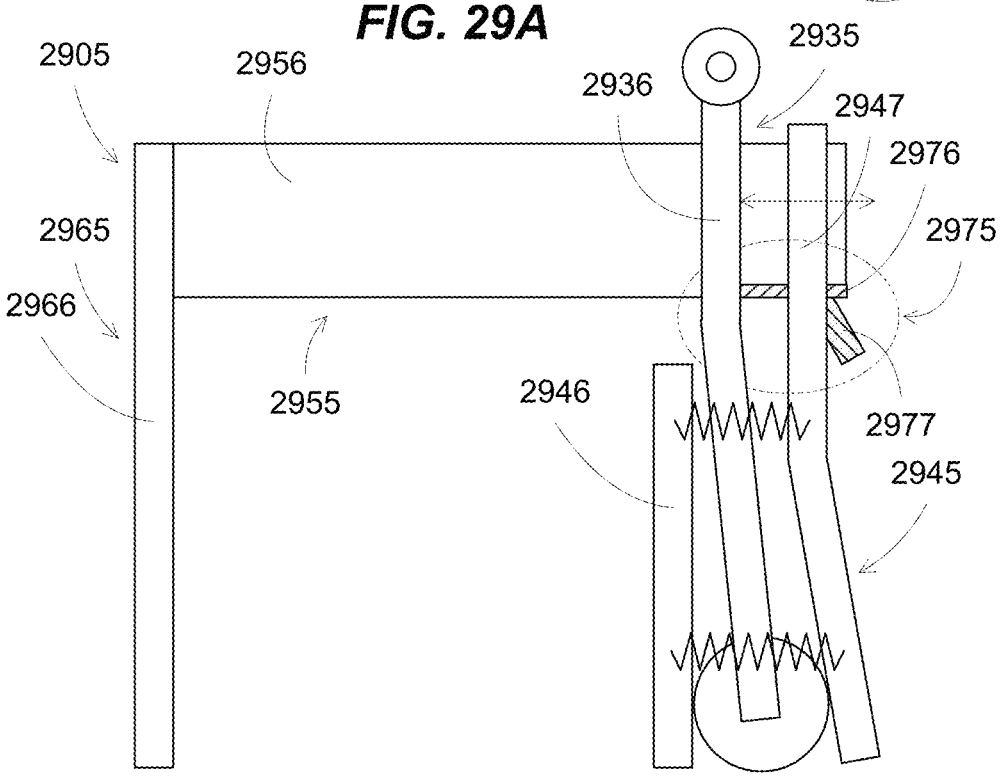

FIGS. 29A and 29B illustrate configurations for clamping device frames according to some embodiments. In FIG. 29A, a clamping device frame 2900 can include two jaw assemblies 2960 and 2940 coupled to a clamp bar 2950. The clamp bar 2950 can include one connection bar 2951. The jaw assembly 2960 can include a jaw 2961, which can be movably coupled to the clamp bar. The jaw assembly 2940 can include a jaw 2941 and a jaw support 2942. The jaw support can be fixedly coupled to the clamp bar. The jaw 2941 can be flexibly coupled to the jaw support, for example, through a set of springs. A pulling element 2930 can include rollers 1032 coupled to a handle 2931. The rollers can be disposed between the jaw 2941 and the jaw support 2942.

A locking mechanism 2970 can be included to secure the movable jaw assembly 2960 to the clamp bar 2950. For example, the locking mechanism 2960 can include a rack bar 2971 coupled to the clamp bar. A mating component 2972 can be mated at discrete locations with the rack bar. The mating component 2972 can be coupled to the jaw 2961, and thus can secure the jaw 2961 with the clamp bar when the mating component is engaged with the rack bar.

In FIG. 29B, a clamping device frame 2905 can include two jaw assemblies 2965 and 2945 coupled to a clamp bar 2955. The clamp bar 2955 can include one connection bar 2955. The jaw assembly 2965 can include a jaw 2966, which can be fixedly coupled to the clamp bar. The jaw assembly 2945 can include a jaw 2946 and a jaw support 2947. The jaw support can be movably coupled to the clamp bar. The jaw 2946 can be flexibly coupled to the jaw support, for example, through a set of springs. A pulling element 2935 can include rollers 2937 coupled to a handle 2936. The rollers can be disposed between the jaw 2946 and the jaw support 2947.

A locking mechanism 2975 can be included to secure the movable jaw assembly 2940 to the clamp bar 2955. For example, the locking mechanism 2965 can include a rack bar 2976 coupled to the clamp bar. A mating component 2977 can be mated at discrete locations with the rack bar. The mating component 2977 can be coupled to the jaw support 2947, and thus can secure the jaw support 2947 with the clamp bar when the mating component is engaged with the rack bar.

In some embodiments, the present invention discloses methods to form clamping devices and components of the clamping devices, including forming metal cores embedded in body of different materials. The metal core can be configured to sustain the high forces and high stresses acting on the clamping devices, leaving the body to handle the low forces and low stresses. The metal core can include reinforced components to handle the high forces and stresses. Also, the metal core can include other features and fixtures, such as having through holes or tap holes. The body can include protruded portions, such as fixtures for attaching a locking mechanism, or end portion for stopping the pulling element. The body can include though holes, for example, through holes corresponded to through holes of the metal core. The body can include exposed portions of the metal core.

Figure 30A:
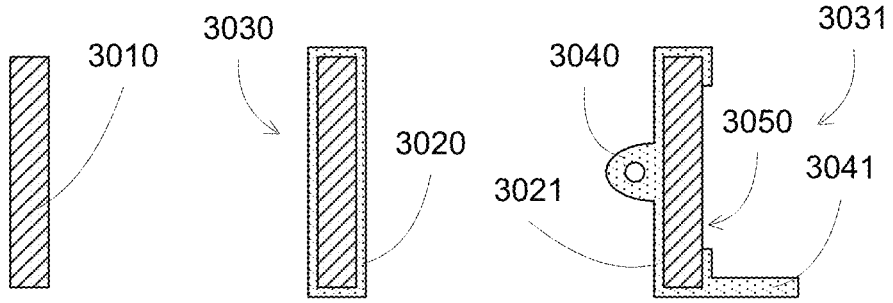
FIGS. 30A-30E illustrate configurations for metal cores and bodies of a component of a clamping device according to some embodiments.

FIGS. 30A-30E illustrate configurations for metal cores and bodies of a component of a clamping device according to some embodiments. In FIG. 30A, the body can include protrusions from the metal core and can also expose a portion of the metal core, e.g., the body not covering some parts of the metal core. A component 3030 can include a metal core 3010 totally embedded in a body 3020.

A component 3031 can include a body 3021 partially cover the metal core, e.g., leaving a portion 3050 of the metal core exposed, e.g., not covered by the body 3021. The exposed portion 3050 can allow other components to directly contact the metal core, instead of contacting the body 3021. With this configuration, high forces can be applied directly to the metal core, instead of to the softer material of the body 3021.

The body 3021 can have protruded portions 3040 and 3041. For example, the protrusion 3040 can include fixtures for coupling with other component, such as a ring for connecting to a latch, e.g., a locking mechanism. The protrusion 3041 can include an extended portion, which can be used for support other components with low forces and stresses.

Figure 30B:
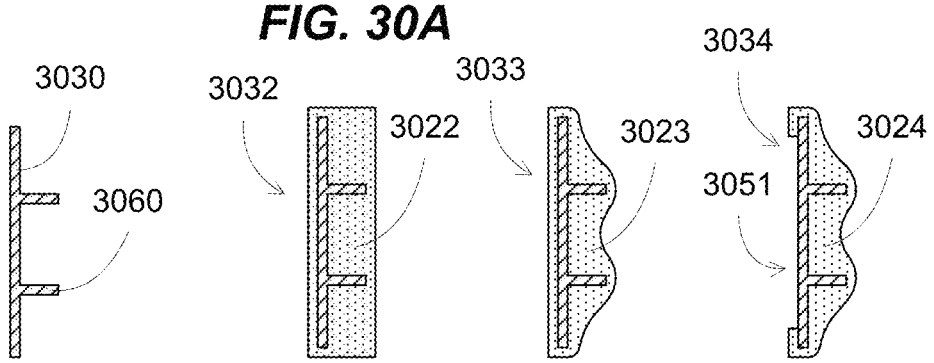

In FIG. 30B, the metal core 3011 can have reinforced elements 3060, for example, to ensure a flatness of the metal core under high forces. A component 3032 can include a body 3022 covering all portion of the metal core, including the reinforced element. A component 3033 can include a body 3023 having a different body coverage. A component 3034 can include a body 3024 exposing a portion 3051 of the metal core, for example, so that a high force can contact the metal core directly.

Figure 30C:
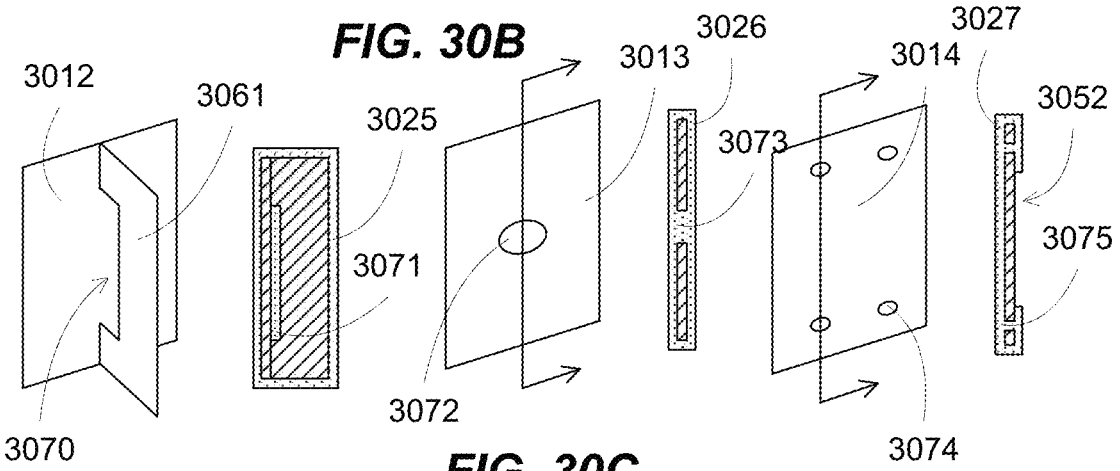

In FIG. 30C, the metal core 3012 can have a reinforced element 3061 that can leave a gap 3070 with the main portion. A body 3025 can cover the metal core, and also filling the gap with the body material 3071. The gap can secure the body with the metal core, e.g., providing a physical glue to keep the body adhering to the metal core.

The secured gap can include a hole 3072 in a metal core 3013, which after filled with the body material 3073, can secure together two side portions of the body 3026.

The secured gap can include multiple holes 3074 in a metal core 3014, which after filled with the body material 3075, can secure together two side portions of the body 3027, especially at areas 3052 that expose the metal core.

Figure 30D:
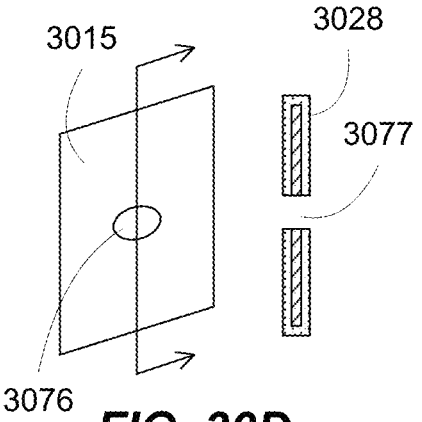

In FIG. 30D, the metal core 3015 can have a through hole 3076. A body 3028 can cover the metal core, but leaving another through hole 3077 connecting with the through hole 3076, for example, to provide a through hole for the component.

Figure 30E:
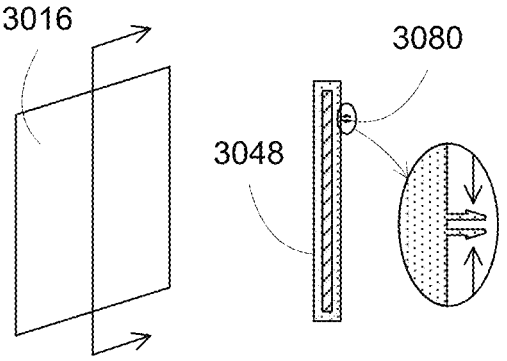

In FIG. 30E, the body 3048 can cover a metal core 3016, and can have a protrusion 3080 (or a recess, not shown). The protrusion is formed of the body material, and thus can be softer and flexible. The protrusion can include a fixture to couple to other components, such as by snap fitting. For example, the protrusion can include two flexible prongs with a latch end. Thus a mated fixture can be pressed on the protrusion 3080, which can press the two prongs together to pass through the latch ends. After passing the latch ends, the two prongs can return to their original positions, securing the mated fixture with the body 3048.

Figure 31:
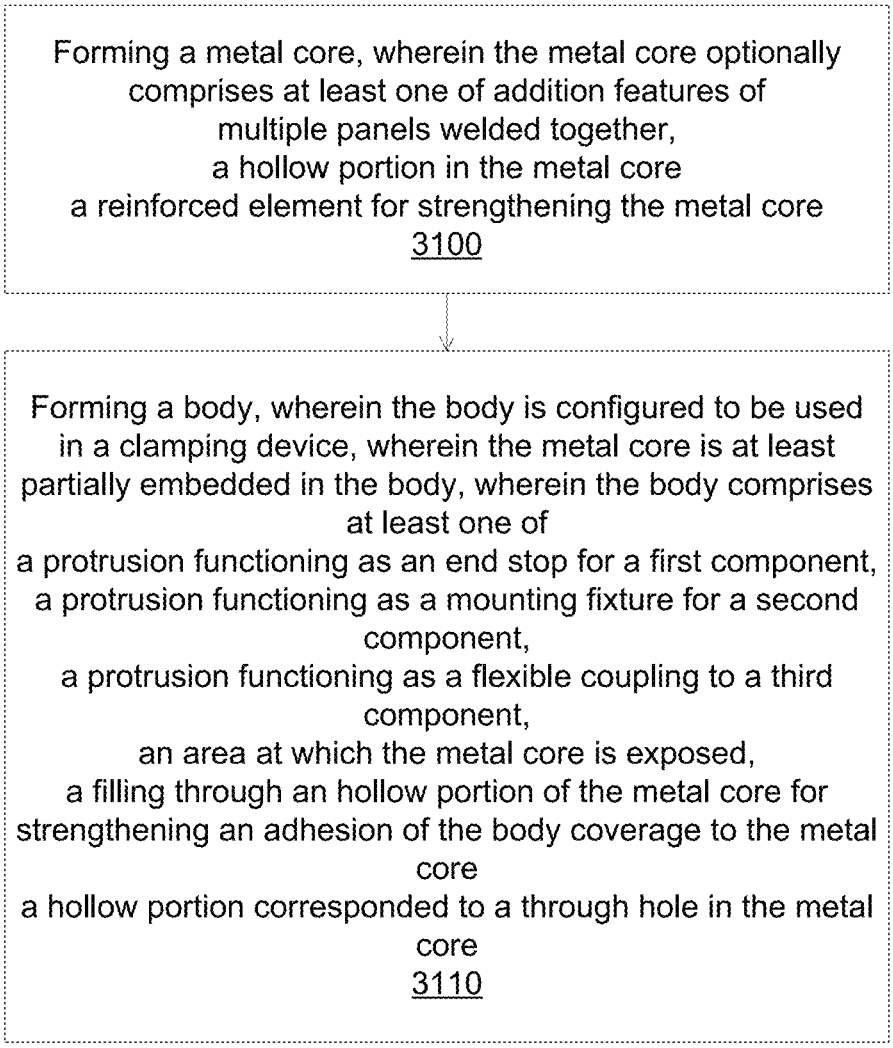
FIG. 31 illustrates a flow chart for forming a clamping device according to some embodiments.

FIG. 31 illustrates a flow chart for forming a clamping device according to some embodiments. A component of the clamping device can include a metal core embedded in a body. Operation 3100 forms the metal core. The metal core can include a structural element of the component of the clamping device. In addition, the metal core can optionally include multiple panels welded together, for example, to have uniform strength and hardness due to the stocked panels.

The metal core can include a hollow portion. The hollow portion can accept another component passing there through. For example, the hollow portion can include multiple through holes, which can be used to secure the metal core to another component of the clamping device. The hollow portion can be used to improve the adhesion of the body around the metal core. For example, the body can form two coating layers at two sides of the metal core, and the hollow portion can provide a connection between the two coating layers, which can secure the two coating layers together.

The metal core can include a reinforced element, which can be used for strengthening the metal core. For example, the metal core can include a flat panel at which a high force can be applied. The reinforced element can include an additional panel coupled to the flat panel, which can provide additional strength and hardness to the panel.

Operation 3110 forms the body completely or partially surrounding the metal core. The body can form the outer shape of the component, which can provide cosmetic and protective coverage for the clamping device. For example, the body can form a housing for other components, thus can protect the other components from being exposed to the environment.

The body can include a protrusion functioning as an end stop for another component of the clamping device. The end stop can have low stresses, since it is used to stop a movement of the components. The body can include a protrusion functioning as a mounting fixture for a second component. A locking mechanism can be mounted to the body, using the protrusion as a mounting fixture. The body can include a protrusion functioning as a flexible coupling to a component of the clamping device. For example, a cover can be pressed fit with the flexible coupling, shielding an opening of the body.

The body can include an area at which the metal core is exposed, meaning the body can partially cover the metal core. The exposed area of the metal core can be used for sustaining high forces, e.g., high forces applied to the body can be directly applied to the metal core.

The body can include a filling through a hollow portion of the metal core for strengthening an adhesion of the body coverage to the metal core. The body can include a hollow portion corresponded to a through hole in the metal core.

In some embodiments, the body can be cast, for example, by a low pressure casting process, a high pressure casting process, an atmospheric casting process, a lost wax casting process, or any other casting processes. In a casting process, a mold can be formed, then the metal core is placed within the mold. The body material can fill the mold. After the body material is hardened, the component can be removed, which includes the body surrounding the metal core.

Figure 32A:
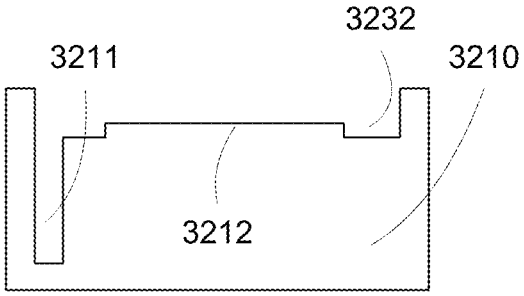
FIGS. 32A-32F illustrate a process for casting a component having a body surrounding a metal core according to some embodiments.

FIGS. 32A-32F illustrate a process for casting a component having a body surrounding a metal core according to some embodiments. In FIG. 32A, a first half 3210 of a mold is prepared, including a protruding portion 3211, an exposing portion 13212 for an embedded metal core, and a cover portion 3213 surrounding the metal core. Other portions can be included, such as flexible coupling portions, and through hole portions.

Figure 32B:
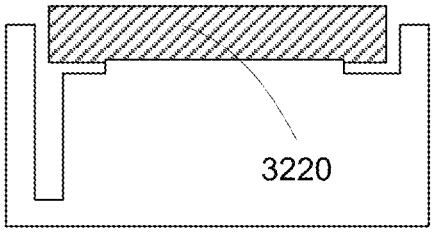

In FIG. 32B, a metal core 3220 is placed in the first half 3210 of the mold. As shown, since the component includes an exposed portion of the metal core, the metal core can contact the mold portion, with the contact portion not covered by the body material in the subsequent casting process. If there is no exposed area, a support element can be included to suspend the metal cover above the mold portion. Alternatively, the support element can include the material of the body, thus can fuse with the body during the casting process. The support element can include a removable material, thus can be removed during the casting process, such as being burned in a high temperature casting process.

Figure 32C:
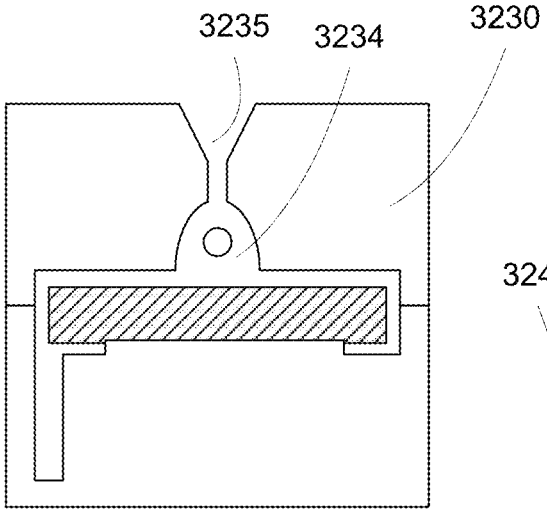

In FIG. 32C, a second half 3230 of the mold is mated with the first half 3210. The second half 3230 can include other elements, such as fixtures 3234 for mounting other components, and optional flues 3235 for pouring the body material.

Figure 32D:
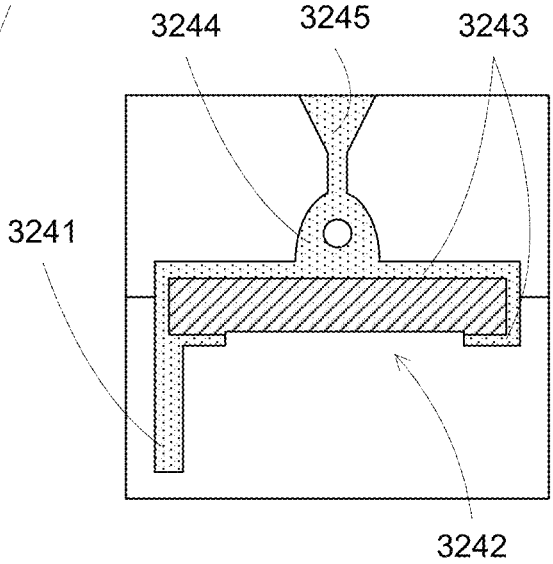

In FIG. 32D, a body material can fill the mold portions, e.g., the mold formed by the first half 3210 and the second half 3230. For example, a liquid or molten polymer (such a plastic) or soft metal (such as aluminum) material can pour in the mold, through the opening and flue portion 3235. Other casting process can be used, such as lost wax casting, high or low pressure casting, or sand casting. The material can form a body of the component, enclosing the metal core. The body can include a protruding portion 3241, corresponded to the protruding portion 3211 in the mold, an exposing portion 3242 exposing the metal core corresponded to the exposing portion 3212, a cover portion 3243 surrounding the metal core, fixtures 3244 corresponded to fixtures 3234, and optional flue portion 3245 corresponded to the flues 3235.

Figure 32E:
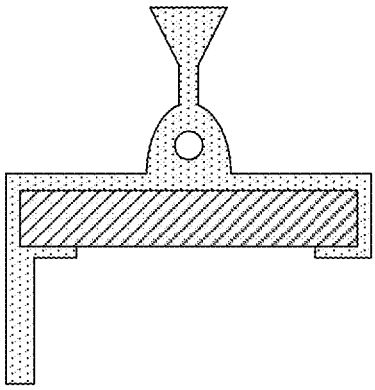
Figure 32F:
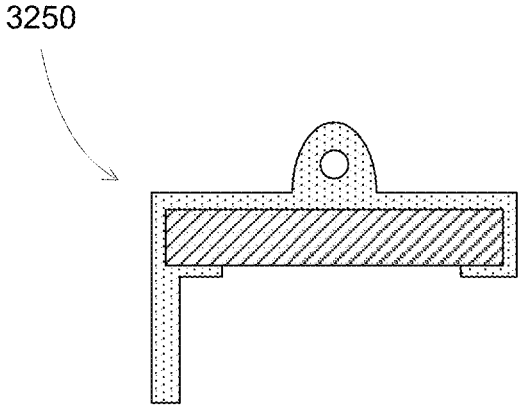

In FIG. 32E, the mold can be removed. In FIG. 32F, the flues can be removed to form the component 3250, including a body surrounding a metal core.

Figure 33:
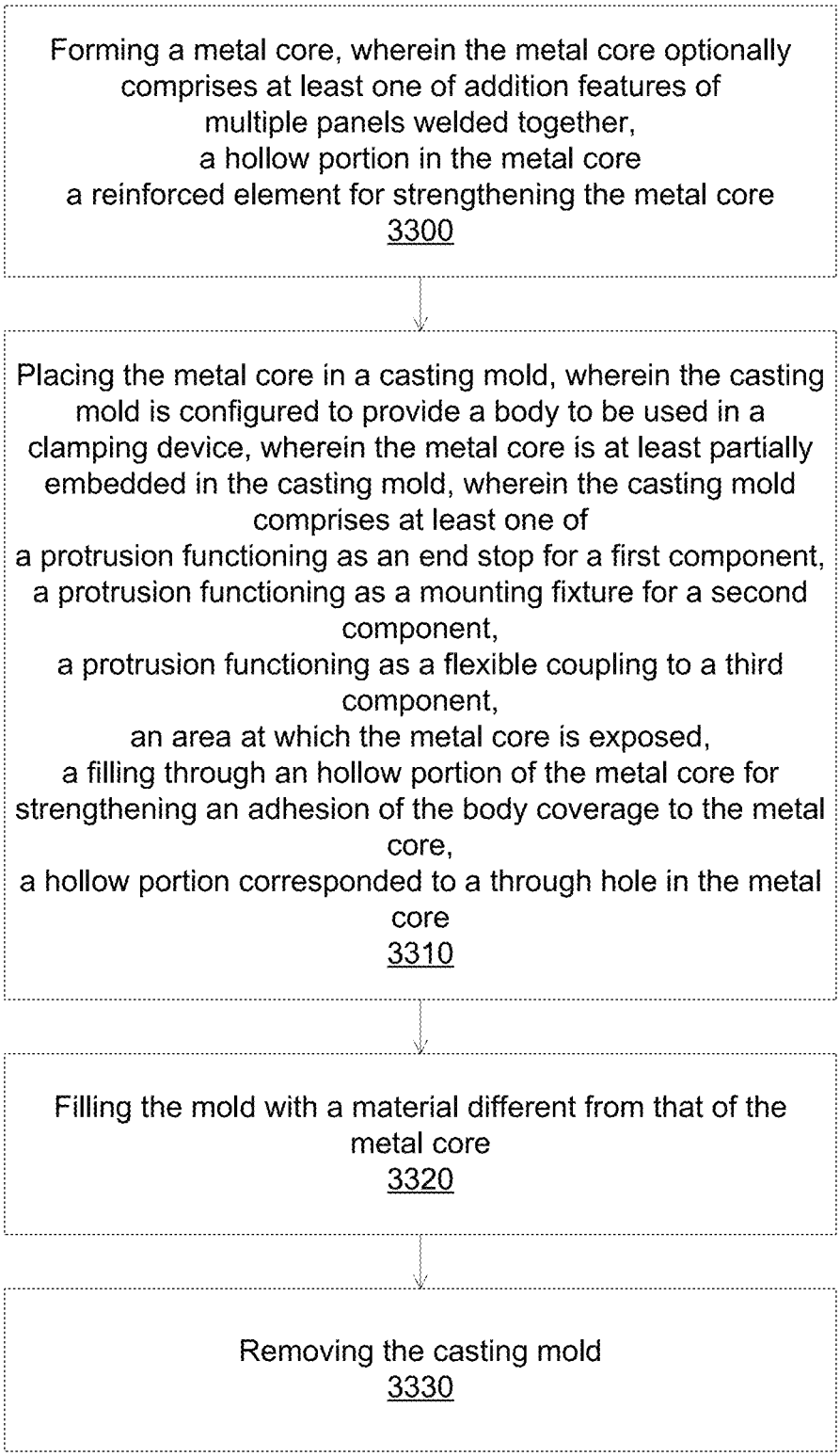
FIG. 33 illustrates a flow chart for forming a component of a clamping device according to some embodiments.

FIG. 33 illustrates a flow chart for forming a component of a clamping device according to some embodiments. Operation 3300 forms a metal core. The metal core can optionally include multiple panels welded together, a hollow portion in the metal core, or a reinforced element for strengthening the metal core.

Operation 3310 places the metal core in a casting mold, wherein the casting mold is configured to provide a body to be used in a clamping device, wherein the metal core is at least partially embedded in the casting mold, wherein the casting mold can include a protrusion functioning as an end stop for a first component, a protrusion functioning as a mounting fixture for a second component, a protrusion functioning as a flexible coupling to a third component, an area at which the metal core is exposed, a filling through an hollow portion of the metal core for strengthening an adhesion of the body coverage to the metal core, or a hollow portion corresponded to a through hole in the metal core.

Operation 3320 fills the mold with a material different from that of the metal core. Operation 3330 removes the casting mold.

In some embodiments, the present invention discloses a clamping device, and methods to form the clamping device, which includes components having a metal core embedded in a body of different material. Stress and strain analysis can be performed on a clamping device configuration to achieve frame structures for the clamping device. The frame structures can sustain high forces and high stresses, such as using added reinforced elements. The frame structures can serve as metal cores for the components of the clamping device. Body portions can then be added to cover the frame structures to form complete components. The body portions can also include fixtures for mounting peripherals, and additional reinforced elements to further strengthen the frame structures.

Figure 34A:
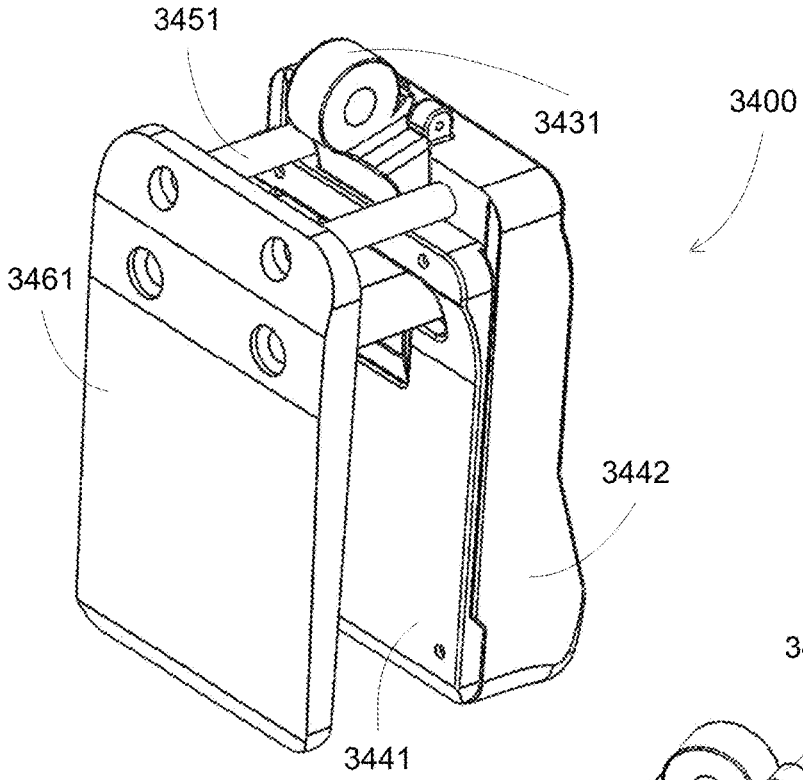
FIGS. 34A-34B illustrate a clamping device according to some embodiments.
Figure 34B:
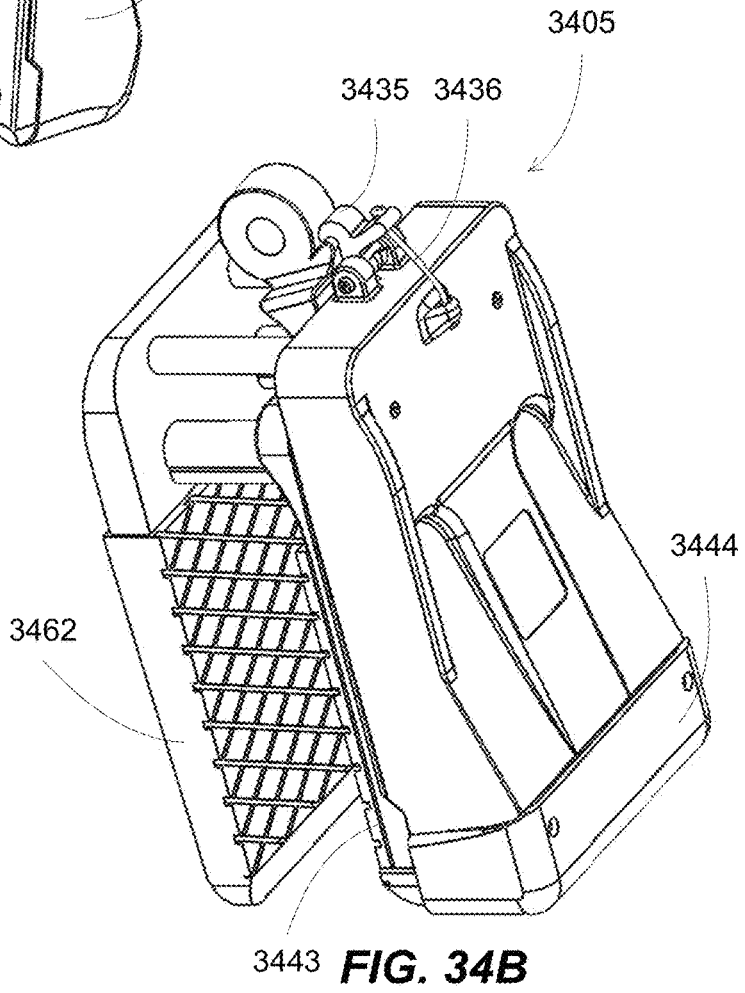

FIGS. 34A-34B illustrate a clamping device according to some embodiments. In FIG. 34A, a clamping device assembly 3400 can include major components assembled together, e.g., an assembly of components that might include a metal core embedded in a body portion.

The clamping device assembly 3400 can include a first jaw 3461 coupled to a clamp bar 3451. A second jaw 3441 can be coupled to a jaw support 3442, which also couples to the clamp bar. A pulling element 3431 can be disposed between the second jaw and the jaw support.

In some embodiments, there can be components having a metal core embedded in a body portion, and other components without the metal core or without the body portion. For example, the jaw support can be formed using a metal core embedded in a body portion. Other components, e.g., the first jaw, the second jaw, the clamp bar, and the pulling element, can include one piece construction, e.g., a body without a metal core, or a metal core without a body. Alternatively, some or all of the other components can be formed using a metal core embedded in a body portion.

In FIG. 34B, peripheral components can be installed in the clamping device assembly 3400 to form a complete clamping device 3405. For example, rubber pads 3462 and 3443 can be coupled to the first jaw 3461 and the second jaw 3441, respectively, for example, to increase a friction with an object clamped by the clamping device. A rubber support 3444 can be coupled to the jaw support 3442, for example, to protect the jaw support from collision. A locking mechanism 3435 can be assembled to the jaw support, for example, to secure the pulling element. A release mechanism 3436 can be assembled, which can release the locking mechanism 3435, so that the pulling element can be free to move.

In the following description, the construction of the jaw support is described, using a metal core embedded in a body portion. Similar construction processes can be used for other components. A jaw support can be coupled to a clamp bar, such as fixedly coupled, or removably/lockably coupled. The jaw support can be flexibly coupled to a jaw, to allow the jaw to move relative to the jaw support. The jaw support can be configured to house a pulling element, so that when the pulling element moves up, the jaw can be separated from the jaw support, for clamping on the object.

Figure 35A:
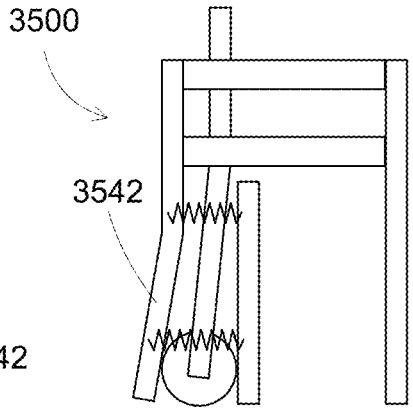
FIGS. 35A-35C illustrate a jaw support configuration according to some embodiments.
Figure 35B:
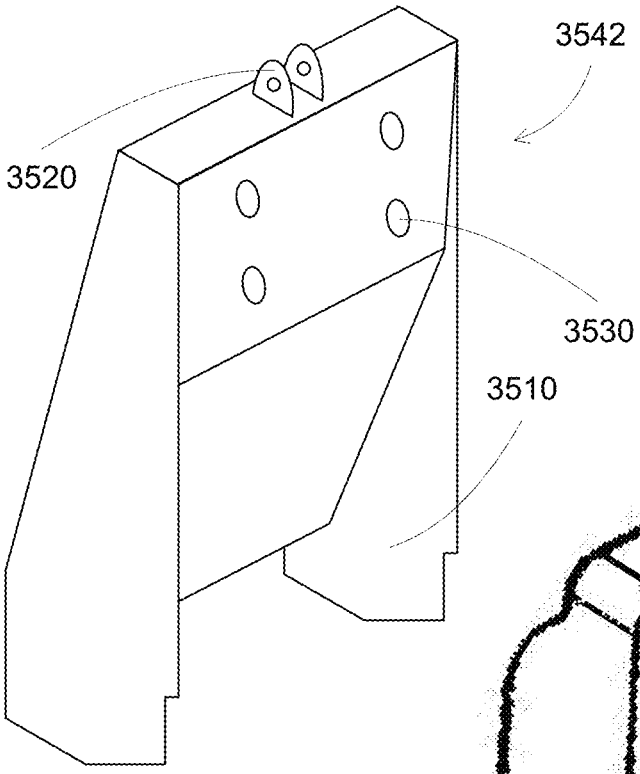
Figure 35C:
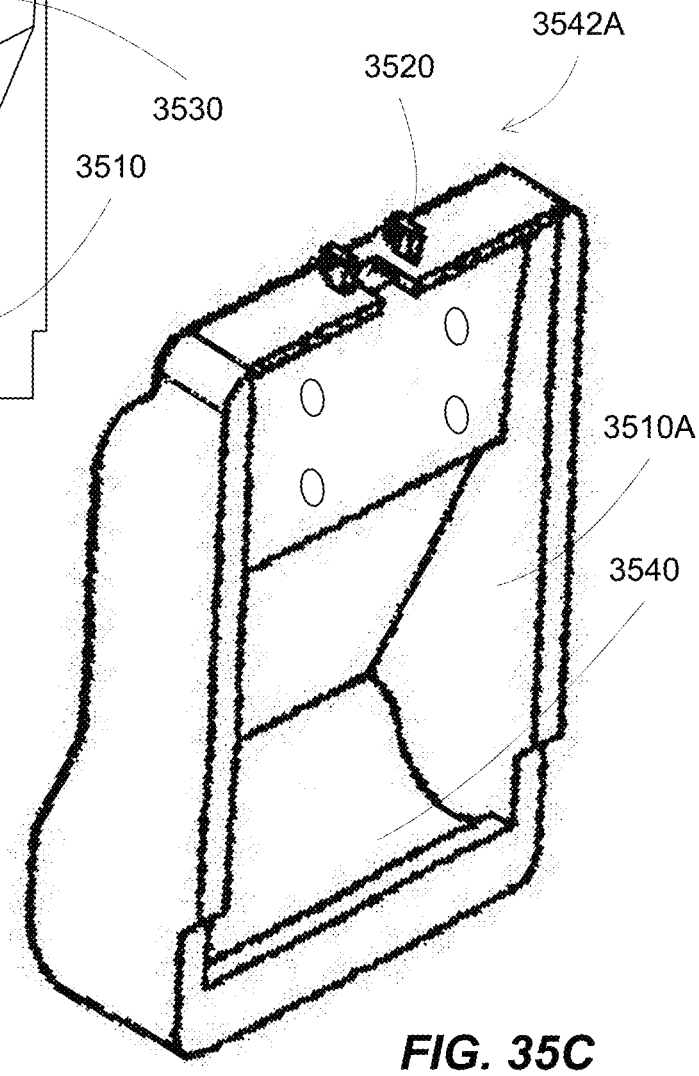

FIGS. 35A-35C illustrate a jaw support configuration according to some embodiments. In FIG. 35A, the position of a jaw support 3542 (a jaw support frame) relative to a clamping device 3500 is shown. In FIG. 35B, the jaw support frame 3542 is shown, which includes multiple panels 3510, such as steel panels or stainless steel panels, assembled together, such as welded together. The jaw support frame 3542 can be processed, such as forming holes 3530 for mounting to the clamp bar, or welding fixtures 3520 for mounting a locking mechanism for securing the pulling element.

In FIG. 35C, a complete jaw support 3542A is shown, which includes the frame 3542 as a metal core, together with a body portion covering the frame. For example, complete jaw support 3542A can include a protrusion portion 3540 for stopping the pulling element, and coverage on the panels 3510 to form body covered panels 3510A. There can be portions of the frame not covered by the body, such as the fixtures 3520.

In some embodiments, the body portion can cover low stress locations. The body portion can avoid high stress locations or can avoid areas that need to be exposed, such as for mounting other elements or components.

Figure 36A:
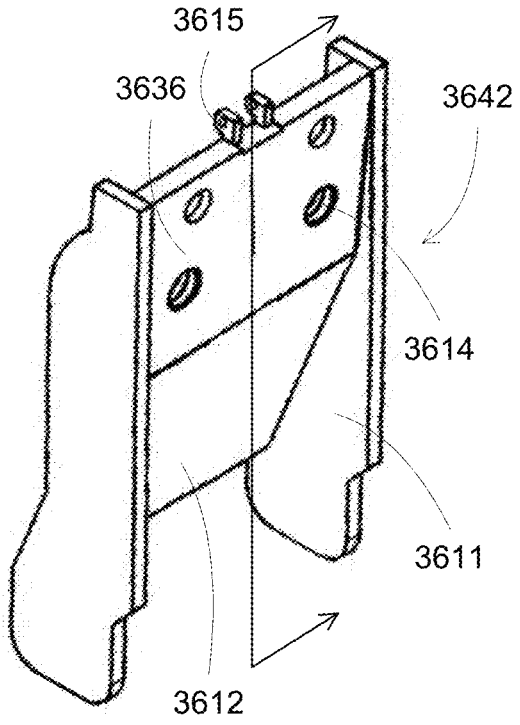
FIGS. 36A-36D (a)-(c) illustrate configurations of body covering a jaw support frame according to some embodiments.
Figure 36C:
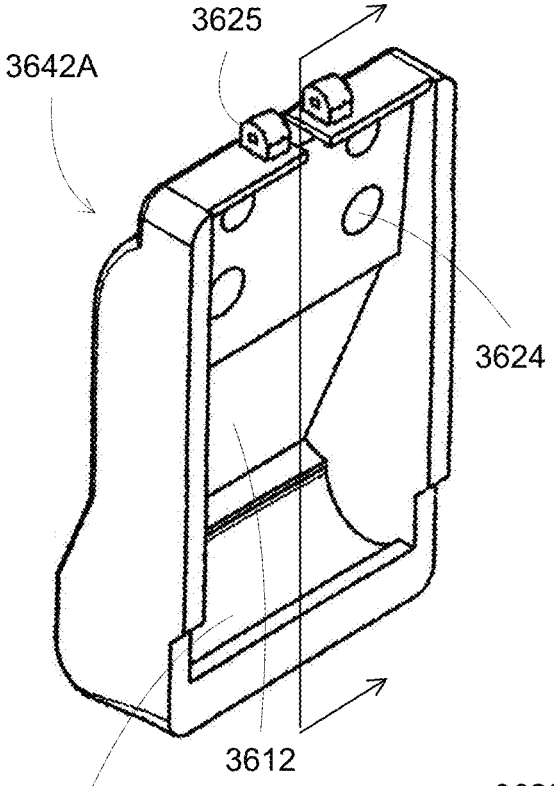
Figure 36B:
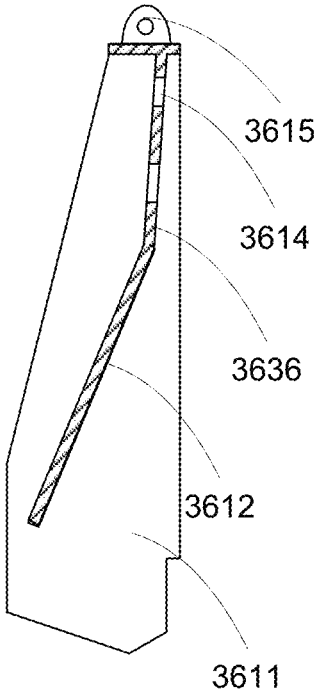

FIGS. 36A-36D (a)-(c) illustrate configurations of body covering a jaw support frame according to some embodiments. FIG. 36A shows a perspective view of a jaw support frame 3642 and FIG. 36B shows a cross section view of the jaw support frame 3642. The jaw support frame 3642 can include multiple panels welded together, including mounting panel 3617 for coupling with the clamp bar, slanting panel 3612 for converting a lifting force to a side force, and side panels 3611 for supporting the mounting and slanting panels. The jaw support frame 3642 can include holes 3614 for mounting to the clamp bar, and welding fixtures 3615 for mounting a locking mechanism for securing the pulling element.

Figure 36D:
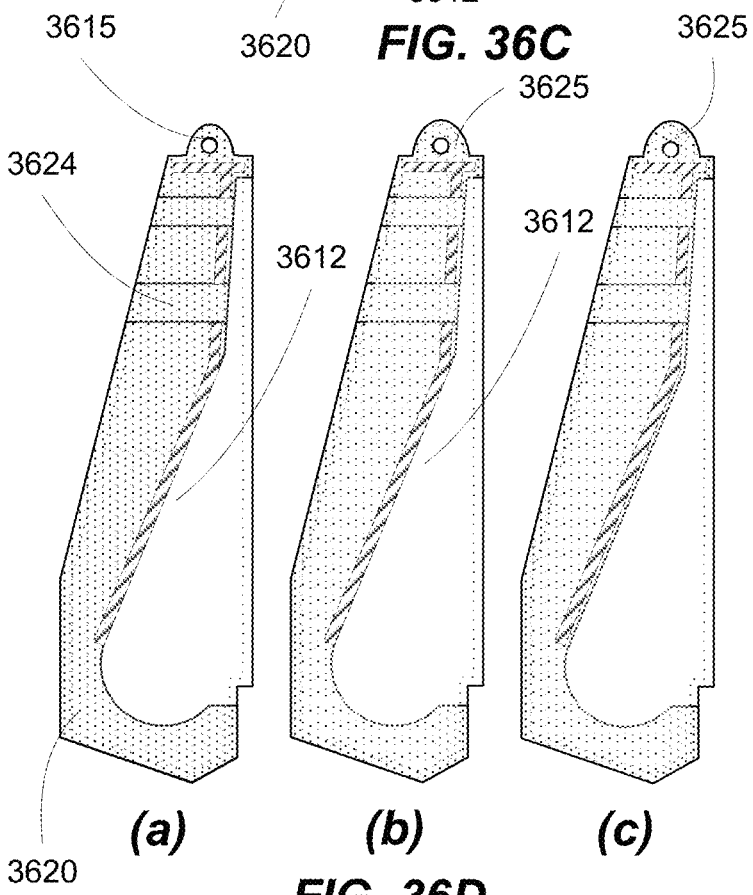

FIG. 36C shows a perspective view of a complete jaw support 3642A and FIG. 36D shows different cross section views of different configurations of the complete jaw support 3642A. The complete jaw support 3642A can include a protrusion portion 3620 for stopping the pulling element, mounting fixtures 3625, through holes 3624, and coverage on the panels.

FIG. 36D (a) shows a configuration of the complete jaw support in which the slanting panel 3612 is exposed, e.g., there is no body coverage. Further, the mounting fixtures 3615 can also be exposed, e.g., the mounting fixtures on the complete jaw support are the same as the mounting fixtures 3615 on the jaw support frame, without body coverage. The holes 3614 also do not have coverage, resulting in through holes 3624 passing through the body and the frame.

FIG. 36D(b) shows a configuration of the complete jaw support in which the slanting panel 3612 is exposed, e.g., there is no body coverage. The holes 3614 also do not have coverage, resulting in through holes 3624 passing through the body and the frame. Other locations are covered with the body material. FIG. 36D(c) shows a configuration of the complete jaw support in which all areas of the jaw support frame are covered with the body material, except the through holes 3624 passing through the body and the frame.

Figure 37A:
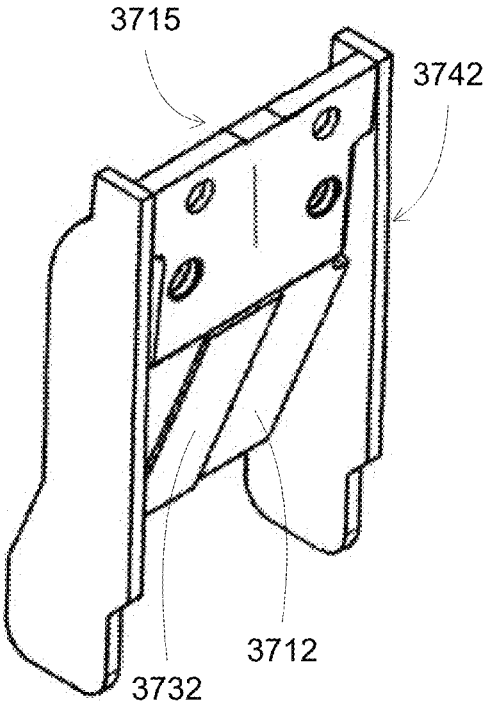
FIGS. 37A-37D (a)-(b) illustrate configurations of body covering a jaw support frame according to some embodiments.
Figure 37C:
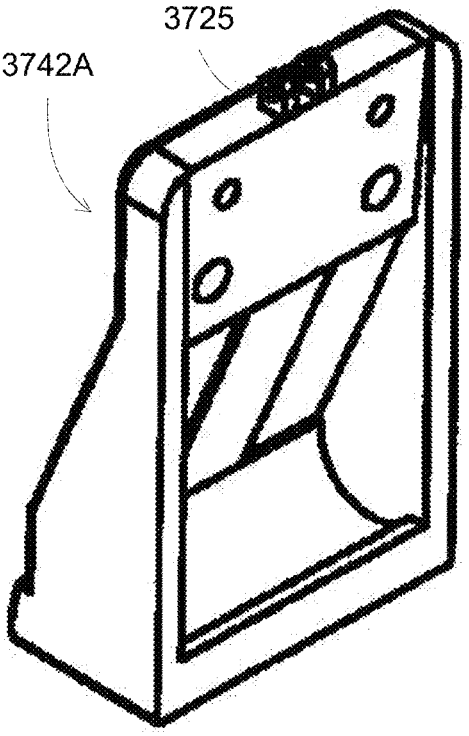
Figure 37B:
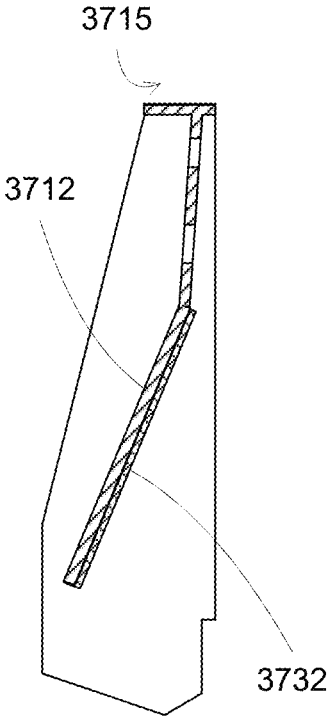

FIGS. 37A-37D (a)-(b) illustrate configurations of body covering a jaw support frame according to some embodiments. FIG. 37A shows a perspective view of a jaw support frame 3742 and FIG. 37B shows a cross section view of the jaw support frame 3742. A reinforced element such as panel 3732 can be added to a slanting panel 3712, for example, to increase the strength and hardness of the slanting surface, since a pulling element can exert high forces on the slanting panel. In addition, low forces or low stress components of the complete jaw support, such as the fixtures 3725 for mounting a locking mechanism, can be omitted from the frame structure. For example, there is an absence 3715 of a frame for fixtures 3725 for mounting a locking mechanism.

Figure 37D:
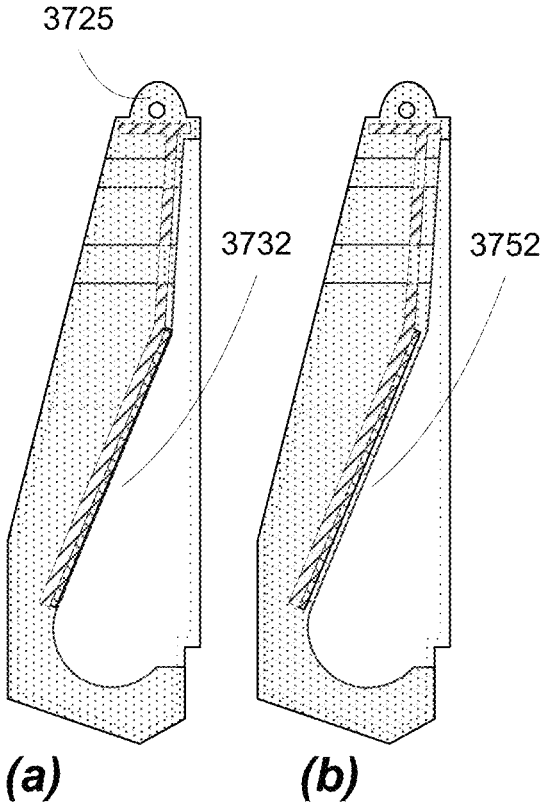

FIG. 37C shows a perspective view of a complete jaw support 3742A and FIG. 37D shows different cross section views of different configurations of the complete jaw support 3742A. In FIG. 37D(a), the reinforced panel 3732 is exposed, e.g., there is not body coverage to at least a portion of the reinforced panel. Alternatively, in FIG. 37D(b), the reinforced panel 3732 is covered with the body material 3752.

Figure 38A:
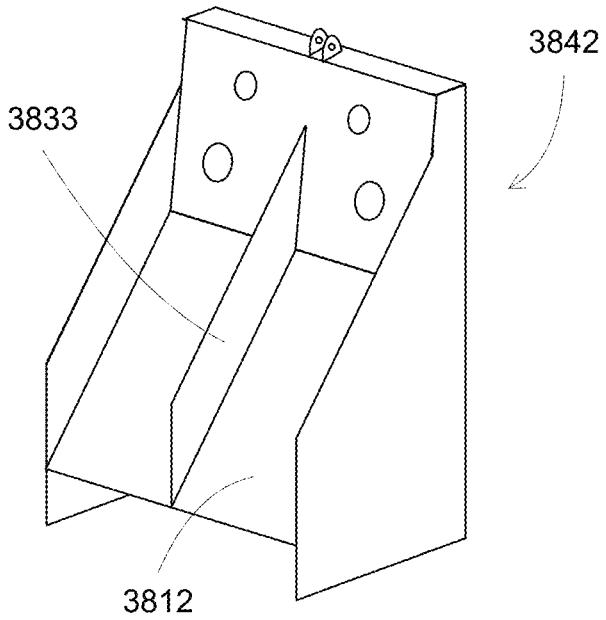
FIGS. 38A-38D illustrate configurations of body covering a jaw support frame according to some embodiments.
Figure 38B:
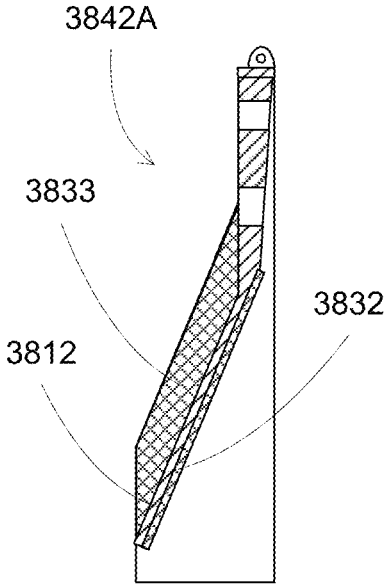

FIGS. 38A-38D illustrate configurations of body covering a jaw support frame according to some embodiments. FIG. 38A shows a perspective view of a jaw support frame 3842 and FIG. 38B shows a cross section view of the jaw support frame 3842. A reinforced element such as panel 3833 can be added to a backside of a slanting panel 3812, for example, to increase the strength and hardness of the slanting surface, since a pulling element can exert high forces on the slanting panel. In addition, a front reinforced panel 3832 can be added to a front side of the slanting panel, as discussed previously.

Figure 38C:
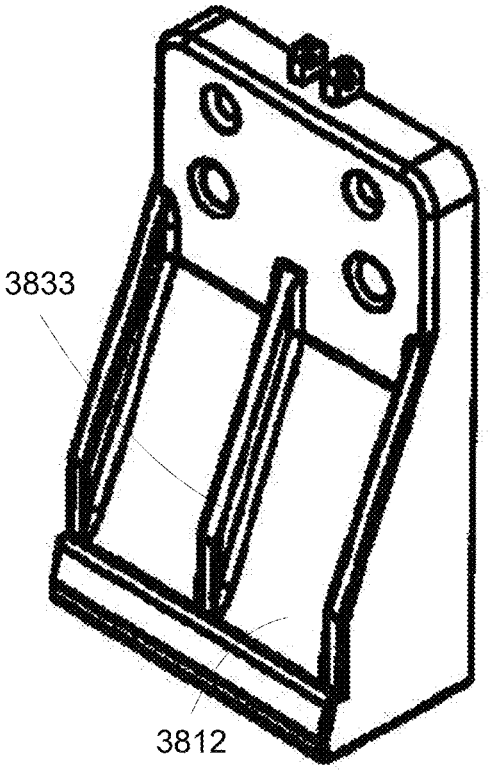
Figure 38D:
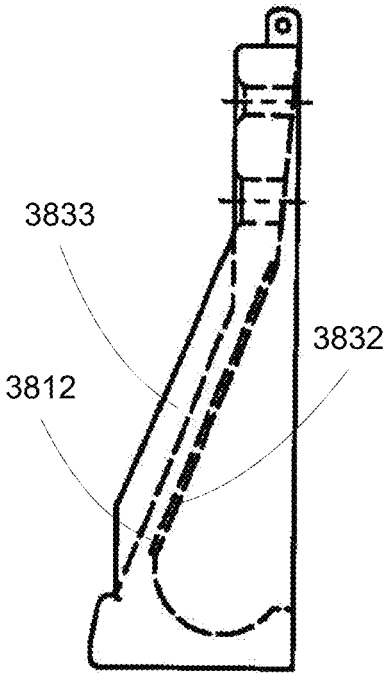

FIG. 38C shows a perspective view of a complete jaw support 3842A and FIG. 38D shows a cross section view of the complete jaw support 3842A. As shown, the reinforced panel 3832 is exposed, but other configurations can be used, such as the reinforced panel is covered with the body material.

In some embodiments, the body portion can include reinforced elements, e.g., thicker materials at high stress areas. The body portion can also include fixtures for mounting peripheral components. The body portion can also include cavities and protrusions for assembly and operation purposes.

Figure 39A:
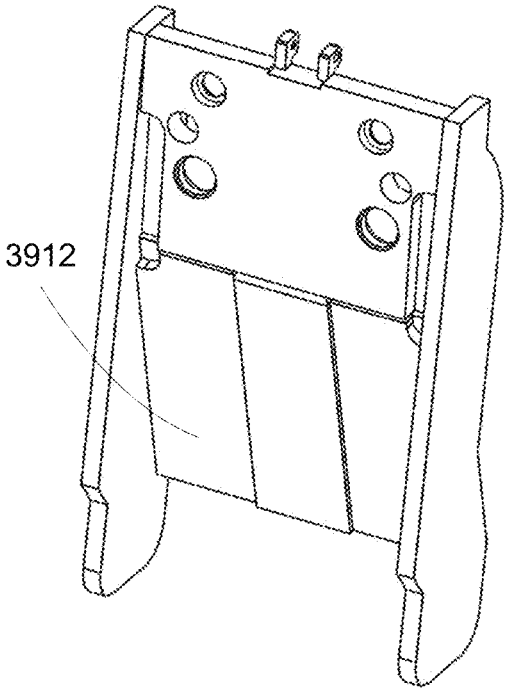
FIGS. 39A-39D illustrate perspective views of a jaw support frame and its corresponded complete jaw support according to some embodiments.
Figure 39B:
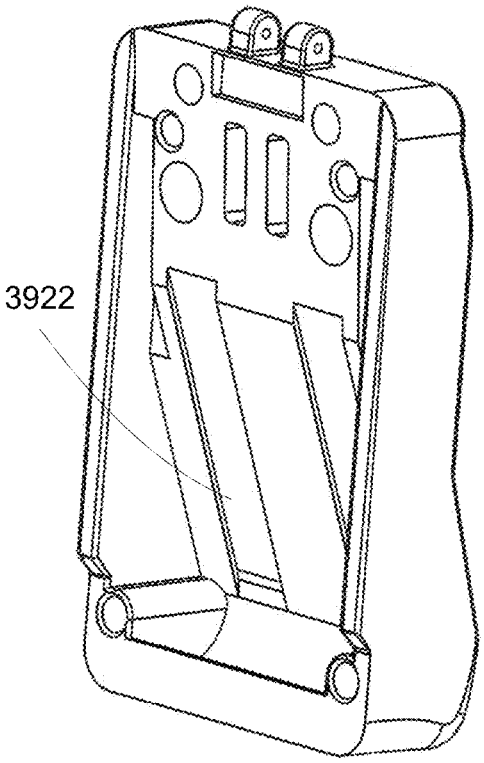

FIGS. 39A-39D illustrate perspective views of a jaw support frame and its corresponded complete jaw support according to some embodiments. In FIG. 39A, a jaw support frame can include a reinforced slanting panel 3912. In FIG. 39B, the complete jaw support can have a middle portion of the slanting panel exposed, together with side portions 3922 recessed along the slanting panel, for example, to prevent rollers of the pulling element from contacting the slanting panel, e.g., the pulling element can have middle rollers for contacting the slanting panel, and side rollers for contacting the jaw disposed facing the jaw support (and not contacting the jaw support).

Figure 39C:
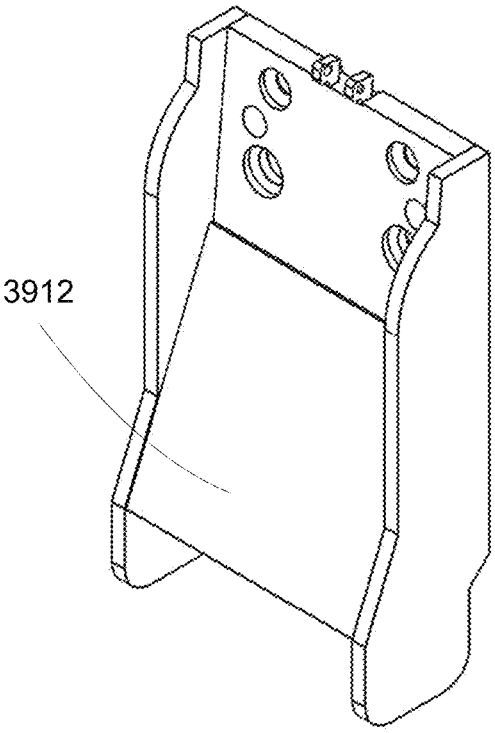
Figure 39D:
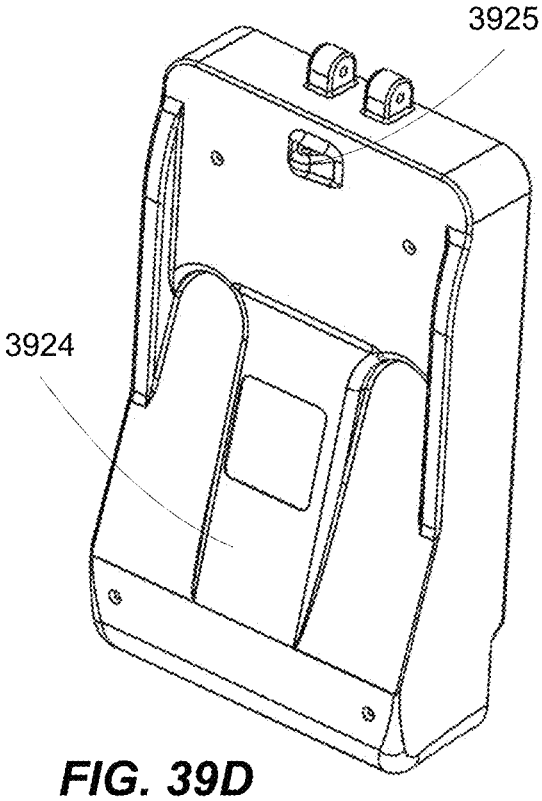

In FIG. 39C, a back side of the reinforced slanting panel 3912 is shown. In FIG. 39D, reinforced element 3924 of the body, e.g., patterned surfaces of the complete jaw support, can be formed, for example, to increase the strength and hardness of the jaw support due to the body material, in addition to reinforced elements on the frame. Further, mounting fixtures 3925 can be added on the body portion, for example, for mounting a release element for the locking mechanism.

Figure 40:
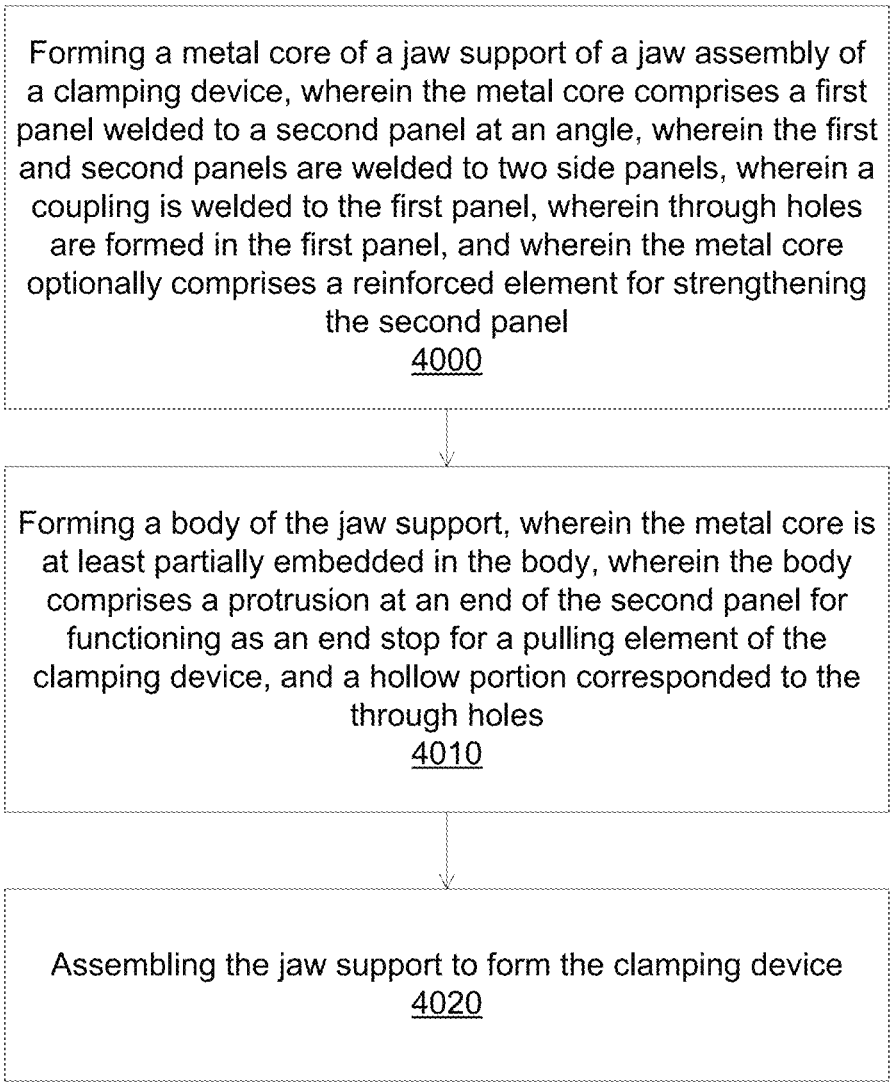
FIG. 40 illustrates a flow chart for forming a clamping device according to some embodiments.
Figure 41A:
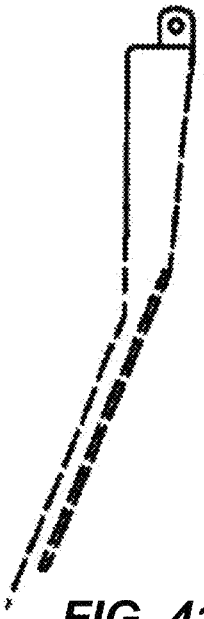
FIGS. 41A-41D show a jaw support configuration having a slanting panel disposed from a bottom portion to a top portion.
Figure 41B:
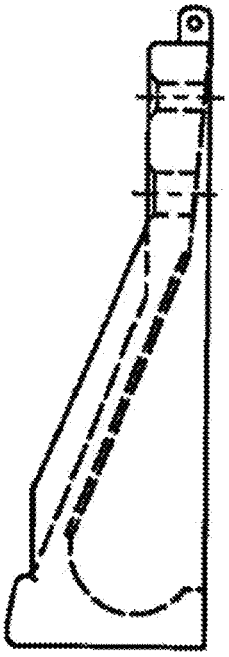
Figure 41C:
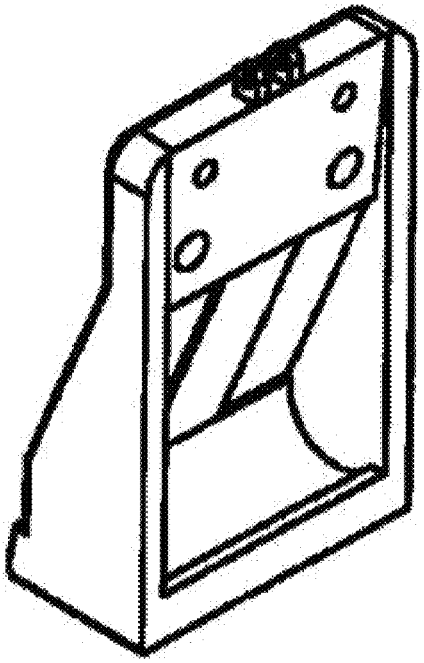
Figure 41D:
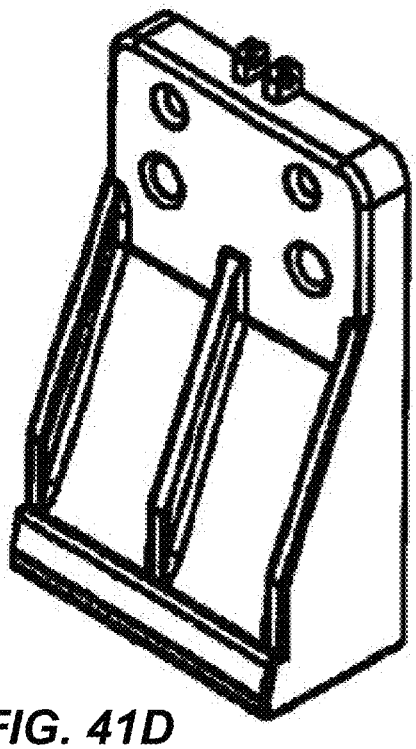
Figure 42A:
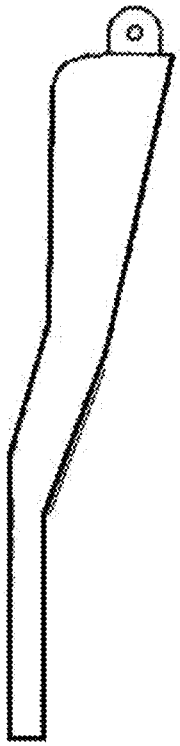
FIGS. 42A-42D show a jaw support configuration having a slanting panel disposed in a middle portion of the jaw support.
Figure 42B:
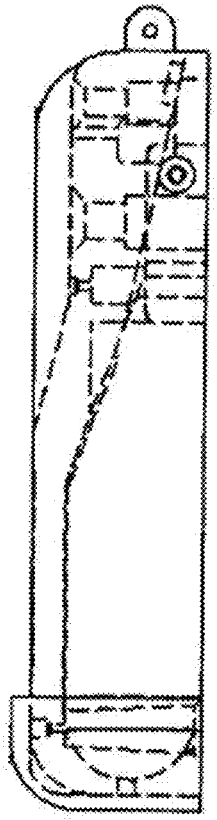
Figure 42C:
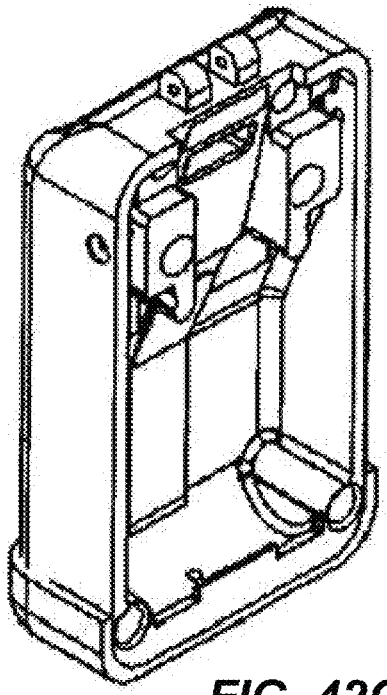
Figure 42D:
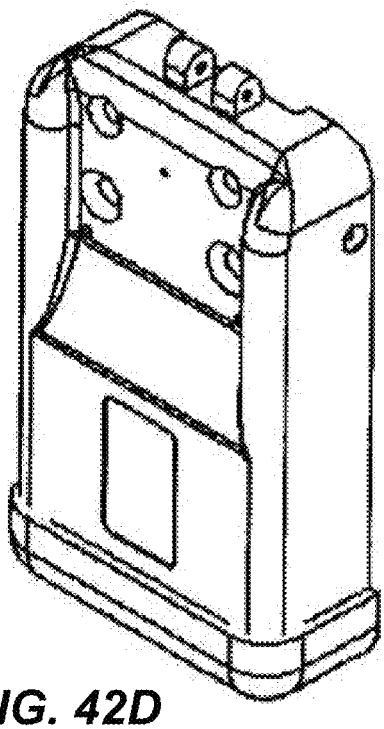
Figure 43A:
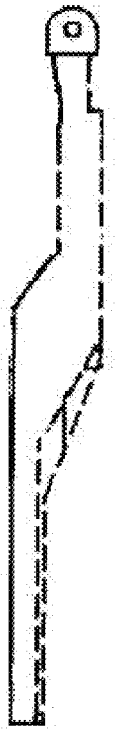
FIGS. 43A-43D show a jaw support configuration having a slanting panel disposed in a middle portion of the jaw support.
Figure 43B:
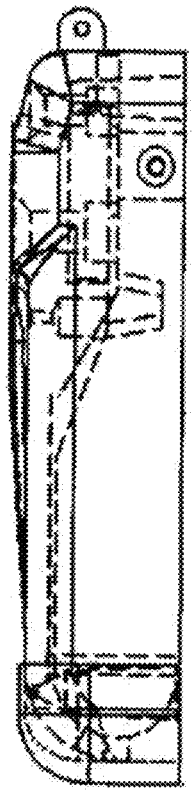
Figure 43C:
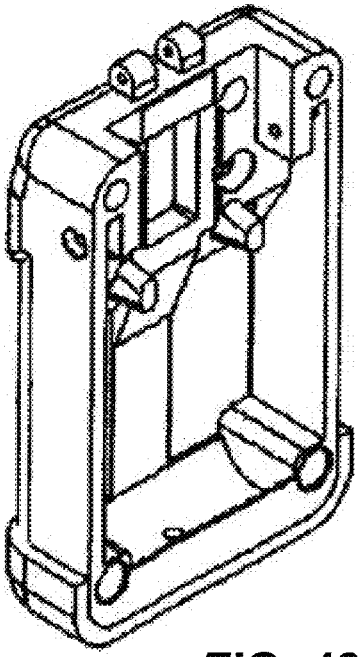
Figure 43D:
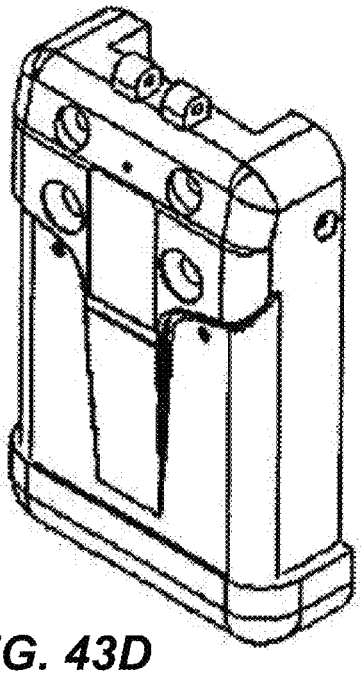
Figure 44A:
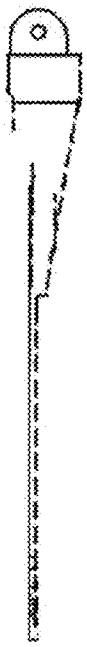
FIGS. 44A-44D show a jaw support configuration having a slanting panel disposed in a middle portion of the jaw support.
Figure 44B:
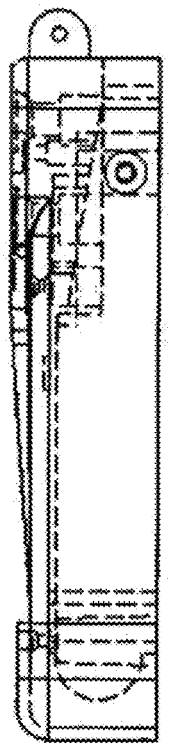
Figure 44C:
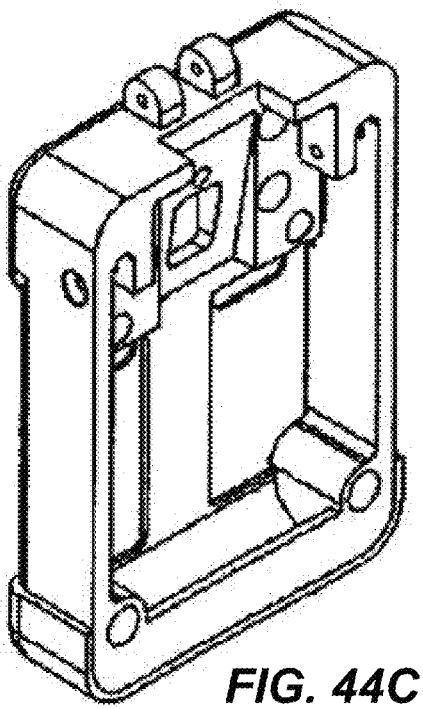
Figure 44D:
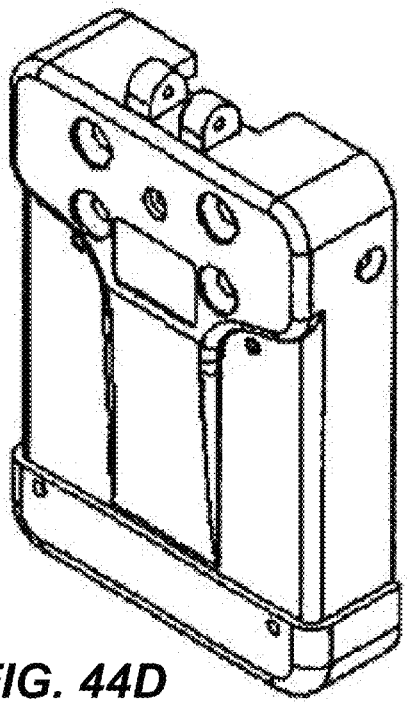

FIG. 40 illustrates a flow chart for forming a clamping device according to some embodiments. A jaw support can include a metal core, e.g., a jaw support frame, embedded in a body portion. The jaw support is then assembled with other components to form the clamping device. Some or all of the other components can be constructed using a body portion surrounding a metal core. Operation 4000 forms Forming a metal core of a jaw support of a jaw assembly of a clamping device, wherein the metal core comprises a first panel welded to a second panel at an angle, wherein the first and second panels are welded to two side panels, wherein a coupling is welded to the first panel, wherein through holes are formed in the first panel, and wherein the metal core optionally comprises a reinforced element for strengthening the second panel. Operation 4010 forms a body of the jaw support, wherein the metal core is at least partially embedded in the body, wherein the body comprises a protrusion at an end of the second panel for functioning as an end stop for a pulling element of the clamping device, a hollow portion corresponded to the through holes. Operation 4020 assembles the jaw support to form the clamping device.

In some embodiments, the jaw support can include different configurations for different applications. The jaw support typically includes a slanting panel, which is configured so that when there is a pulling force acting on the pulling element, a side force is generated pushing the jaw coupled to the jaw support toward the object for increasing a clamping force.

FIGS. 41-44 illustrate configurations for jaw supports according to some embodiments. FIGS. 41A-41D show a jaw support configuration having a slanting panel disposed from a bottom portion to a top portion. Thus when the pulling element starts moving up, the pulling element also moves outward away from the jaw support due to the slanting panel. Front and back reinforced panels can be included for strengthening the slanting panel.

FIGS. 42A-42D show a jaw support configuration having a slanting panel disposed in a middle portion of the jaw support. Thus the pulling element can move straight up for a first portion until reaching the slanting panel. After reaching the slanting panel, the pulling element can also move outward when moving upward. There can be two slanting panels, disposed at different slanting angles. The pulling element can move away at a higher rate at the lower slanting panel as compared to at the upper slanting panel.

FIGS. 43A-43D show a jaw support configuration having a slanting panel disposed in a middle portion of the jaw support. Thus the pulling element can move straight up for a first portion until reaching the slanting panel. After reaching the slanting panel, the pulling element can also move outward when moving upward. There can be large slanting angle, so the pulling element can move outward at a faster rate. The upper panel can be straight, e.g., the pulling element can move straight upward after passing the slanting panel.

FIGS. 44A-44D show a jaw support configuration having a slanting panel disposed in a middle portion of the jaw support. Thus the pulling element can move straight up for a first portion until reaching the slanting panel. After reaching the slanting panel, the pulling element can also move outward when moving upward.

Figure 45A:
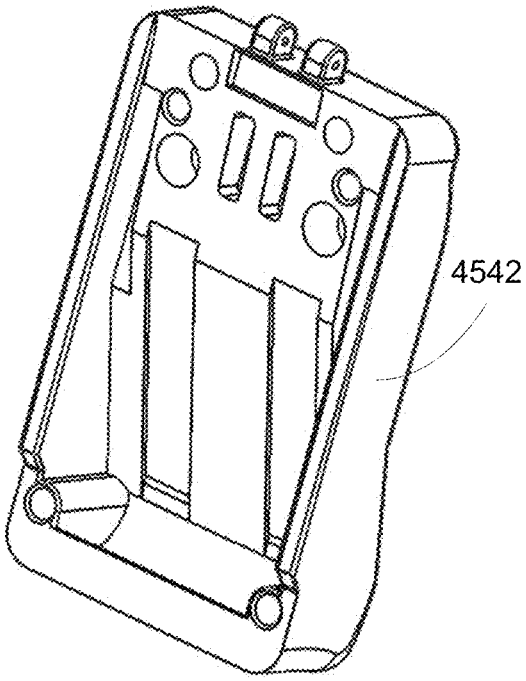
FIGS. 45A-45E illustrate an assembling process for a clamping device according to some embodiments.
Figure 45B:
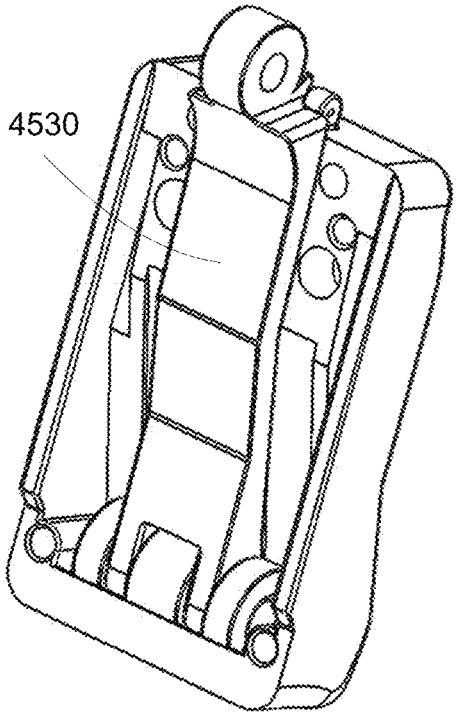
Figure 45C:
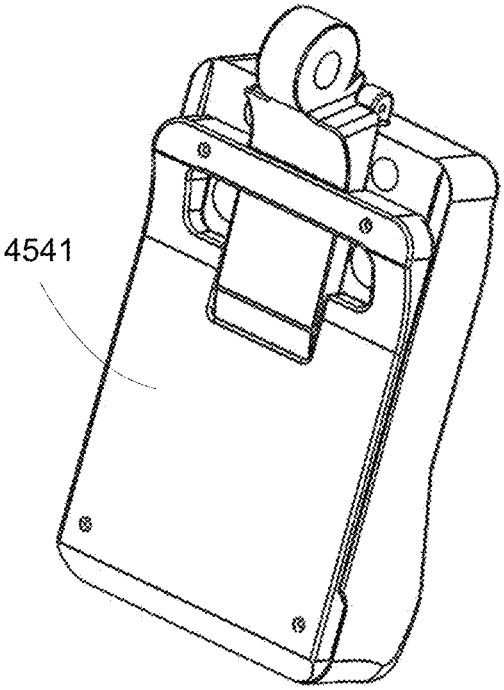
Figure 45D:
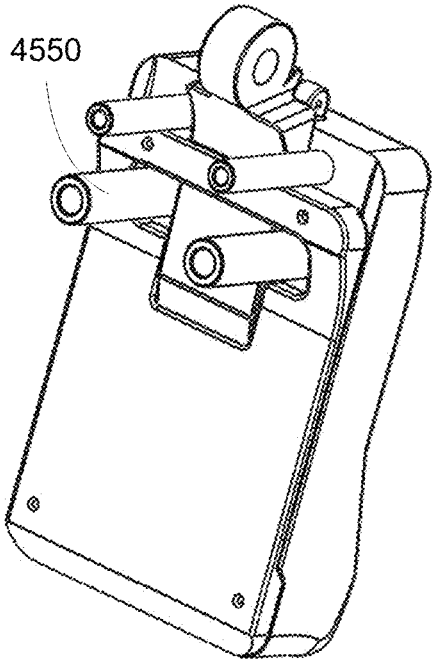
Figure 45E:
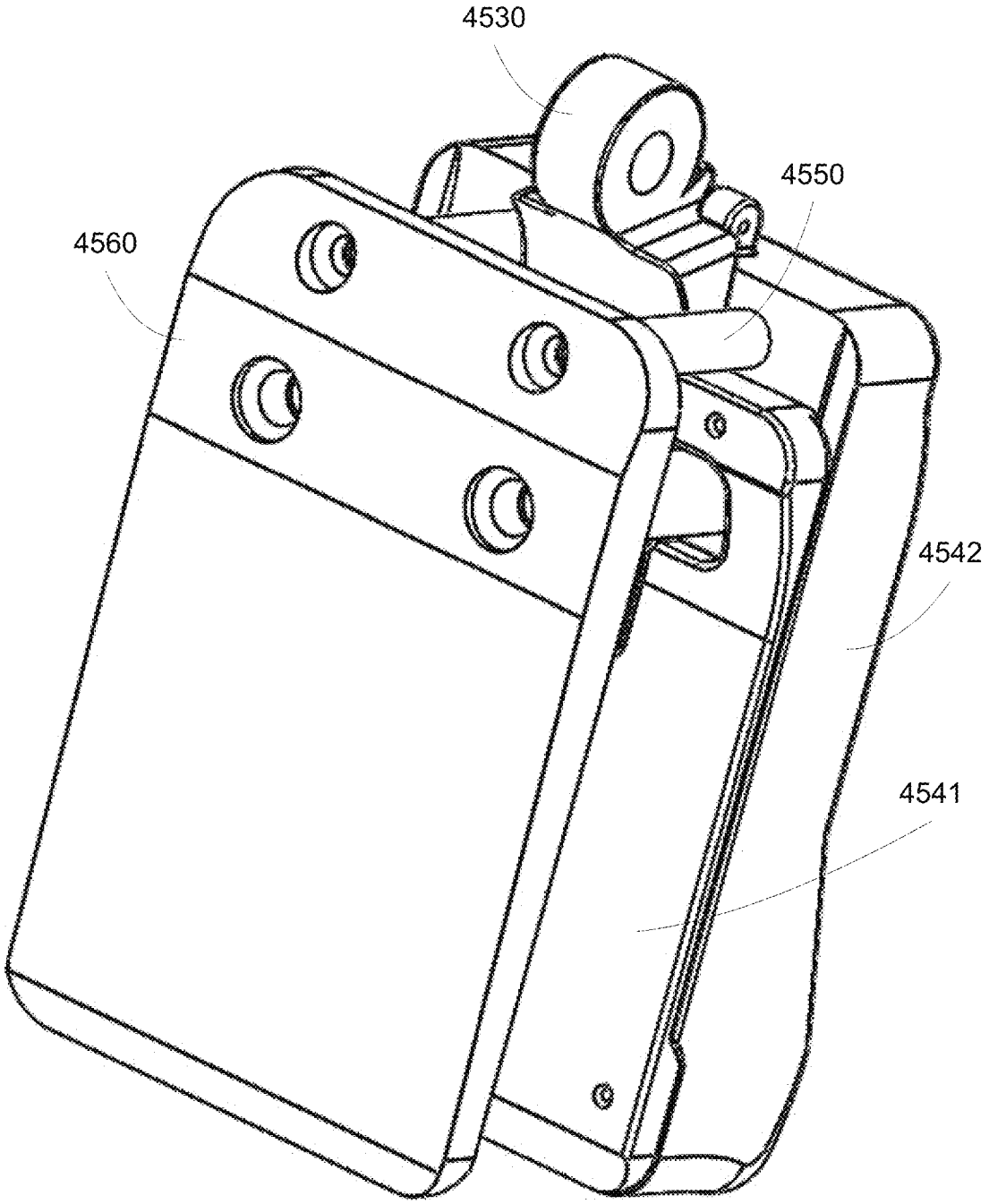

FIGS. 45A-45E illustrate an assembling process for a clamping device according to some embodiments. In FIG. 45A, a jaw support 4542 can be formed, including a metal core or frame embedded in a body portion. In FIG. 45B, a pulling element 4530 can be placed in a hollow portion of the jaw support. In FIG. 45C, a jaw 4541 can be coupled to the jaw support, closing the hollow portion. In FIG. 45D, clamp bar 4550 can be installed, e.g., multiple connection bars can be secured to the jaw support. The pulling element can be disposed between the connection bars, for example, to constrain the pulling element in a side direction of the jaw support. In FIG. 45E, an opposite jaw 4560 can be installed, which is coupled to the connection bars 4550.

FIGS. 46-49 illustrate operations of a clamping device according to some embodiments. FIGS. 46A-46D show a locking mechanism 4635 to secure a pulling element 4630 to a jaw support 4642. At a rest position, the pulling element is disposed against a bottom portion of the jaw support (FIG. 46A). The locking mechanism 4635 can be used to secure the pulling element to the jaw support (FIG. 46B).

The locking mechanism can lock the pulling element to a downward most position, e.g., a position that minimizes the gap distance between the jaw and the jaw support, or a position that makes the jaw closest to the jaw support. Together with springs pulling on the jaw toward the jaw support, the locking mechanism can keep the jaw of the jaw assembly away from the opposite jaw in the clamping device, e.g., making sure that the opening between the jaws of the clamping device is largest possible so that it can be easier to put the object into the jaws.

Figure 46A:
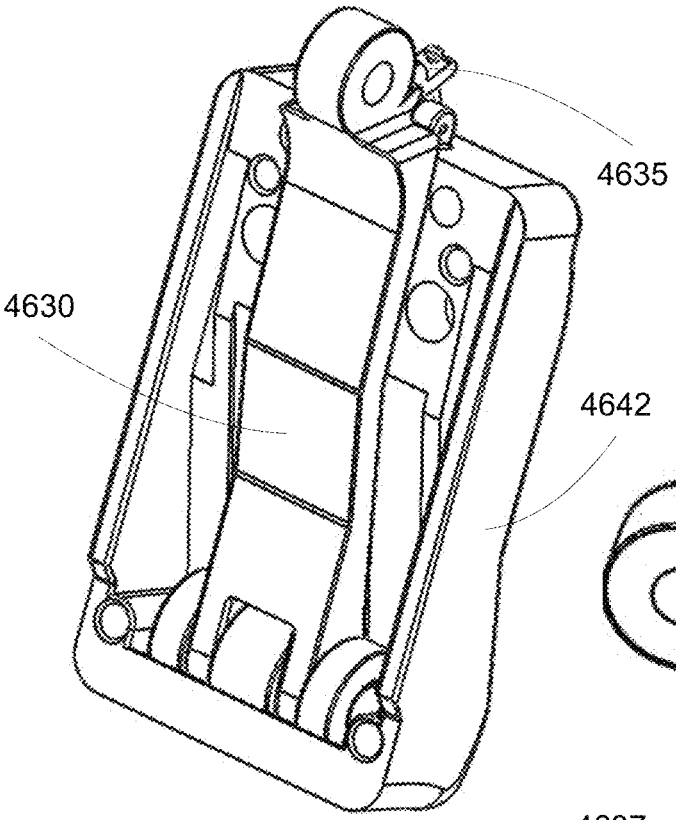
FIGS. 46A-46D illustrate operations of a clamping device according to some embodiments.
Figure 46B:
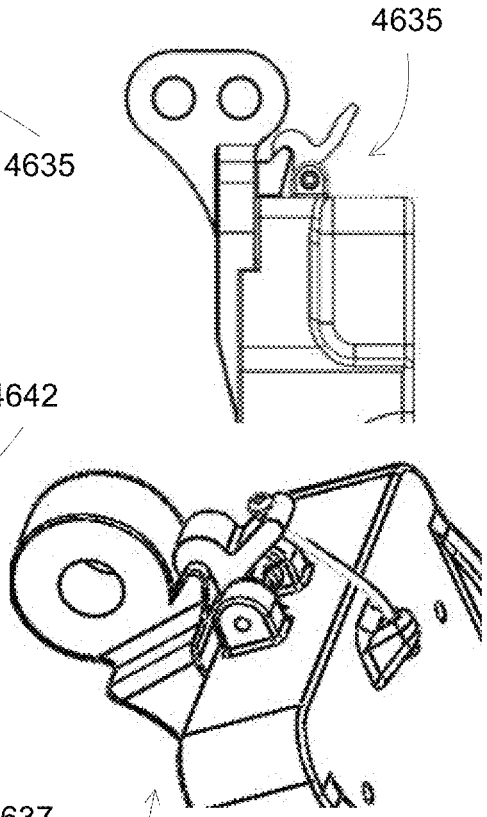
Figure 46C:
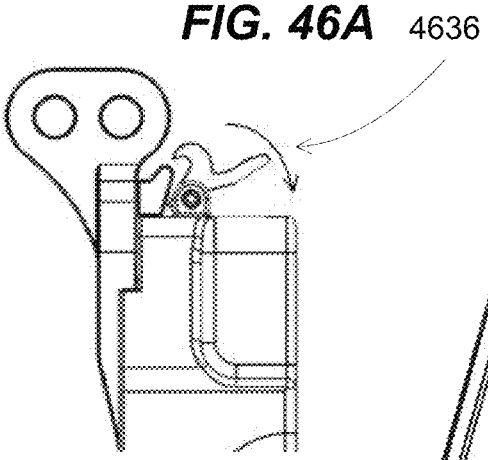

The locking mechanism can include a latch, which can be rotated around a center or rotation on the jaw support. Rotating forward in one direction, the latch can engage with a hook in the pulling element, preventing the pulling element from moving upward. Rotating backward 4636, the latch can disengage from the hook, allowing the pulling element to move upward (FIG. 46C).

The latch can be configured for automatic lock, e.g., from the unlocked or disengaged position, the pulling element can be pushed down, and the hook can push on a level of the latch, swinging the latch counterclockwise to lock or engage with the hook. A spring can be included, to keep the latch in engaged position. The pulling element, when pushed down, can swing the latch clockwise to open the latch. When the pulling element is at the lowest position, the latch can swing back to lock with the hook.

Figure 46D:
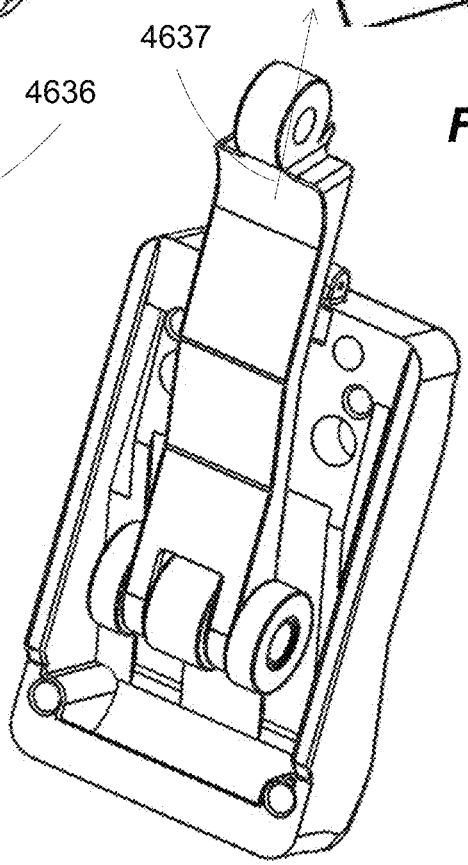

When the pulling element moves upward 4637, for example, by a force applied to the pulling element, the rollers can roll on a slanting surface of the jaw support (FIG. 46D). Some rollers can roll on a surface of the jaw (not shown).

Figure 47A:
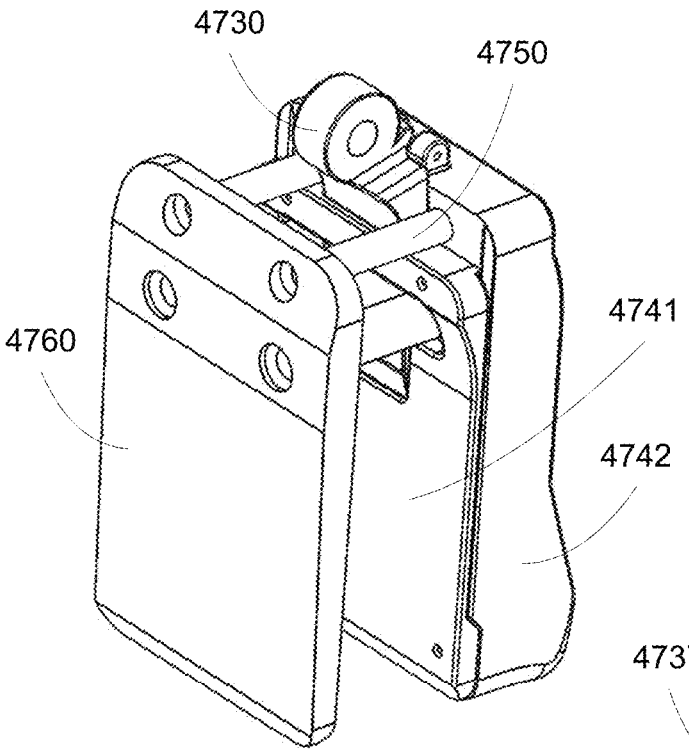
FIGS. 47A-47B illustrate operations of a clamping device according to some embodiments.
Figure 47B:
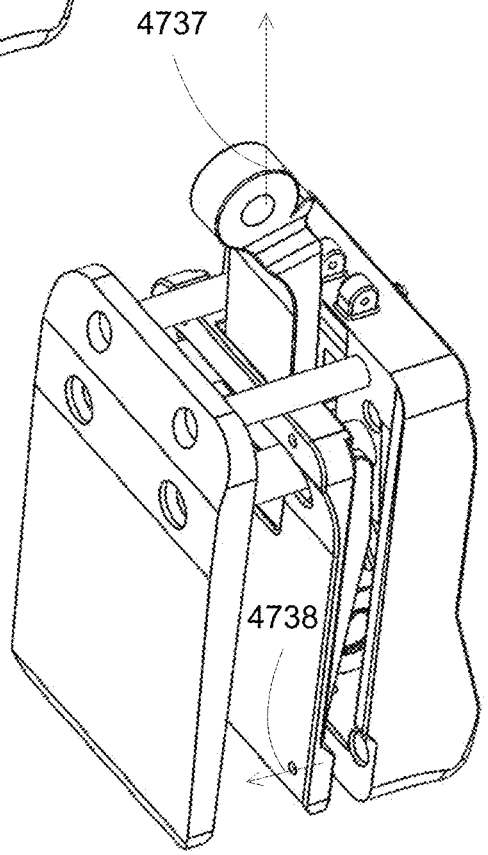

FIGS. 47A-47B show movements of the pulling element 4730, and corresponding movements of the jaw 4741 coupled to the jaw support 4742. In FIG. 47A, the pulling element is at rest, e.g., at a bottom most position. In FIG. 47B, the pulling element moves upward 4737, which results in the jaw 4741 moving outward 4738 toward the other jaw 4760. The pulling element can be disposed between the connection bars of the clamp bar 4750, which can allow the pulling element to move upward and forward, and can constrain the pulling element from moving sideward, e.g., perpendicular to upward and forward directions.

Figure 48A:
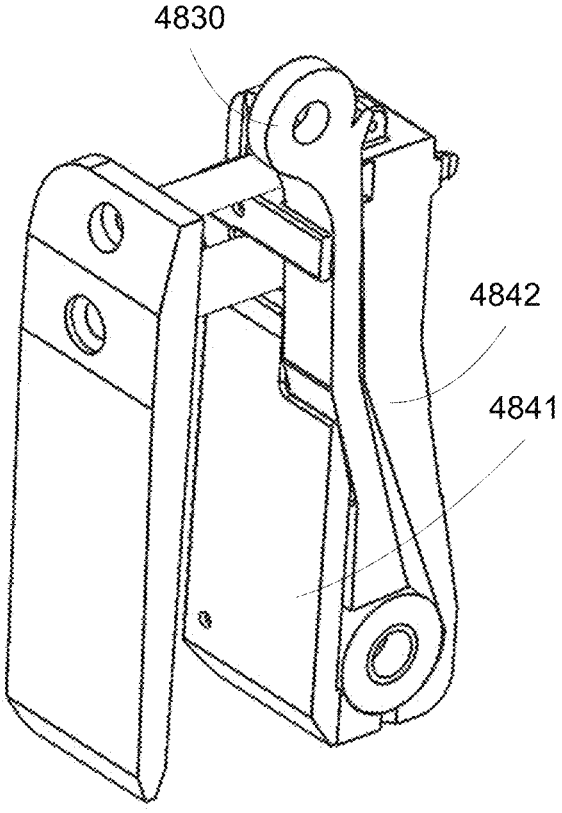
FIGS. 48A-48D illustrate operations of a clamping device according to some embodiments.
Figure 48B:
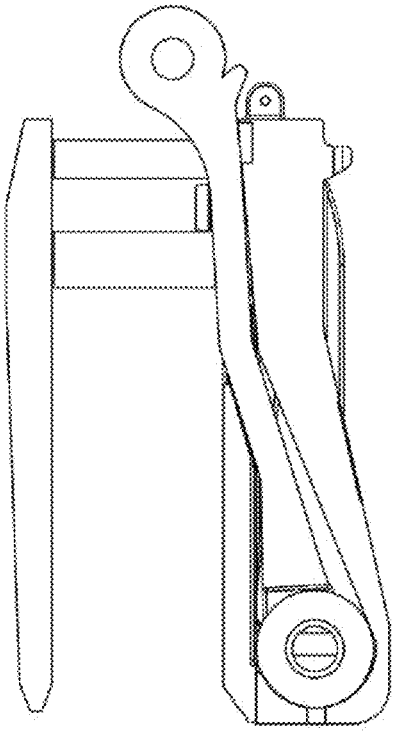
Figure 48C:
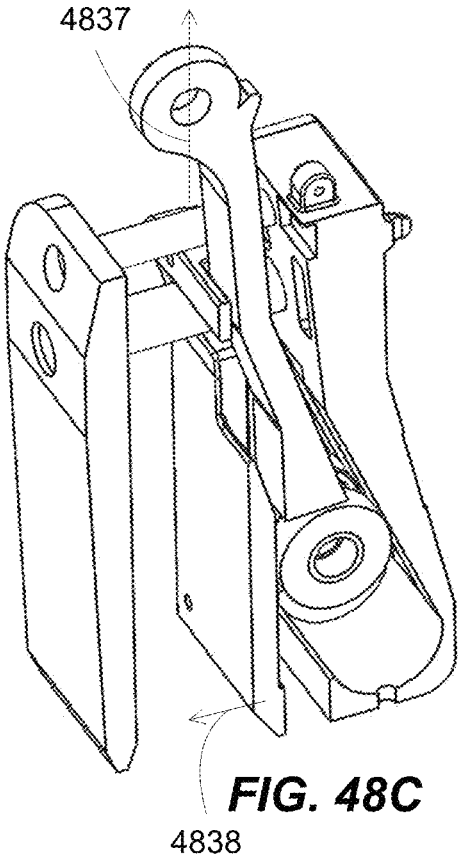
Figure 48D:
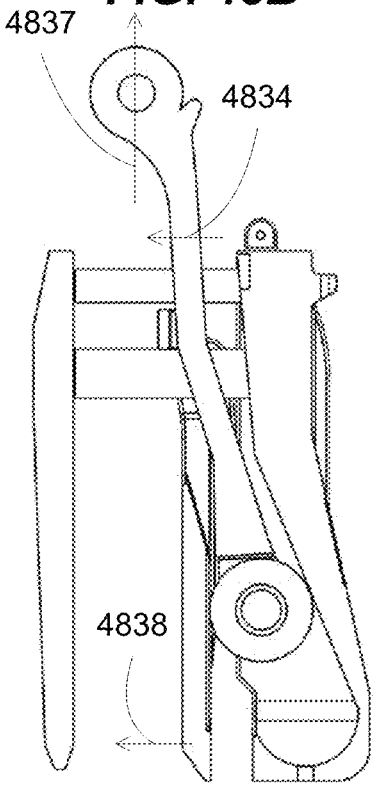

FIGS. 48A-48B show cross section views of the movements of the pulling element 2930, and corresponding movements of the jaw 4841 coupled to the jaw support 4842. At rest, the pulling element is at the down most position (FIGS. 48A and 48B). When a force is applied to the pulling element, the pulling element can move upward 4837 and forward 4834, for example, due to the slanting surface of the jaw support. The forward movement of the pulling element can generate a forward movement 4838 of the jaw 4841.

If the jaw 4841 is blocked, for example, by the object, a force lifting the pulling element can generate a forward pushing the jaw toward the object.

FIGS. 49A-49B illustrate flow charts for forming a clamping device according to some embodiments. In FIG. 49A, operation 4900 forms a clamping device, wherein the clamping device comprises a first jaw coupled to a clamp bar, and a jaw assembly coupled to the clamp bar, wherein the jaw assembly comprises a second jaw disposed opposite the first jaw for clamping on an object, wherein the jaw assembly comprises a jaw support, wherein the jaw assembly comprises a hanging element disposed between the second jaw and the jaw support, wherein at least an interface between the hanging element and the jaw support and an interface between the hanging element and the second jaw comprises a slanting surface, wherein the slanting surface is configured so that when the clamping device is lifted up from the hanging element, the second jaw is configured to press on the object.

In FIG. 49B, operation 4920 forms a clamping device, wherein the clamping device comprises a clamp bar, a first jaw, and a jaw assembly, wherein the jaw assembly comprises a jaw support, wherein at least one of the first jar or the jaw support is configured to movably couple to the clamp bar and to lockably coupled to the clamp bar at discrete positions through a locking mechanism, wherein the jaw assembly comprises a second jaw disposed opposite the first jaw for clamping on an object, wherein the second jaw is coupled to the jaw support through a flexible component to allow the second jaw to move in multiple directions with respect to the jaw support, wherein the jaw assembly comprises a hanging element disposed between the second jaw and the jaw support, wherein at least an interface between the hanging element and the jaw support and an interface between the hanging element and the second jaw comprises a slanting surface, wherein the slanting surface interface comprises a rolling friction, wherein the slanting surface is configured so that when the hanging element moves in a direction comprising a vertical direction, the second jaw moves away relative to the jaw support in a direction comprising a horizontal direction.

Figure 50A:
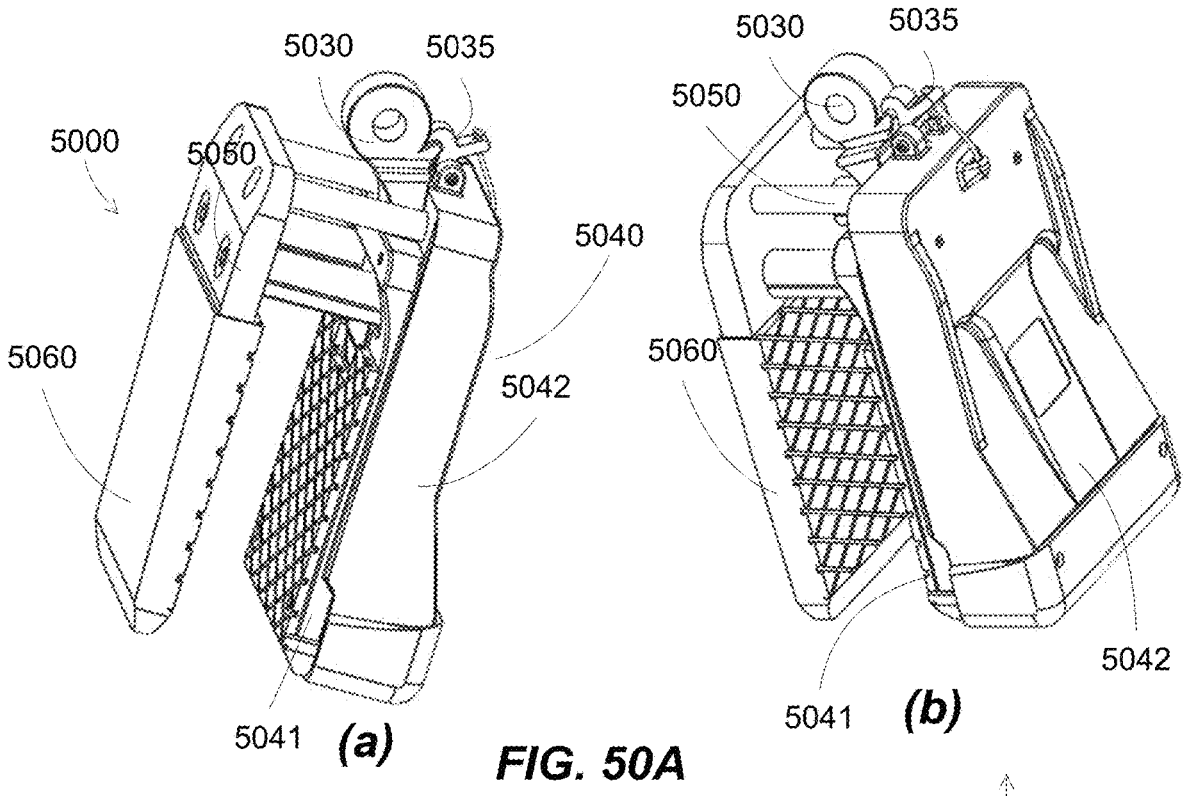
FIGS. 50A (a)-(b)-50B (a)-(c) illustrate an operation of a clamping device according to some embodiments.

FIGS. 50A (a)-(b)-50B (a)-(c) illustrate an operation of a clamping device according to some embodiments. FIG. 50A (a)-(b) show perspective views of a clamping device 5000 configured for lifting heavy objects. The clamping device can include a first jaw 5060 fixedly coupled to a clamp bar 5050. The clamping device can include a second jaw assembly 5040, which can also be fixedly coupled to the clamp bar. The second jaw assembly can include a second jaw 5041 disposed opposite the first jaw. The second jaw assembly can include a jaw support 5042, which can fixedly couple to the clamp bar. The second jaw assembly can include stretchable elements, such as springs (not shown), which can be coupled to the second jaw and the jaw support, for pulling the second jaw toward the jaw support. The stretchable elements can allow the second jaw to move away from the jaw support, for a limited distance, such as a distance equal or smaller than a distance between the discrete locking locations of the discrete locking mechanism.

The clamp bar can include connection bars that serve as end point limits to prevent the second jaw from moving too far from the jaw support.

The clamping device can include a pulling element 5030, which can be configured to be pulled on for lifting the clamped object. The pulling element can freely move in an up direction. The pulling element can be configured to exert a clamping force on the object when being pulled, for example, through slanting surfaces of the components of the second jaw assembly, such as a slanting interface between the pulling element and the jaw support.

A locking mechanism 5035 can be coupled to the second jaw assembly to prevent the pulling element from being pulled up.

Figure 50B:
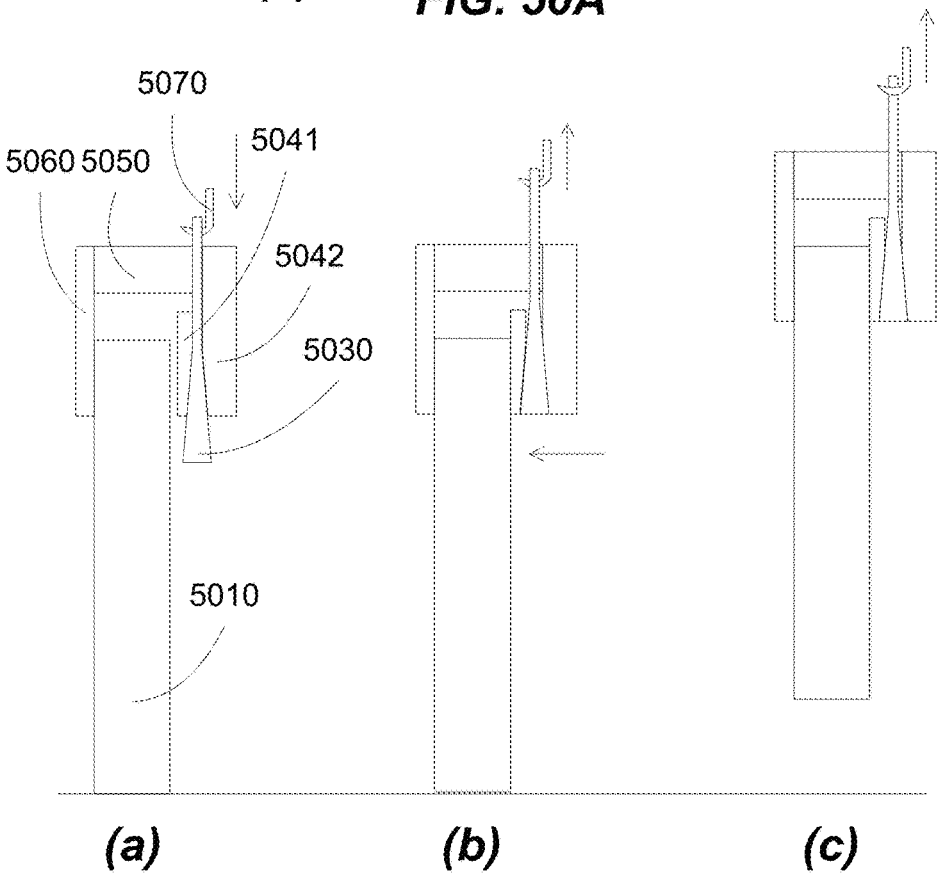

FIG. 50B (a)-(c) show an operation of the clamping device. In FIG. 50B (a), the pulling element 5030 can be in a down most position, and locked by the locking mechanism. Due to the stretchable elements, the second jaw 5041 can be pulled toward the jaw support 5042.

In FIG. 50B (b), the pulling element can be pulled up, for example, by a hoist 5070 hooking to the pulling element. The pulling on the pulling element can push the second jaw toward the object for clamping the object. In FIG. 50B (c), further pulling on the pulling element can lift the object above the ground to move to a new location.

Figure 51A:
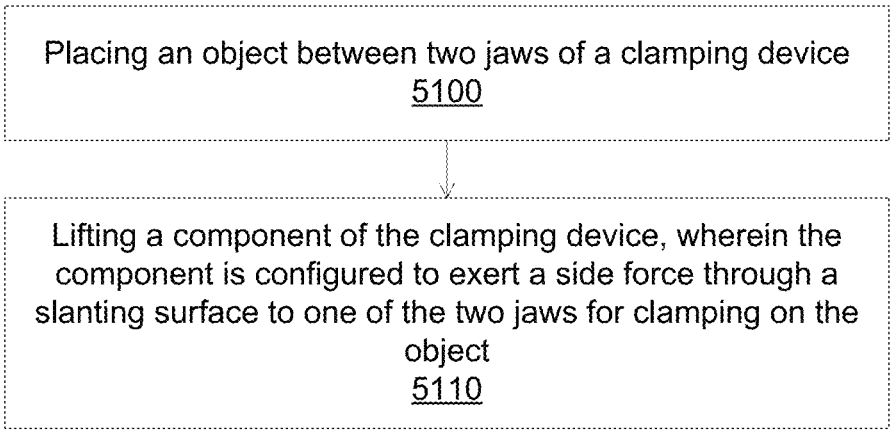
FIGS. 51A-51B illustrate flow charts for operating a clamping device according to some embodiments.
Figure 51B:
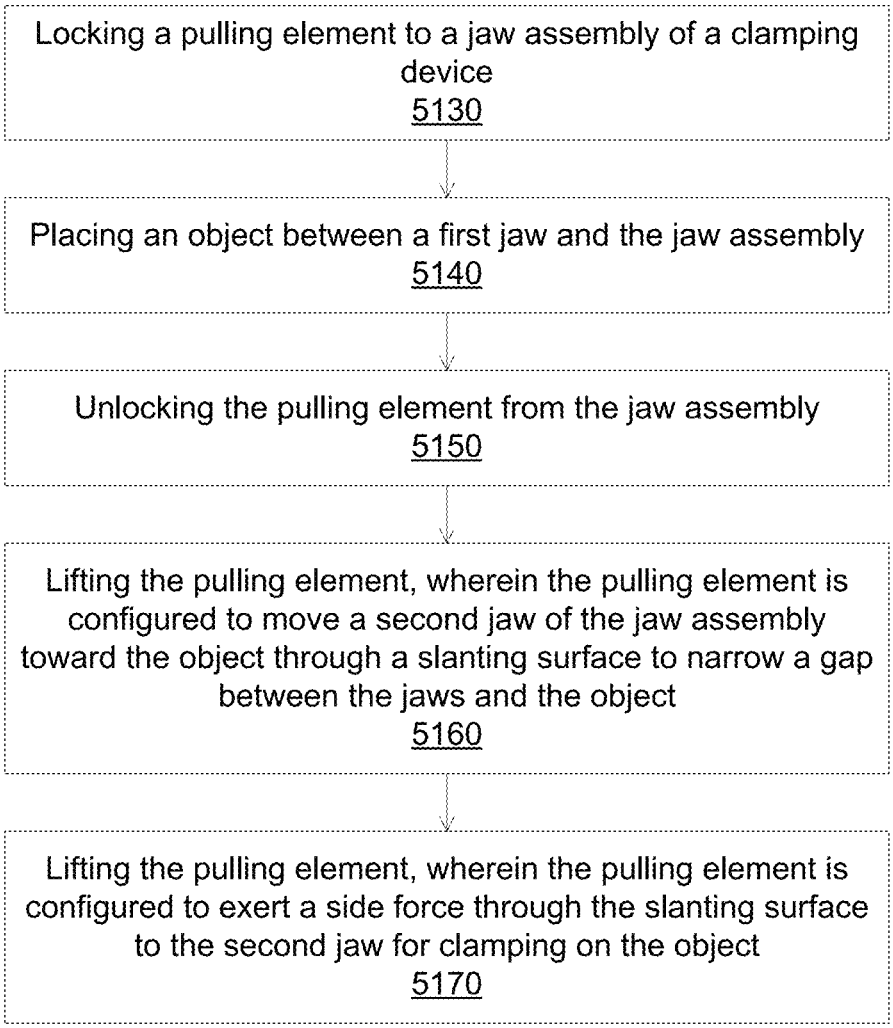

FIGS. 51A-51B illustrate flow charts for operating a clamping device according to some embodiments. In FIG. 51A, operation 5100 places an object between two jaws of a clamping device. Operation 5110 lifts a component of the clamping device, wherein the component is configured to exert a side force through a slanting surface to one of the two jaws for clamping on the object.

In FIG. 51B, operation 5130 locks a pulling element to a jaw assembly of a clamping device. Operation 5140 places an object between a first jaw and the jaw assembly. Operation 5150 unlocks the pulling element from the jaw assembly. Operation 5160 lifts the pulling element, wherein the pulling element is configured to move a second jaw of the jaw assembly toward the object through a slanting surface to narrow a gap between the jaws and the object. Operation 5170 lifts the pulling element, wherein the pulling element is configured to exert a side force through the slanting surface to the second jaw for clamping on the object.

What is claimed is:

1. A clamping device comprising a clamp bar;

a first jaw assembly coupled to the clamp bar, wherein the first jaw assembly comprises a first jaw;

a second jaw assembly coupled to the clamp bar, wherein the second jaw assembly comprises a jaw support, wherein the second jaw assembly comprises a second jaw, wherein the second jaw is coupled to the jaw support, wherein the first jaw and the second jaw are configured for clamping on an object, a pulling element interfacing with the jaw support and the second jaw, wherein at least one of the interface between the pulling element and the jaw support and the interface between the pulling element and the second jaw comprises a slanting interface, wherein the slanting interface is configured so that when a force is applied to the pulling element in a direction comprising a vertical direction, a second force is generated pushing the second jaw in a direction comprising a direction from the second jaw to the first jaw.

2. A clamping device as in claim 1 wherein there is at least one of wherein the first jaw assembly or the first jaw is fixedly coupled to the clamp bar, wherein the first jaw assembly or the first jaw is movably coupled to the clamp bar, wherein the first jaw assembly or the first jaw is movably coupled to the clamp bar through a first locking mechanism for securing the first jaw assembly or the first jaw to the clamp bar, wherein the second jaw assembly, the jaw support, or the second jaw is fixedly coupled to the clamp bar, and wherein the second jaw assembly, the jaw support, or the second jaw is movably coupled to the clamp bar, wherein the second jaw assembly, the jaw support, or the second jaw is movably coupled to the clamp bar through a second locking mechanism for securing the second jaw assembly, the jaw support, or the second jaw to the clamp bar.

3. A clamping device as in claim 1 wherein the jaw support is configured to be secured to the clamp bar at discrete locations.

4. A clamping device as in claim 1 wherein the jaw support is configured to be secured to the clamp bar at continuous locations.

5. A clamping device as in claim 1 further comprising a mechanism comprising a screw for moving the second jaw assembly continuously along a portion of the clamp bar.

6. A clamping device as in claim 1 wherein the pulling element comprises one or more rollers, wherein the one or more rollers are configured to roll on the slanting surface.

7. A clamping device as in claim 1 wherein one end of the pulling element comprises one or more rollers, wherein at least a first roller of the one or more rollers is configured to roll on a surface of the second jaw, wherein at least a second roller of the one or more rollers is configured to roll on a surface of the jaw support.

8. A clamping device as in claim 1 wherein the jaw support is coupled to the clamp bar, wherein the second jaw is flexibly coupled to the jaw support.

9. A clamping device as in claim 1 further comprising a lead screw or a ball screw for continuously moving the second jaw assembly along the clamp bar.

10. A clamping device as in claim 1
wherein the jaw support is movably coupled to the clamp bar,
wherein the second jaw is flexibly coupled to the jaw support.

11. A clamping device as in claim 1
wherein the second jaw is flexibly coupled to the jaw support so that the second jaw is coupled to the jaw support but is able to move in multiple directions relative to the jaw support.

12. A clamping device as in claim 1
wherein the second jaw is coupled to the jaw support through one or more springs.

13. A clamping device as in claim 1
wherein the second jaw is coupled to the jaw support through one or more springs, wherein the strength of the one or more springs is configured to secure the second jaw to the jaw support when the pulling element is not moving, and wherein the strength of the one or more springs is configured to allow the second jaw to move relative to the jaw support when the pulling element is moving in the direction comprising the vertical direction.

14. A clamping device as in claim 1 further comprising
a limiting element coupling to the second jaw, wherein the limiting element is configured to limit a movement of the second jaw with respect to the jaw support.

15. A clamping device as in claim 1 further comprising
one or more bars coupled to the jaw support or to the clamp bar, wherein the one or more bars pass through the second jaw at an opening larger than the cross section of the one or more bars to support the second jaw and to limit a sliding movement of the second jaw with respect to the jaw support.

* * * * *